US007192207B2

(12) United States Patent
Ohashi et al.

(10) Patent No.: US 7,192,207 B2
(45) Date of Patent: Mar. 20, 2007

(54) BOTH-SIDE RECORDING APPARATUS AND RECORDING METHOD

(75) Inventors: Tetsuyo Ohashi, Kanagawa (JP); Takeshi Sekino, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 6 days.

(21) Appl. No.: 10/925,028

(22) Filed: Aug. 25, 2004

(65) Prior Publication Data

US 2005/0058480 A1 Mar. 17, 2005

(30) Foreign Application Priority Data

Aug. 29, 2003 (JP) ..... 2003-306417

(51) Int. Cl.
*B41J 3/60* (2006.01)
*B41J 25/308* (2006.01)

(52) U.S. Cl. ..... 400/188; 400/59; 347/8

(58) Field of Classification Search ..... None
See application file for complete search history.

(56) References Cited

U.S. PATENT DOCUMENTS

| | | | | |
|---|---|---|---|---|
| 5,398,049 | A * | 3/1995 | Terasawa et al. | 347/8 |
| 6,089,773 | A * | 7/2000 | Bailey et al. | 400/642 |
| 6,332,068 | B2 | 12/2001 | Blackman et al. | 399/364 |
| 6,554,416 | B2 * | 4/2003 | Koto | 347/104 |
| 6,659,603 | B2 * | 12/2003 | Kida et al. | 347/104 |
| 6,793,425 | B2 | 9/2004 | Yoshikawa et al. | 400/624 |

FOREIGN PATENT DOCUMENTS

| | | | |
|---|---|---|---|
| JP | 2000218893 A | * | 8/2000 |
| JP | 2002-67407 | | 3/2002 |
| JP | 2002127541 A | * | 5/2002 |
| JP | 2004098412 A | * | 4/2004 |

OTHER PUBLICATIONS

Machine translation of JP 2004-98412 to Ninomiya from Japanese Patent Office website.*
Machine translation of JP 2002127541 to Shimomura et al. from Japanese Patent Office website.*

* cited by examiner

*Primary Examiner*—Daniel J. Colilla
(74) *Attorney, Agent, or Firm*—Fitzpatrick, Cella, Harper & Scinto

(57) ABSTRACT

In both-side recording, wherein the fed recording sheet is conveyed to the recording portion and after the recording is executed on a face side surface, the recording sheet is conveyed to a sheet reversing portion where both sides are reversed, and is sent to the recording portion again where the rear side surface is recorded, a clearance between the recording head and the recording sheet can be changed when recording on the face side or the rear side surface. A first clearance suitable for the recording sheet having a standard thickness and material, and a second clearance greater than the first clearance, can be selected. When there is a possibility that the recording head can come into contact with the recording sheet due to influences from warping and the like, the second clearance is selected, and when there is less possibility of contact, a first clearance is selected.

6 Claims, 23 Drawing Sheets

BOTH-SIDE RECORDING APPARATUS AND RECORDING METHOD

BACKGROUND OF THE INVENTION

1. Field of the Invention

The present invention relates to a both-side recording apparatus for automatically executing a recording on both the front surface and the rear surface of a recording sheet which is a recorded medium (i.e. a medium to be recorded), and more in particular, it relates to a both-side recording apparatus comprising a sheet reversing portion for reversing the recorded medium in a printed state on one surface only, and a recording method including the both-side recording.

2. Description of the Related Art

Heretofore, as a configuration for executing an automatic both-side recording in the recording apparatus such as an inkjet recording apparatus and the like, there have been executed or proposed apparatuses of several systems. They are configured such that, after having completed a recording on the front side surface (first surface) of the recording sheet which is the recorded medium, the recording sheet is conveyed to a sheet reversing portion, and at the sheet reversing portion, the recording sheet is reversed and after that, the recording sheet is conveyed to a recording portion again, where a recording on a rear side surface (second surface) of the recording sheet is executed. From among such both-side recording apparatuses, the inventions disclosed in U.S. Pat. No. 6,332,068 and Japanese Patent Application Laid-Open No. 2002-67407 are configured such that a clearance between the recording sheet and the recording portion is not adjustable, but fixed constant at all times. Further, there exist the recording apparatuses wherein the clearance between the recording sheet and the recording portion is adjustable, and before starting a recording operation, the clearance between the recording sheet and the recording portion has to be decided in advance.

In any of the above-described conventional examples, during the recording operation on one sheet of the recording sheet, it is not possible to change the clearance between the recording sheet and the recording portion. However, there are sometimes the cases where a state of the recording sheet is not always the same when recording on the face side surface of the recording sheet and recording on the rear side surface of the recording sheet. In such cases, when the recording apparatus is set in a state most suitable for the processing of any surface of the recording sheet (for example, a recording on the face side surface), there is a possibility that the recording apparatus is not always in a state most suitable for executing a processing of the other side surface (for example, a recording on the rear side surface). The cause of such difference in the state of the recording sheet comes from, for example, a warp inherent in the recording sheet and the warp resulting from the recording operation on the first surface of the recording sheet.

As with the above-described conventional example, when the clearance between the recording sheet and the recording portion is constant at the time of recording on the face side surface of the recording sheet and at the time of recording on the rear side surface of the recording sheet after the sheet is reversed, there is a possibility of a trouble to occur at the time of recording on any side of the surface. For example, when the clearance between the recording portion and the recording sheet is set comparatively narrow, the recording portion and the recording sheet are brought into contact due to the warp of the recording sheet, thereby causing an unintended ink adherence to the recording sheet or a possibility of an external force applied to prevent an accurate conveyance of the recording sheet. On the other hand, when the clearance between the recording portion and the recording sheet is set wider than necessary in anticipation of the warp of a sheet material in advance, there is a possibility of a recording dignity to be deteriorated, and particularly when the inkjet recording is executed, it is probable that the recording dignity is worsened.

SUMMARY OF THE INVENTION

It is an object of the present invention to provide an both-side recording apparatus and a recording method including a both-side recording, which are capable of preventing an unintended adherence of ink to a recording sheet and a lowering in the conveying accuracy of the recording sheet in case of using a warped recording sheet or even in the case where the recording sheet is warped as a result of the recording operation on the face side surface (a first surface), and moreover, are capable of executing a steady recording operation without deteriorating a recording dignity.

It is another object of the present invention to provide a both-side recording apparatus for executing a recording on both surfaces of the recording sheet by a recording head, said apparatus comprising a conveying portion for conveying the recording sheet, and a sheet reversing portion for reversing the recording sheet, wherein the clearance between the recording head and the recording sheet is changed when executing the recording on the first surface of the recording sheet and the recording on the second surface of the recording sheet.

DETAILED DESCRIPTION OF THE PREFERRED EMBODIMENTS

Figure 1:
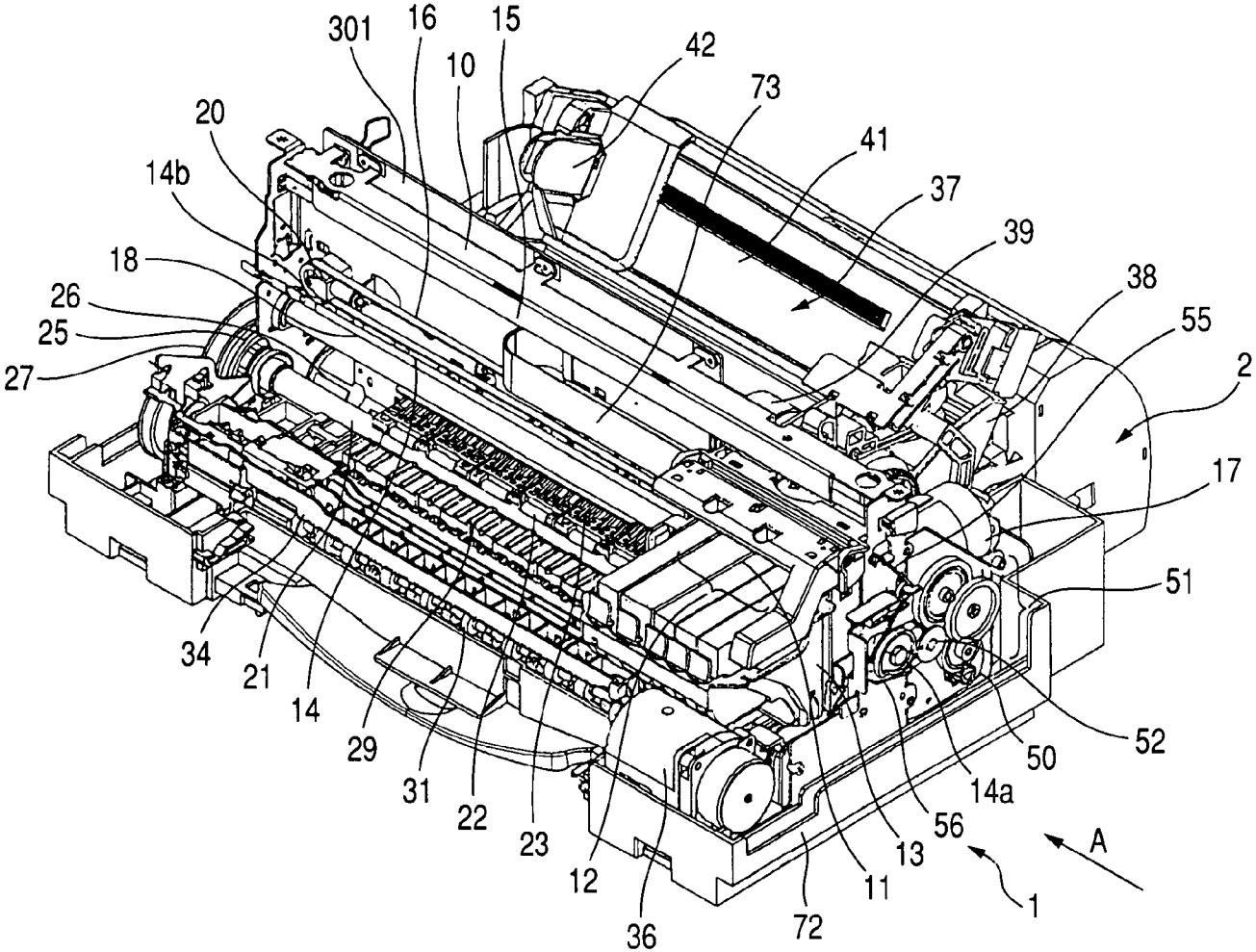
FIG. 1 is a perspective view to show the whole configuration of a both-side recording apparatus according to one embodiment of the present invention.

An embodiment of the present invention will be specifically described below with reference to the drawings. Throughout each of the drawings, the same reference numerals will be attached to the same components.

Figure 2:
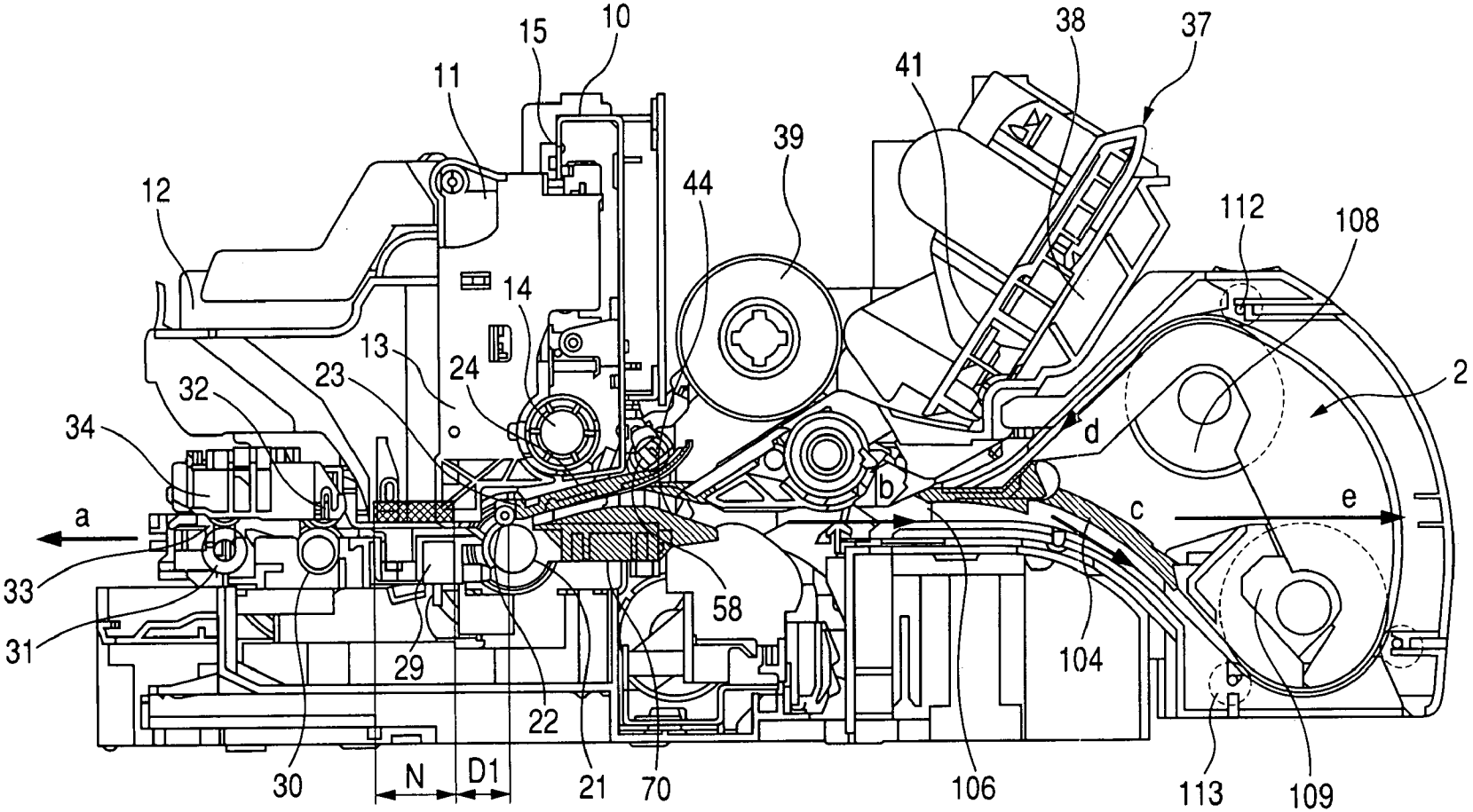
FIG. 2 is a sectional side view to show the whole configuration of the both-side recording apparatus according to one embodiment of the present invention.

FIG. 1 is a perspective view to show the whole configuration of a both-side recording apparatus of the present invention, and FIG. 2 is a sectional side view to show the whole configuration of the recording apparatus seen from the direction of an arrow mark A of FIG. 1. The both-side recording apparatus of the present embodiment is a recording apparatus adopting an inkjet recording system for executing the recording by discharging ink to a recorded medium. As the recorded medium, a recording sheet 4 comprising various materials such as a paper, a plastic sheet, a cloth, a metal sheet or a plate member is used.

As shown in FIGS. 1 and 2, the basic configuration of the both-side recording apparatus of the present embodiment, that is, a recording unit main body 1 consists of a base 72 and a chassis 10, a sheet feeding portion, a conveying portion, a recording portion, a maintenance portion, an electrical control portion, a sheet reversing portion (referred to also as (automatic reversing portion) or (automatic both-side unit)) 2, and various lift mechanisms.

In the present embodiment, the recording sheet supplied from the sheet feeding portion one sheet by one sheet is conveyed to the recording portion by the conveying portion, and after a recording is executed on the first surface (the face side surface), the conveying portion conveys the recording sheet in a reverse direction to the sheet reversing portion, and the sheet reversing portion reverses the recording sheet relative to the face surface and the rear surface, and then, conveys it to the recording portion again, where the recording is executed on the second surface (rear side surface). The distance between the recording portion and the recording sheet can be changed by the lift mechanism and the like when executing the recording on the face side surface and the rear side surface.

(Sheet Feeding Portion)

The sheet feeding portion is an automatic sheet feeding portion, that is, a main ASF (Automatic Sheet Feeder) 37, which pulls out the recording sheet 4 one sheet by one sheet for every recording operation from a plurality of recording sheets 4 loaded on a thick plate 41 and sends it to the conveying portion. This main ASF 37, as shown in FIGS. 1 and 2, mainly has an ASF base 38, the thick plate 41 for loading the recording sheet 4, a side guide 42 movably provided on the thick plate 41, a sheet feeding roller 39 for discharging the recording sheet 4 on the thick plate 41, a separating roller 40 for separating a plurality of recording sheets 4 one sheet by one sheet, a return claw 43 for returning the top end of the recording sheet 4 advancing further than a nip portion between the sheet feeding roller 39 and the separating roller 40 to a predetermined position at the time of a sheet feeding operation, and an ASF flap 44 for regulating the traveling direction of the recording sheet 4 from the main ASF 37 to one direction.

The thick plate 41 abuts against an unillustrated cam connected to an ASF motor 46, and moreover, it is biased to the sheet feeding roller 39 by an unillustrated thick plate spring. Consequently, the thick plate 41 can take a state of abutting against the sheet feeding roller 39 and a state of being separated from the sheet feeding roller 39 by the action of the cam.

The side guide 42 becomes a positional reference in a width direction of the recording sheet 4, and is a guide member for preventing a positional shift in the width direction of the recording sheet 4 to be recorded, thereby feeding the sheet to a predetermined position.

The separating roller 40 is press-contacted to the sheet feeding roller 39, and moreover, it has a predetermined reverse running torque in a direction reverse to a conveying direction of the recording sheet 4, and when a plurality of recording sheets 4 are pulled out between the separating roller 40 and the sheet feeding roller 39, the roller 40 can push back to the thick plate 41 the recording sheets 4 other than the recording sheets 4 contacting the sheet feeding roller 39.

At the time of completing the sheet feeding operation, the return claw 43 reliably pushes back the recording sheets 4 remaining in the vicinity of the separating roller 40 and the sheet feeding roller 39 to a predetermined position on the thick plate 41.

The ASF flap 44 is biased by an unillustrated ASF flap spring so as to narrow a sheet material pathway. Since the ASF flap 44 is inclined, and is swingable, the recording sheet 4 is allowed to pass through the sheet material pathway in the forward direction (direction to the recording portion from the sheet feeding portion) and is prevented from traveling to a reverse direction (direction to the sheet feeding portion from the recording portion).

(Conveying Portion)

The conveying portion, as shown in FIGS. 1 and 2, has a sheet passing roller 21, a pinch roller 22, a pinch roller holder 23, a pinch roller spring 24, a sheet passing roller pulley 25, a LF motor (Line Feed Motor) 26, a code wheel 27, a platen 29, a first sheet discharge roller 30 and a second sheet discharge roller 31, a first spur row 32 and a second spur row 33, a spur base 34, and a sheet passing guide (sheet guide) 70.

The sheet passing roller 21 is for conveying the recording sheet 4. The pinch roller 22 is rotatably held by the pinch roller holder 23, and is press-contacted to the sheet passing roller 21 by the pinch roller spring 24 so as to be slaved. The sheet passing roller pulley 25 is fixed to the sheet passing roller 21, and the sheet passing roller 21 is driven by the LF motor 26, and the rotation angle of the sheet passing roller 21 is detected by the code wheel 27. The platen 29 supports the recording sheet 4 by opposing to a recording head 11. The first sheet discharge roller 30 conveys the recording sheet 4 in collaboration with the sheet passing roller 21, and the second sheet discharge roller 31 is provided in the downstream side of the first sheet discharge roller 30. The first spur row 32 is a body of rotation to hold the recording sheet 4 by opposing to the first sheet discharge roller 30, and the second spur row 33 is a body of rotation to hold the recording sheet 4 by opposing to the second sheet discharge roller 31. The first spur row 32 and the second spur row 33 are rotatably held by the spur base 34. The sheet passing guide 70 guides the top end of the recording sheet 4 to the nip portion between the sheet passing roller 21 and the pinch roller 22.

The sheet passing roller 21 and the pinch roller 22 configure a nip portion to allow the recording sheet 4 to pass through. The center of the pinch roller 22 is attached to a position slightly off set in a direction to approach the first sheet discharge roller 30 for the center of the sheet passing roller 21. Consequently, an angle of approach (angle of tangential direction) of the recording sheet 4 is slightly inclined than horizontal, and therefore, the sheet material pathway formed by the pinch roller holder 23 and the sheet passing guide 70 in such manner that the top end of the recording sheet 4 is guided accurately to the nip portion is configured such that the recording sheet is conveyed with an angle set.

(Recording Portion)

The recording portion, as shown in FIGS. 1 and 2, has a recording head 11 for executing a recording by ejecting the ink on the recording sheet 4, an ink tank 12 for storing the ink to be supplied to the recording head 11, a carriage 13 for scanning by holding the recording head 11 and the ink tank 12, a guide shaft 14 for guiding and supporting the carriage 13, a guide rail 15 for guiding and supporting the carriage 13 in parallel with the guide shaft 14, a carriage belt 16 for driving the carriage 13, a carriage motor 17 for driving the carriage belt 16 through a pulley, an idler pulley 20 for stretching the carriage belt 16 by opposing to the pulley of the carriage motor 17, and a code strip 18 for detecting a position of the carriage 13.

The recording head 11 of the present embodiment is a head of an inkjet recording system, and though not illustrated, a plurality of ink flow paths to be connected to the ink tank 12 are formed, and the ink flow paths are communicated to the ejection ports arranged on the surface oppossed to the platen 29. In the interior of each of a plurality of ejection ports which form a line, an ink ejection actuator (energy generating means) is arranged. As for this actuator, for example, an electrothermal conversion device (heater element) for generating a film boiling pressure of fluid mass, an electromechanical conversion device (electro-pressure transducer element) such as a piezo element and the like are used. This recording head 11 is transferred with the signal of a head driver 307 to be described later through a flexible flat cable 73, and can eject an ink droplet according to the recording data.

The carriage 13 mounted with the recording head 11 is guided and held by the guide shaft 14 fixed to a chassis 10 and the guide rail 15 which is a part of the chassis 10. The carriage 13 is transferred with a driving force of the carriage motor 17 through the carriage belt 16 which is stretched between the carriage motor 17 and the idler pulley 20 so as to execute a reciprocating scan in a direction to cross the conveying direction of the recording sheet 4. Further, the carriage 13 is provided with a CR (carriage) encoder 19. The CR encoder 19 reads a code strip 18 provided in the chassis 10 and provides a data for ejecting the ink droplet to the recording sheet 4 with an appropriate timing by the recording head 11. When the recording sheet 4 is conveyed by a predetermined amount (one line pitch) by the conveying portion, the recording head 11 executes a recording for one line portion, while the carriage 10 is scanning. When the recording for one line portion is completed, the recording sheet 4 is conveyed again by a predetermined amount (one line pitch) by the conveying portion. In this manner, the alternating repetition of the conveyance of the recording sheet 4 by the conveying portion and the scanning of the carriage 13 and the recording by the recording head 11 can easily accomplish the recording operation over the whole surfaces of the recording sheet 4.

(Maintenance Portion)

The maintenance portion shown in FIG. 1 is a maintenance unit 36, which maintains and recovers the ink ejecting performance of the recording head 11, and operates when the ink of the recording head 11 is let to circulate in the ink flow path at the time of exchanging the ink tank 12. The maintenance unit 36, for example, consists of a capping mechanism including a cap, which abuts against the ink ejection port surface of the recording head 11 so as to protect the ejection port, a suction recovery mechanism for generating a negative pressure inside the cap capping the ejection port and suctioning and ejecting the ink from the ejection port, a wiping mechanism for wiping and cleaning the peripheral portion of the ejection port and the like, and prevents a clogging of the ejection port, and clears contamination of the ejection port surface due to paper dusts and the like, thereby maintaining and recovering the recording operation of the recording head 11 to a normal state, and at the same time, an ink suction is executed when the ink tank 12 is exchanged. Consequently, the maintenance unit 36 is installed in such a manner as to oppose to the recording head 11 at the home position of the carriage 13. When the ink in the interior of the ejection port of the recording head 11 is sucked out to be refreshed, the cap is pressed to the ejection port surface, and a suction pump is driven so that the interior of the cap is negatively pressured, thereby suctioning and ejecting the ink. When the ink adheres on the ejection port surface after the ink is suctioned or when foreign matters such as paper dusts and the like adhere on the ejection port surface, a wiper is abutted and is moved against the ejection port surface so as to wipe off the ejection port surface.

(Electrical Control Portion)

Figure 21:
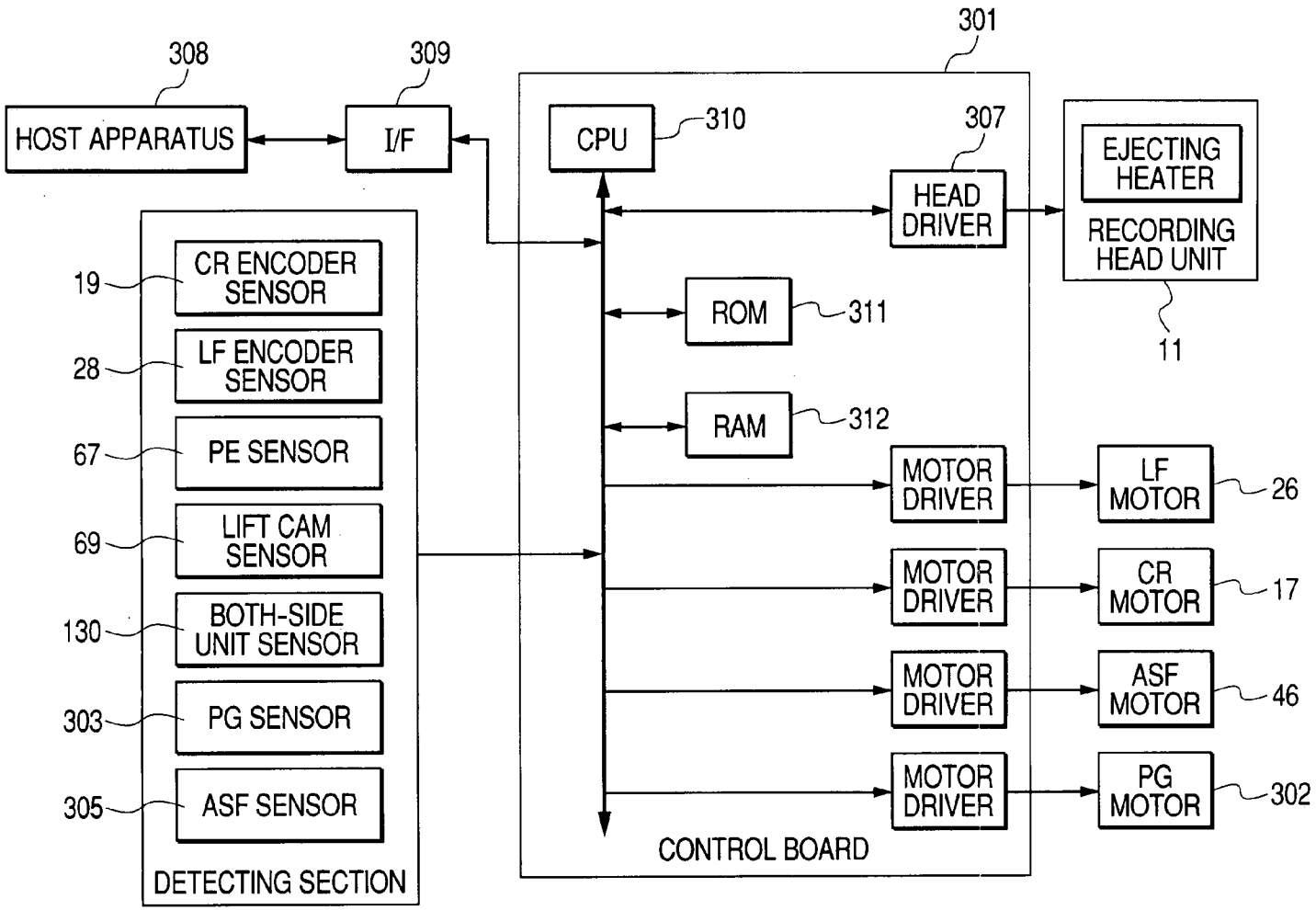
FIG. 21 is a block diagram to show a control circuit configuration according to one embodiment of the present invention.

The electrical control portion can be packed into a control substrate 301, and as shown in FIG. 21, has a CPU 310, a ROM 311, a RAM 312, the head driver 307, and a motor driver. The control substrate 301 is connected with a detection portion including a CR (carriage) encoder sensor 19, a LF encoder sensor 28, a PE (paper end) sensor 67, a lift cam sensor 69, a sheet reversing portion sensor 130, a PG sensor 303, and an ASF sensor 305, and the LF motor 26, the CR motor 17, the ASF motor 46, a PG motor 302, the recording head 11, a host device 308, and the like. The CPU 310 manages the control of the recording apparatus and issues a control command, and a control data and the like are written in the ROM 311, and the RAM 312 is an area in which the recording data and the like are developed. The head driver 307 drives the recording head 11, and the motor driver drives each motor. The CR encoder sensor 19 is mounted in the carriage 13 and reads the code strip 18. The LF encoder sensor 28 reads the code wheel 27 attached to the chassis 1. The PE sensor 67 detects the operation of a PE sensor lever 66. The lift cam sensor 69 detects the operation of the lift cam shaft 58. The sheet reversing portion sensor 130 detects the detachment and attachment of the sheet reversing portion 2. The PG sensor 303 detects the operation of the maintenance unit 36. The ASF sensor 305 detects the operation of the main ASF 37. The ASF motor 46 drives the main ASF 37, and the PG motor 302 drives the maintenance unit 36. The host device 308 is connected through an I/F (interface) 309 which acts as an intermediary of an electrical connection, and can transmit a recording data to a recording apparatus.

(Sheet Reversing Portion)

The sheet reversing portion 2 reverses the recording sheet in order to automatically execute a recording on the face surface and the rear surface of the recording sheet which is a sheet like cut paper without troubling an operator's hand. The sheet reversing portion 2, as shown in FIG. 2, has a first double-sided roller 108 and a second double-sided roller 109 for conveying the recording sheet 4, a first double-sided pinch roller 112 following the first double-sided roller 108, a second double-sided pinch roller 113 following the second double-sided roller 109, a selector flap 104 rotatably supported for deciding a traveling direction of the recording sheet 4, and an exit flap 106 for opening and closing when the recording sheet 4 rotatably supported comes out from the sheet reversing portion 2.

The sheet reversing portion 2 nips the incoming recording sheet 4 by the second double-sided roller 109 and the second double-sided pinch roller 113 and converts its traveling direction, and moreover, nips the sheet by the first double-sided roller 108 and the first double-sided pinch roller 112 so as to convey it in a direction of an arrow mark d of FIG. 2, and finally changes its traveling direction by 180 degrees and discharges it horizontally.

(Lift Mechanism)

Further, in the both-side recording apparatus of the present embodiment, there are provided various types of lift mechanisms. In the present embodiment, there are mainly provided a release mechanism of the pinch roller 22, a pressure adjustment mechanism of the pinch roller spring 24, a release mechanism of the PE sensor lever 66, an up and down mechanism of the sheet passing guide 70, and the up and down mechanism of the carriage 13.

Figure 3:
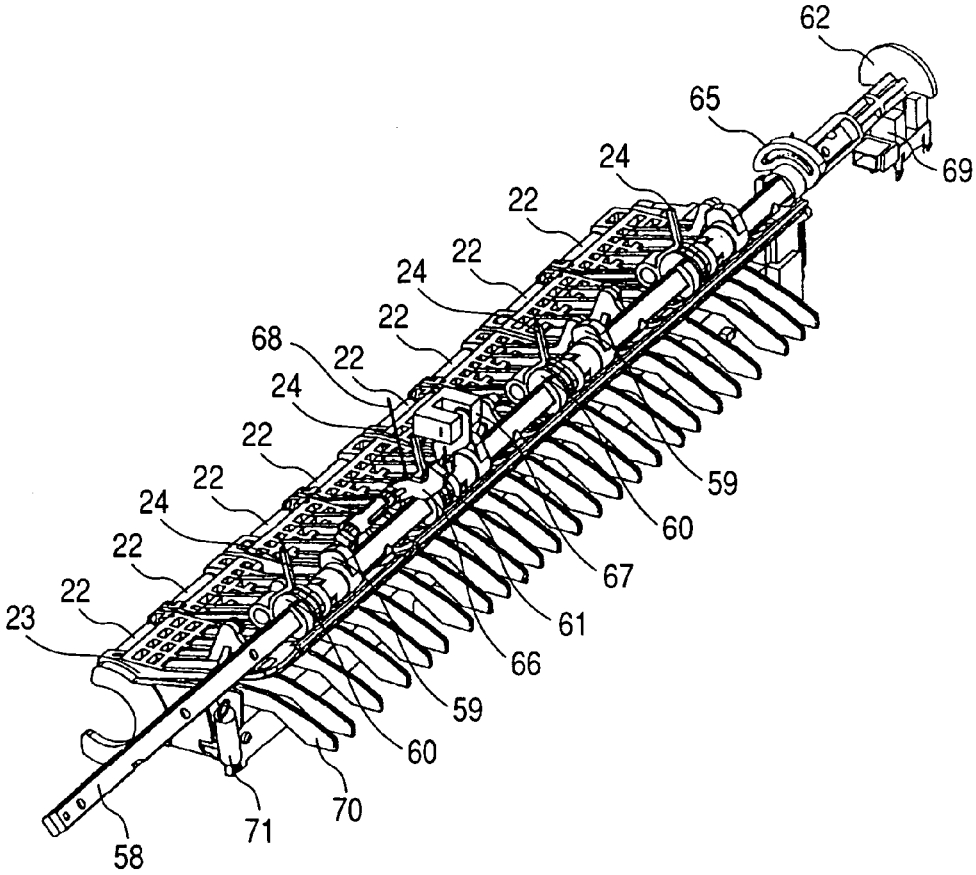
FIG. 3 is a main component perspective view to show a drive mechanism of each lift mechanism according to one embodiment of the present invention.

A pinch roller release mechanism, a pinch roller spring pressure adjustment mechanism, a PE sensor lever release mechanism, a sheet passing guide up and down mechanism, and a carriage up and down mechanism are operated by the rotation of a lift cam shaft 58. That is, as shown in FIG. 3, the lift cam shaft 58 is fixed with a pinch roller holder press cam 59, a pinch roller spring press cam 60, a PE sensor lever press cam 61, and a sheet passing guide press cam 65, respectively, so that each cam rotates in synchronization with the rotation of the lift cam shaft 58. The pinch roller holder press cam 59 abuts against the pinch roller holder 23. The pinch roller spring press cam 60 becomes a point of action of the pinch roller spring 24. The sheet passing guide press cam 65 abuts against the sheet passing guide 70, and the sheet passing guide 70 is biased in a predetermined direction by a sheet passing guide spring 71. The PE sensor lever press cam 61 abuts against the PE sensor lever 66 which contacts the recording sheet 4 and detects its top end or rear end. The PE sensor lever 66 can switch over the exposed state and the shielded state of the PE sensor 67. The PE sensor lever 66 is biased in a predetermined direction by a PE sensor lever spring 68. The angle of the lift cam shaft 58 is recognized by a lift cam shaft shield plate 62 and the lift cam sensor 69, which is switched over the exposed state and the shielded state by the lift cam shaft shield plate 62. That is, the initial position and the rotational state of the lift cam shaft 58 are recognized by the state where the lift cam sensor 69 is switched over the exposed state and the shielded state by the lift cam shaft shield plate 62. However, the present invention is not limited to such a configuration, but may adopt configurations which independently drive, respectively, as the need arises.

<Pinch Roller Release Mechanism and Pinch Roller Spring Pressure Adjustment Mechanism>

The release mechanism of the pinch roller 22 operates in such a manner as to release the pinch roller 22 from the sheet passing roller 21 in order to lead the recording sheet 4 to the thick plate 41 side again.

The pressure adjustment mechanism of the pinch roller spring 24 is a pressure adjustment mechanism for fluctuating the pressure by which the pinch roller 22 press-contacts the sheet passing roller 21. In the present embodiment, to release the pinch roller 22, the whole of the pinch roller holder 23 is configured so as to rotate. In a state where the pinch roller 22 press-contacts the sheet passing roller 21, since the pinch roller spring 24 biases the pinch roller holder 23, when the pinch roller holder 23 is rotated in a release direction, it rotates by opposing to the spring force of the pinch roller spring 24, there arises an adverse effect such as an increase of a load for releasing the pinch roller holder 23 and an increase of stress applied to the pinch roller holder 23 itself. To prevent this effect, there is provided a mechanism (pressure adjustment mechanism) for reducing the pressure of the pinch roller spring 24 at the time of releasing the pinch roller holder 23.

Figure 4A:
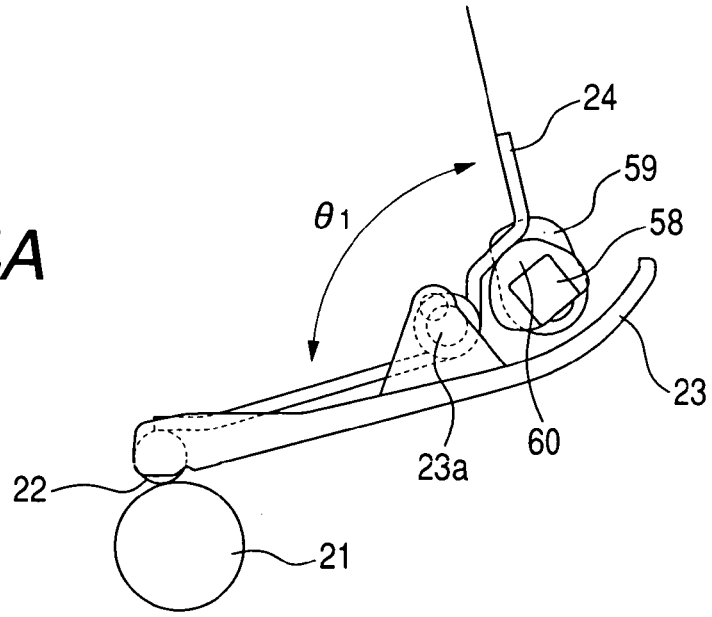
FIGS. 4A, 4B and 4C are explanatory drawings to show a pinch roller release mechanism according to one embodiment of the present invention.
Figure 4B:
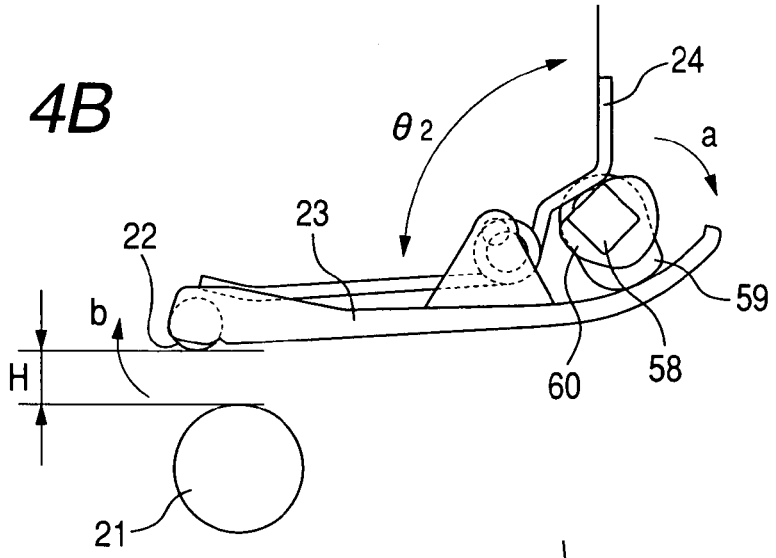

FIGS. 4A and 4B are partial side views to schematically show the operations of the pinch roller release mechanism and the pinch roller spring pressure adjustment mechanism. FIG. 4A shows a state in which the pinch roller holder press cam 59 is located at the initial position, and the pressure of the pinch roller spring 24 is in a standard state, and the pinch roller 22 press-contacts the sheet passing roller 21. The pinch roller holder 23 is rotatably supported with a pinch roller holder shaft 23*a* borne by the bearing portion of the chassis 10, and is swingably configured within a predetermined angle range. In one end of the pinch roller holder 23, there is rotatably supported the pinch roller 22, and in the other end thereof, there is provided an abutting area with the pinch roller holder press cam 59.

As shown in FIG. 4A, the pinch roller spring 24 becomes a power point with one end thereof abutting against the pinch roller 22 of the pinch roller holder 23, and the other end thereof is supported by the pinch roller spring press cam 60, and the intermediate portion thereof is a torsional coil spring supported by the support portion of the chassis 10. By such pinch roller spring 24, the pinch roller 22 press-contacts the sheet passing roller 21 with a predetermined pressure. When the sheet passing roller 21 is rotated in this state, the recording sheet 4 nipped by the nip portion between the sheet passing roller 21 and the pinch roller 22 is conveyed.

When the lift cam shaft 58 rotates in the direction of an arrow mark a from the state shown in FIG. 4A, as shown in FIG. 4B, the pinch roller holder press cam 59 abuts against the pinch roller holder 23, and the pinch roller holder 23 is gradually swung in the direction of the arrow mark b. The pinch roller 22 is released from the sheet passing roller 21. In the state shown in FIG. 4B, the minor diameter of the pinch roller spring press cam 60 abuts against the pinch roller spring 24, and since a torsional angle θ2 of the pinch roller spring 24 becomes larger than a torsional angle θ1 of the state shown in FIG. 4A, a spring load is reduced, and there is hardly any load (stress) applied to the pinch roller holder 23. In this state, a predetermined amount of clearance H is formed between the sheet passing roller 21 and the pinch roller 22, and only by roughly guiding the recording sheet 4, it is possible to easily insert its top end into the nip portion.

Figure 4C:
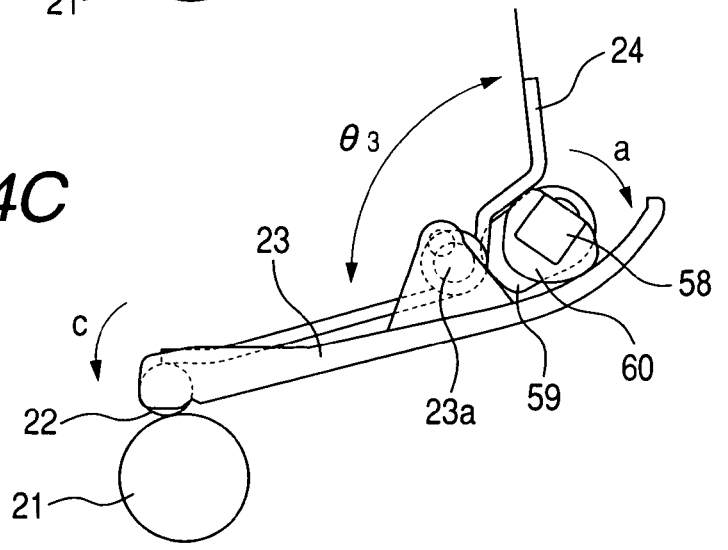

When the lift cam shaft 58 further rotates in the direction of the arrow mark a from the state shown in FIG. 4B, as shown in FIG. 4C, the abutting of the pinch roller holder press cam 59 and the pinch roller holder 23 is released, and the pinch roller holder 23 rotates in the direction of the arrow mark c of FIG. 4C and restores to the original state (state shown in FIG. 4A), and the abutting portion thereof with the pinch roller spring 24 of the pinch roller spring press cam 60 is a radius portion having an intermediate size between the abutting portion in the state shown in FIG. 4A and the abutting portion in the state shown in FIG. 4B. Consequently, the state shown in FIG. 4C is a lightly weak press-contact state, though the pinch roller 22 press-contacts the sheet passing roller 21 similarly to the state shown in FIG. 4A. Since the torsional angle θ3 of the pinch roller spring 24 is slightly smaller than a torsional angle θ1 of the state shown in FIG. 4A, a force by which the pinch roller 22 is press-contacted to the sheet passing roller 21 is slightly small.

During one rotation of the lift cam shaft 58, the pinch roller release mechanism and the pinch roller spring pressure adjustment mechanism return to a standard state shown in FIG. 4A from the state shown in FIG. 4A through the states of FIG. 4B and FIG. 4C. In the case where the rotational position of the lift cam shaft 58 is adjusted so as to take the state shown in FIG. 4C, thereby pinching the recording sheet 4 which is thicker than usual between the sheet passing roller 21, and the pinch roller 22, the torsional angle of the pinch roller spring 24 becomes larger than usual, and this can prevent a generated load for the pinch roller holder 23 from becoming large. Consequently, in the present embodiment, by adjusting the rotational position of the lift cam shaft 58, and by properly using the standard state shown in FIG. 4A and the lightly weak press-contact state shown in FIG. 4C, even in the case of the recording sheet 4 having an ordinary thickness and in the case of the thick recording sheet 4, the rotational load applied to the shaft of the sheet passing roller 21 can be leveled.

<PE Sensor Lever Release Mechanism>

The PE sensor lever 66 is attached in such a manner as to swing with a predetermined angle for the recording sheet 4 so that, when the recording sheet 4 travels in the forward direction (direction from the sheet feeding portion to the recording portion), the positions of the top end and the rear end of the recording sheet 4 can be accurately detected. Consequently, when the recording sheet 4 travels in an opposite direction (direction from the recording portion to the sheet feeding portion), there arises a technological problem in that the end portion of the recording sheet 4 is caught by the PE sensor lever 66 and the top end of the PE sensor lever 66 in the midst of the conveyance cuts into the recording sheet 4. Hence, in the present embodiment, the PE sensor lever 66 is alienated from the sheet material pathway during the step of reversing the face side and the rear side of the recording sheet 4, so that the release mechanism is configured not to abut against the recording sheet 4.

Figure 5A:
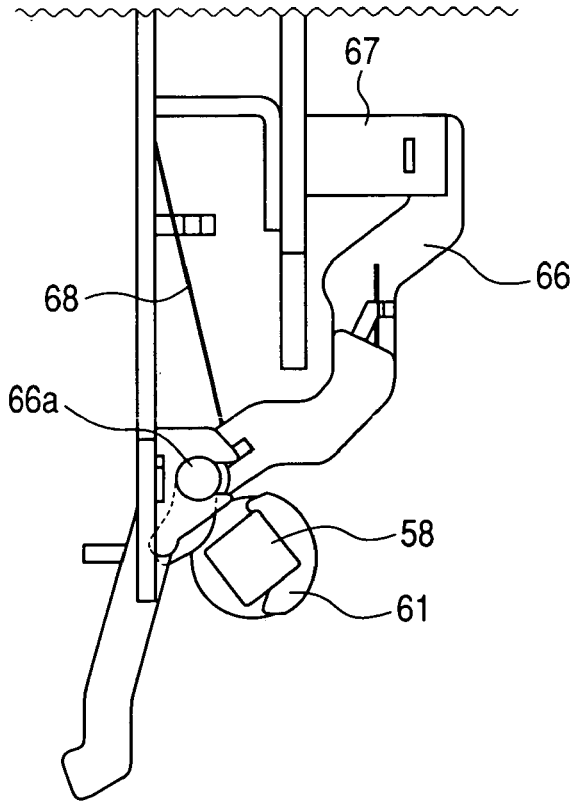
FIGS. 5A and 5B are explanatory drawings to show a PE sensor lever release mechanism according to one embodiment of the present invention.
Figure 5B:
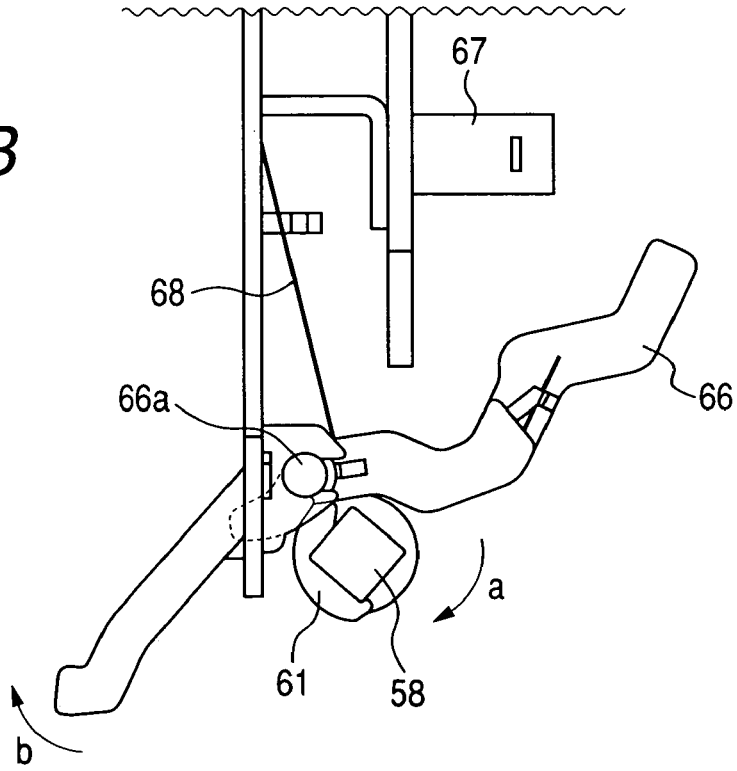

FIGS. 5A and 5B are partial side views to schematically show the operation of the PE sensor lever up and down mechanism. FIG. 5A shows a state where the PE sensor lever press cam 61 is in the initial position, and the PE sensor lever 66 is in the free state. The PE sensor lever 66 has the PE sensor lever shaft 66*a* rotatably supported by the bearing portion of the chassis 10. In the state shown in FIG. 5A, the PE sensor lever 66 is biased by the PE sensor lever spring 68, so that the shield plate portion of the PE sensor lever 66 shields the PE sensor 67. When, in this state, the recording sheet 4 passes through the position of the PE sensor lever 66, the PE sensor lever 66 is pushed to the end portion of the recording sheet 4 so as to rotate clockwise, and the PE sensor 67 is released from the shield plate portion and put into an exposed state. This allows the existence of the recording sheet 4 to be detected. In this light shielding state and the exposed state, the top end and the rear end of the recording sheet can be detected.

FIG. 5B is a partial side view to schematically show a locked state of the PE sensor lever 66. As shown in FIG. 5B, when the PE sensor lever press cam 61 rotates in the direction of the arrow mark a, a cam follower portion of the PE sensor lever 66 is pushed up and is swung in the direction of an arrow mark b. In this state, the end portion of the PE sensor lever 66 (portion abutted by the recording sheet 4) is hidden further inside than the pinch roller holder 23, and the recording sheet 4 and the PE sensor lever 66 do not abut against each other. Consequently, even when, in this state, the recording sheet 4 is conveyed in the direction of the arrow mark b, there is no problem caused such as a jamming and the like by hitting upon the PE sensor lever 66 by the recording sheet 4.

This release mechanism of the PE sensor lever 66 is replaceable by other means or configurations. That is, as means for solving the above-described technological problem, a roller is provided on the top end of the PE sensor lever 66, and even when the recording sheet 4 travels in a reverse direction, it may be allowed to smoothly pass through by rotating the roller. Further, the swing angle of the PE sensor lever 66 is made large, and when the recording sheet 4 is conveyed in the reverse direction, the PE sensor lever 66 may be allowed to swing in a reverse direction different from ordinarily.

<Sheet Passing Guide Up and Down Mechanism>

Figure 6A:
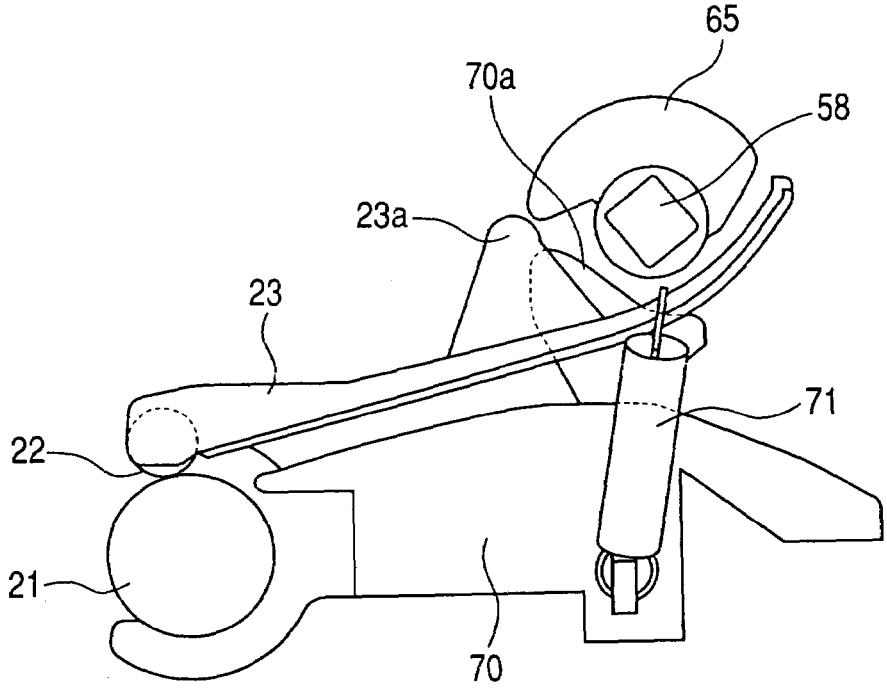
FIGS. 6A and 6B are explanatory drawings to show sheet passing guide up and down mechanism according to one embodiment of the present invention.

The up and down mechanism of the sheet passing guide 70 will be described. Usually, in order to guide the recording sheet 4 fed from the main ASF 37 to the sheet passing roller 21, the sheet passing guide 70 is positioned at a slightly upward angle than a horizontal plane from the position of a LF roller 21 so that, as described above, the recording sheet 4 is smoothly guided to the nip portion of the LF roller 21 by the pathway slightly inclined for the horizontal plane (ref. FIGS. 2 and 6A) However, if this continues, when the recording sheet 4 is conveyed in the direction of the arrow mark b of FIG. 2, the sheet is guided again to the main ASF 37. However, in the present embodiment, to guide the recording sheet 4 recorded in the first surface at the recording portion to the sheet reversing portion 2, it is necessary to smoothly guide the sheet to a horizontal pathway. Hence, there is provided the up and down mechanism which moves up and down the sheet passing guide 70 so as to change the angle so that the sheet passing guide 70 becomes horizontal.

Figure 6B:
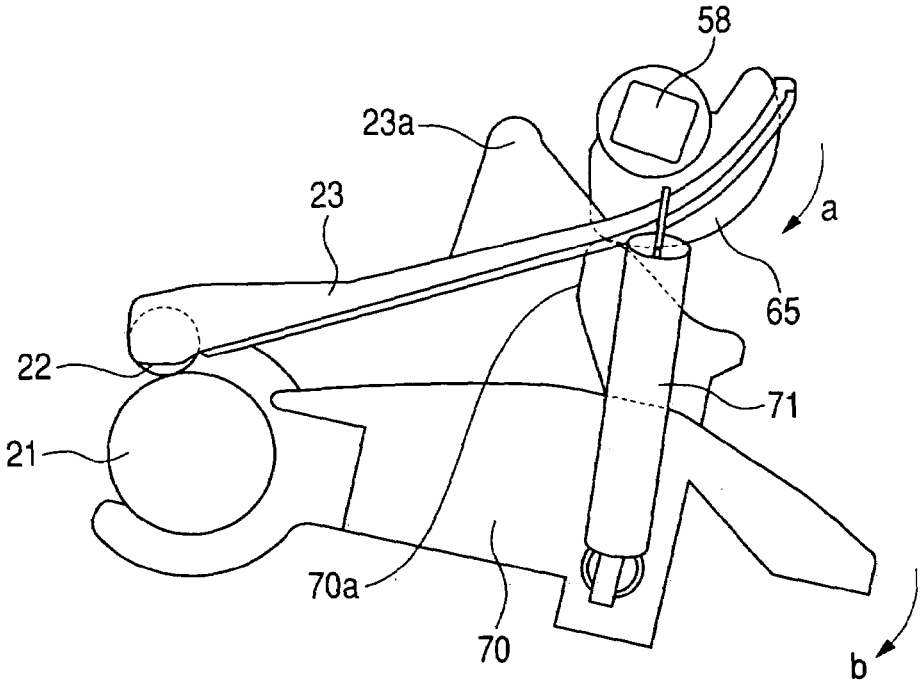

FIGS. 6A and 6B are partial side views to schematically show the operation of the sheet passing guide up and down mechanism. FIG. 6A shows a lifting state of the sheet passing guide 70. As shown in FIG. 6A, the sheet passing guide 70 is usually biased to a lifting direction by the sheet passing guide spring 71 which is an elastic member, and a position which hits against an unillustrated stopper is set as the lifting position. When the recording sheet 4 fed from the main ASF 37 passes through, the sheet passing guide 70 holds the lifting state by the action of the sheet passing guide spring 71. However, when a force larger than usual is applied, the sheet passing guide 70 is configured such that it can descend by opposing to a spring force of the sheet passing guide spring 71.

FIG. 6B shows the descending state of the sheet passing guide 70. As shown in FIG. 6B, when the sheet passing guide press cam 65 fixed to the lift cam shaft 58 rotates in the direction of the arrow mark a, the sheet passing guide press cam 65 abuts against a sheet passing guide cam follower portion 70*a* which is a part of the sheet passing guide 70 and gradually presses it. This allows the sheet passing guide 70 to be rotated in the direction of the arrow mark b and is pressed down by opposing to the spring force of the sheet passing guide spring 71. In this descending state, the portion opposing to the sheet material pathway of the sheet passing guide 70 becomes approximately horizontal, and the sheet material pathway becomes approximately completely straight. Consequently, when the recording sheet 4 is conveyed to the reverse direction against the sheet passing roller 21, the recording sheet 4 is conveyed horizontally, and there is no pressing to the upper surface (ceiling portion) of the sheet material pathway of a portion previously recorded in the face side surface of the recording sheet 4.

<Carriage Up and Down Mechanism>

The up and down mechanism of the carriage 13 is for preventing the movement in the main scanning direction of the carriage 13 from acting as a hindrance in the case where, when the pinch roller holder 23 is put into a release state, the top end of the pinch roller holder 23 approaches the carriage 13, and both of them abut against each other. Therefore, the up and down mechanism of the carriage 13 synchronizes with the release operation of the pinch roller holder 23 so as to lift the carriage 13. This up and down mechanism of the carriage 13 can be used for other applications, and for example, it can be used also when the recording head 11 is moved for the purpose of evacuating so as not to contact the recording sheet at the time of recording on a thick recording sheet.

Figure 7:
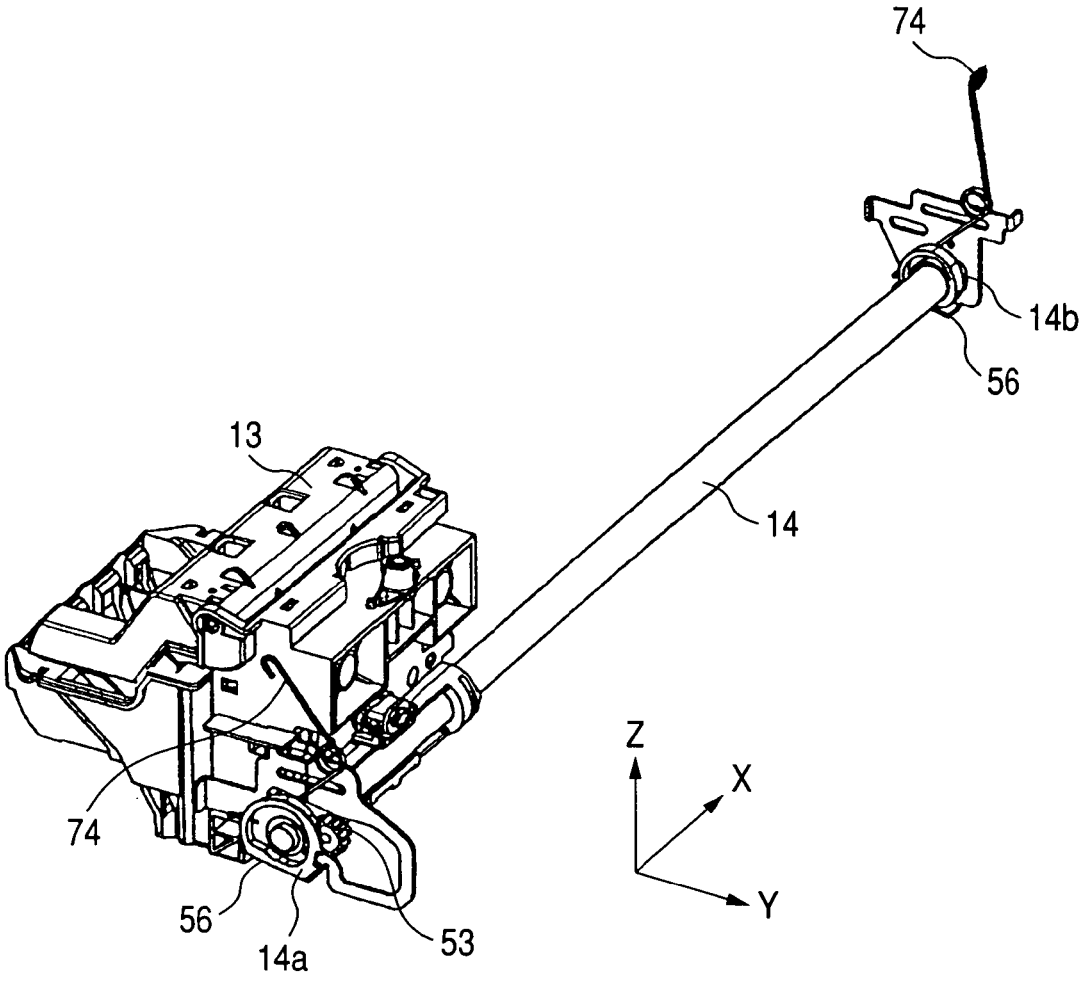
FIG. 7 is a perspective view to show a carriage up and down mechanism according to one embodiment of the present invention.

FIG. 7 is a perspective view to show a carriage up and down mechanism. The guide shaft 14, as shown in FIG. 1, is supported by both-side surfaces of the chassis 10, and is attached with a right guide shaft cam 14*a* and a left guide shaft cam 14*b*. The gear portion of the right guide shaft cam 14*a* is connected to a lift cam gear 52 through a cam idler gear 53. The guide shaft 14 is engaged with the inside of an up and down guide long hole 57, and can move in the direction of the arrow mark Z of FIG. 7. However, the movement in the directions of arrow marks X and Y are regulated.

In the carriage up and down mechanism shown in FIG. 7, usually, the guide shaft 14 is biased downward (direction opposite to the arrow mark Z) by a guide shaft spring 74. When a cam idler gear 53 rotates, the right guide shaft cam 14*a* and the left guide shaft cam 14*b* abut against a guide slant surface 56, so that the guide shaft 14 is configured in such a manner as to move up and down while rotating.

Figure 8A:
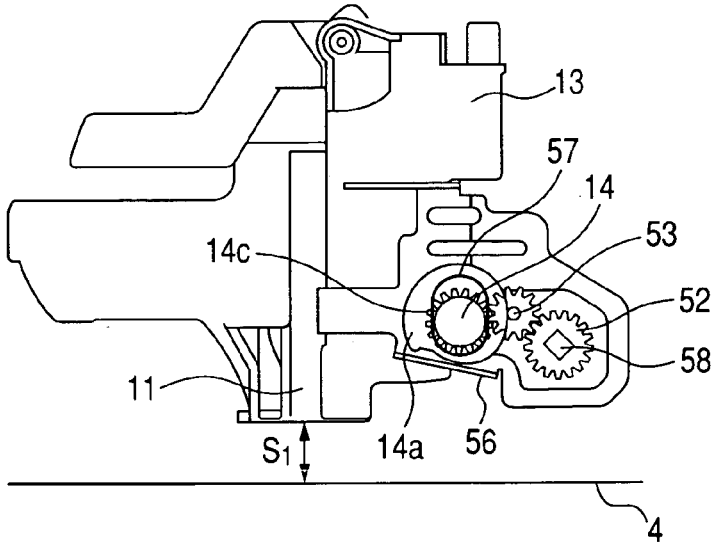
FIGS. 8A, 8B and 8C are explanatory drawings to show a carriage up and down mechanism according to one embodiment of the present invention.
Figure 8B:
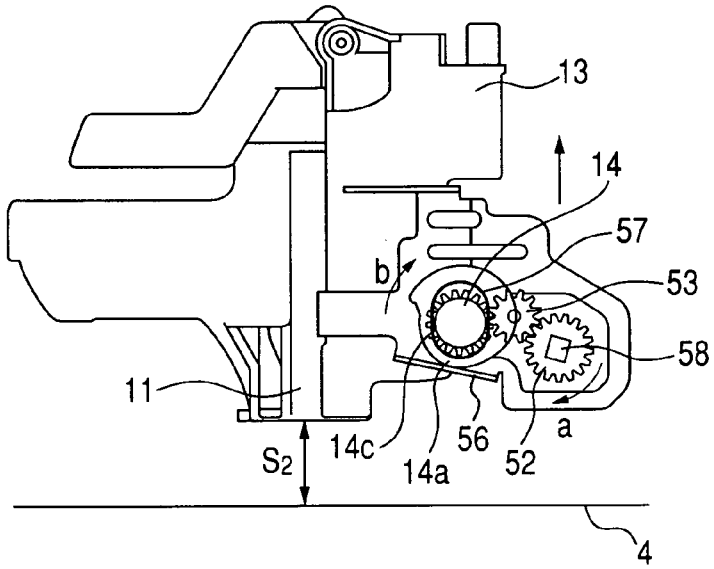
Figure 8C:
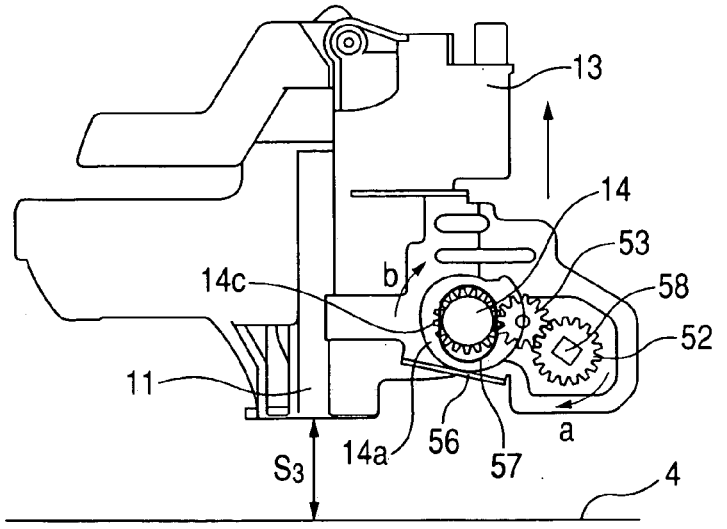

FIGS. 8A to 8C are partial side views to schematically show the operation of the carriage up and down mechanism. FIG. 8A shows the case where the carriage 13 is located at a first position which is the standard position. In this state, the guide shaft 14 is positioned by being hit on the lower limit of the guide long hole 57 of the chassis 10, and the guide shaft cam 14*a* is not brought into contact with the guide slant surface 56. In this first position, there develops a relatively short clearance S1 between the ejection port surface of the recording head 11 and the recording sheet 4. This clearance S1 is suitable when the recording sheet 4 of standard thickness and material is recorded in a normal state, and is a clearance calculated so as to achieve an excellent recording dignity.

When the lift cam shaft 58 rotates from this first position, a lift cam gear 52 fixed to the lift cam shaft 58 rotates, and a right guide shaft cam gear 14*c* rotates through a cam idler gear 53 engaged with the lift cam gear 52, and as shown in FIG. 8B, the carriage 13 moves to a slightly higher second position. At this time, when the lift cam gear 52 and the right guide shaft cam gear 14*c* are allowed to have the same number of teeth, the lift cam shaft 58 and the guide shaft 14 rotate in the same direction with approximately the same angle. The reason why they do not rotate completely with the same angle is because, while the lift cam gear 52 and the cam idler gear 53 have the rotational shafts fixed, in case of the right guide shaft cam gear 14*c*, the guide shaft 14 itself which is a rotational shaft executes the up and down movement, and therefore, the distance between the gears fluctuates.

When the lift cam shaft 58 rotates in the direction of the arrow mark a of FIG. 8B in this manner, the guide shaft 14 rotates in the direction of the arrow mark b. By this rotation, the right guide shaft cam 14*a* and the left guide shaft cam 14*b* abut against the fixed guide slant surface 56, respectively, and since the moving direction of the guide shaft 14, as described above, is regulated only for the up and down directions by the guide long hole 57 of the chassis 10, the guide shaft 14 moves to the second position. In this second position, there develops a clearance S2 slightly longer than the clearance S1 between the ejection port surface of the recording head 11 and the recording sheet 4. In this second position, the deformation of the recording sheet 4 is great, and the first position is suitably set for the case where the recording sheet 4 and the recording head 11 end up abutting against each other.

When the lift cam shaft 58 further rotates from the second position, from among the cam surfaces of the right guide shaft cam 14*a* and the left guide shaft cam 14*b*, a cam surface having a larger radius abuts against the guide slant surface 56, and the guide shaft 14 moves further to a higher position (third position shown in FIG. 8C). In this third position, there develops a long clearance S3 between the ejection port surface of the recording head 11 and the recording sheet 4. This third position is suitable when the recording sheet 4 thicker than usual is used. In FIGS. 8A to 8C, the clearances S1 to S3 are shown magnified to explain in an easy to understand format.

<Drive Mechanism of Lift Cam Shaft>

A drive mechanism of the lift cam shaft, which operates the above-described lift mechanism, that is, the pinch roller release mechanism, the pinch roller spring pressure adjustment mechanism, the PE sensor lever release mechanism, the sheet passing guide up and down mechanism, and the carriage up and down mechanism will be described with reference to the perspective view of FIG. 9.

In the present embodiment, there are provided the ASF motor 46 (illustrated in FIG. 9 with the upper half omitted to show a variety of gears) for driving the main ASF 37 which is a driving source of the lift cam shaft 58, an ASF planetary gear 49 drivingly associated with the main ASF 37, a lift input gear 50 engaged with the ASF planetary gear 49, a lift speed reduction gear row 51 for transferring a motive power from the lift input gear 50 while reducing the speed, the lift cam shaft 58 for allowing the pinch roller holder 23 to lift and descend, the lift cam gear 52 directly connected to the lift cam shaft 58, a guide shaft spring 55 for biasing the guide shaft 14 to one side, the guide shaft gear 53 directly connected to the guide shaft 14, and the guide slant surface 56 where the cam of the guide shaft gear 53 slides.

The ASF motor 46 is controlled in its rotational direction and amount, and operates the main ASF 37, and at the same time, operates the lift cam shaft 58 through an ASF pendulum arm 47 positioned at the next stage of the gear attached to the ASF motor 46, an ASF sun gear 48 attached to the center of the ASF pendulum arm 47, the ASF planetary gear 49 engaged with the ASF sun gear 48 attached to the end portion of the ASF pendulum arm 47, a pendulum look cam 63 fixed to the lift cam shaft 58, and a pendulum lock lever 64 which swings by acting on the pendulum lock cam 63.

By the rotational direction of the ASF motor 46, the driving force transfer direction is decided. When the lift cam shaft 58 is operated, the ASF motor 46 is rotated in the direction of the arrow mark a of FIG. 9. Then, the gear attached to the ASF motor 46 rotates the ASF sun gear 48. Since the ASF sun gear 48 and the ASF pendulum arm 47 are rotatably brought into contact with each other with a predetermined frictional force, the ASF pendulum arm 47 is swung in a rotational direction (arrow mark b direction) of the ASF sun gear 48. Then, the ASF planetary gear 49 engages with the next stage lift input gear 50. This allows the driving force of the ASF motor 46 to be transferred to the lift cam gear 52 through the lift speed reduction gear row 51. At this time, since the ASF pendulum arm 47 is swung in the direction of the arrow mark b, the driving force to the gear row which drives the main ASF 37 is in a cut-off state.

Figure 9:
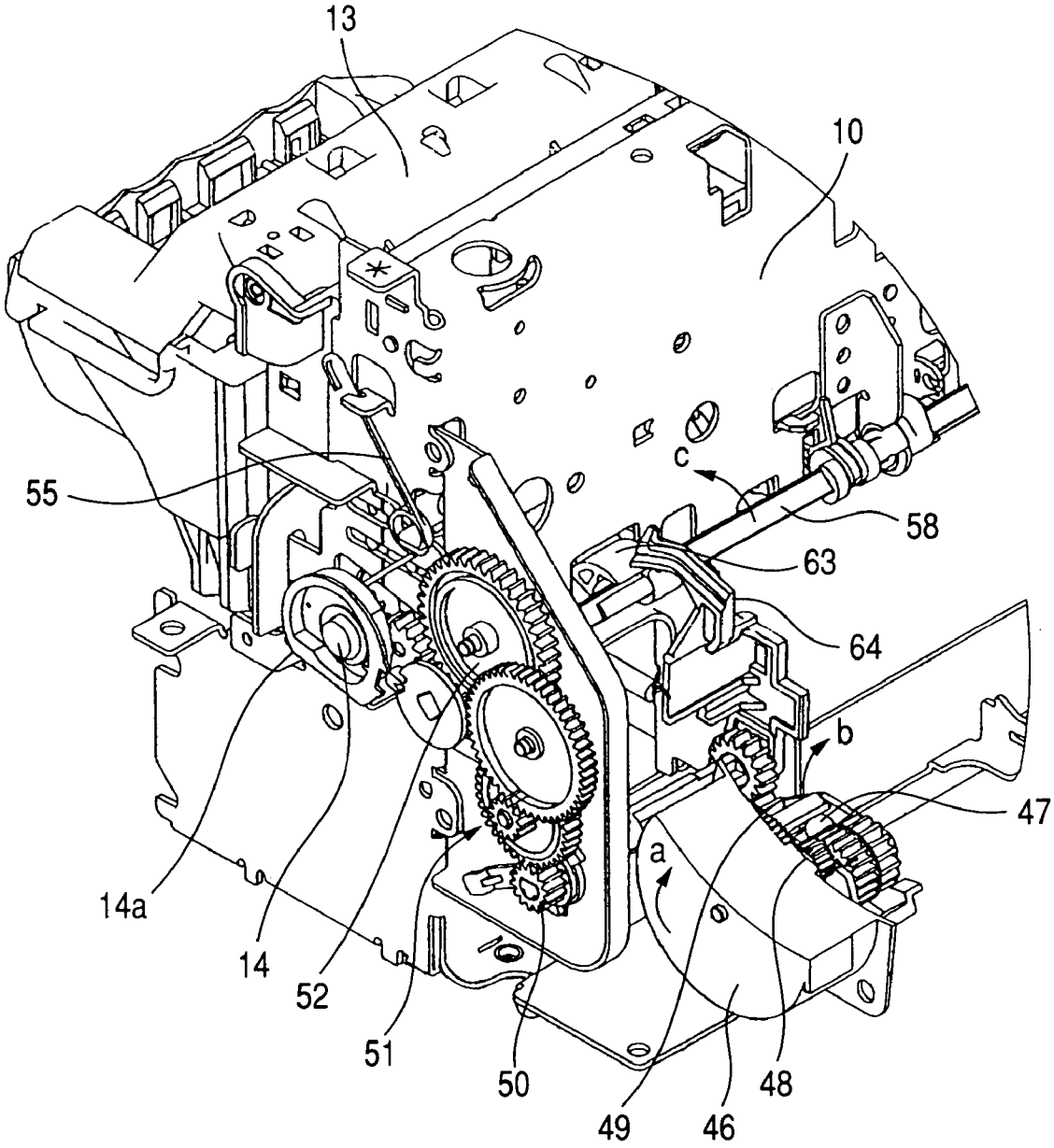
FIG. 9 is a perspective view to show the drive mechanism of a lift cam shaft according to one embodiment of the present invention.

On the other hand, when the main ASF 37 is driven, the ASF pendulum arm 47 swings to a direction opposite to the arrow mark b, by rotating the ASF motor 46 in a direction opposite to the arrow mark a of FIG. 9. This allows the engagement of the ASF planetary gear 49 with the lift input gear 50 to be released, and another ASF planetary gear 49 provided in the ASF pendulum arm 47 engages with the gear row tied to the main ASF 37, thereby driving the main ASF 37.

In the present embodiment, a so-called stepping motor is used as the ASF motor 46, and this stepping motor is controlled by an open loop. Naturally, an encoder may be used for a DC motor and controlled by a closed loop.

In case the planetary gear mechanism is used for the driving force transfer, when the driven side becomes a negative load, that is, when, from among the lift mechanism and the main ASF 37, the side which is not driven is released without receiving the load, there is the possibility of developing a so-called advancement in that the pendulum lock lever 64 moves so as to take off the engagement of the gear, and the driven side travels further than the driving source in phase. To prevent this phenomenon from developing, in the present embodiment, there are arranged the pendulum lock cam 63 and the pendulum lock lever 64. When the lift cam shaft 58 is within the predetermined angle range, the pendulum lock lever 64 is swung in the direction of the arrow mark c of FIG. 9 due to the cam surface shape of the pendulum lock cam 63, and the pendulum lock lever 64 engages with the ASF pendulum arm 47 so that the main ASF 37 is fixed so as not to be able to return to the side which drives the main ASF 37. Since this allows the ASF planetary gear 49 to be always in a state of engaging with the lift input gear 50, the ASF motor 46 and the lift cam shaft 58 always rotate in synchronization. When the pendulum lock cam 63 returns within the predetermined angle range, the pendulum lock lever 64 returns in the direction opposite to the arrow mark c, and the lock of the ASF pendulum arm 47 is released, and when the ASF motor 46 is reversed, the motor returns to a state capable of transferring the drive to the main ASF side.

By the above-described drive mechanism of the lift cam shaft 58, the release of the pinch roller 22, the lock of the PE sensor lever 66, the pressure adjustment of the pinch roller spring 24, the up and down movement of the sheet passing guide 70, and the up and down movement of the carriage 13 are made possible.

<Correlative Operation of Lift Mechanism>

Next, how these five types of lift mechanisms correlatively operate will be described. FIGS. 10A to 10D are schematic partial side views to show the operations of the carriage 13, the pinch roller 22, the PE sensor lever 66, and the sheet passing guide 70.

Figure 10A:
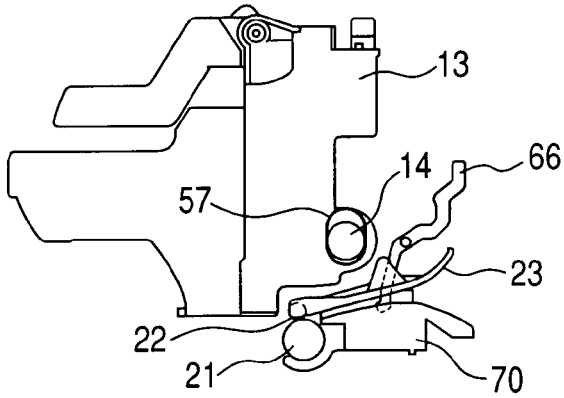
FIGS. 10A, 10B, 10C and 10D are explanatory drawings to show respective positions of a lift mechanism according to one embodiment of the present invention.

FIG. 10A shows the case where the lift mechanism is in a first position. In this state, the pinch roller 22 is in a state of press-contacting the sheet passing roller 21, and the PE sensor lever 66 is in a free state, and the pinch roller spring 24 (ref. FIGS. 4A to 4C) press-contacts with a normal pressure, and the sheet passing guide 70 is in a lifting state, and the carriage 13 is in a first carriage position.

The state shown in FIG. 10A shows a position used for a recording operation using the ordinary recording sheet 4 or a registration after the reversal of the recording sheet at the sheet reversing portion 2. As described above, the carriage 13 is movably guided and supported along the guide shaft 14, and the guide shaft 14 is configured so as to be movable up and down by the up and down movement along the guide long hole 57 formed on the chassis 10.

Figure 10B:
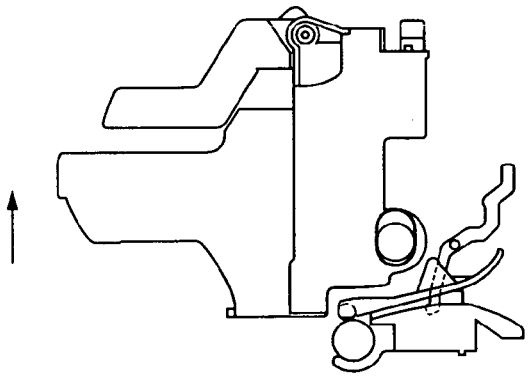

FIG. 10B shows the case where the lift mechanism is in a second position. In this state, the pinch roller 22 is in a state of press-contacting the sheet passing roller 21, and the PE sensor lever 66 is in a free state, and the pinch roller spring 24 press-contacts with a normal pressure, and the sheet passing guide 70 is in a lifting state, and the carriage 13 is in a second carriage position. In this state, compared to the first position of the lift mechanism, the only difference is a position of the height of the carriage 13. This state shows a position used for the case where the deformation of the recording sheet 4 is great and there is the possibility of friction between the recording sheet 4 and the recording head 11 or the case where a slightly thick recording sheet 4 is used.

Figure 10C:
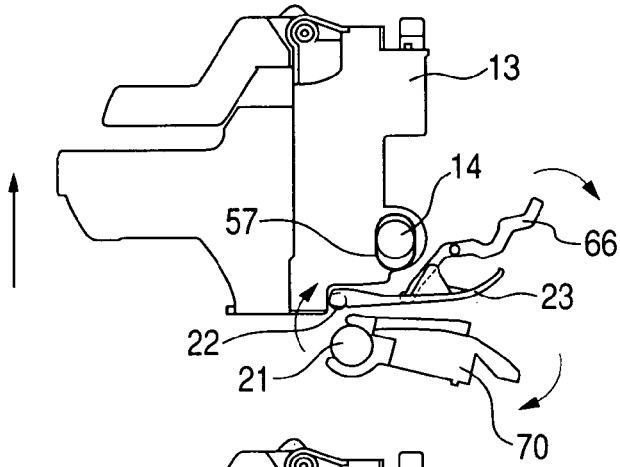

FIG. 10C shows the case where the lift mechanism is in a third position. In this state, the pinch roller 22 is released from the sheet passing roller 21, and is in a state of having a predetermined clearance with the roller 21, and the PE sensor lever 66 is evacuated upward and in a locked state, and the pinch roller spring 24 is in a state having a weakened press-contacting force, and the sheet passing guide 70 is in a descending state, and the carriage 13 is in a third carriage position which is the highest. Compared to the second position of the lift mechanism, this is a state where all the states are changed, and the sheet material pathway is completely opened, and the lead-in (or introduction) of the recording sheet 4 is made possible. This state shows a position used for the case where the recording sheet 4 is conveyed in the direction of the arrow mark b of FIG. 2 after a recording on the front surface of the recording sheet 4 is completed or the case where a thick recording sheet 4 is inserted.

Figure 10D:
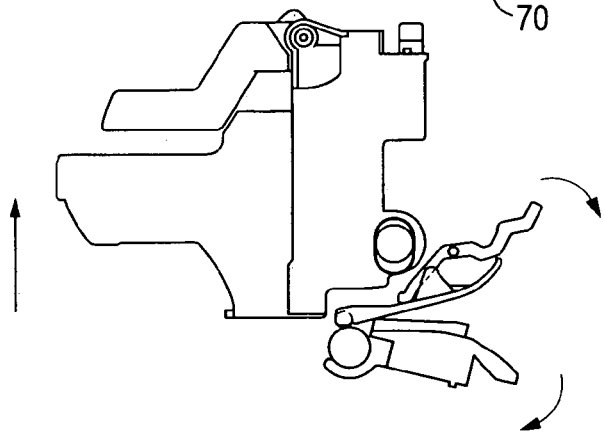

FIG. 10D shows the case where the lift mechanism is in a fourth position. In this state, the pinch roller 22 press-contacts the sheet passing roller 21, and the PE sensor lever 66 is evacuated upward and in a locked (engaged) state, and the pinch roller spring 24 is press-contacted with a slightly weak pressure, and the sheet passing guide 70 is in a descending state, and the carriage 13 is in a third position which is the highest. Compared to the third position of the lift mechanism, this state is changed such that the pinch roller 22 is restored to a press-contacted state, and a press-contacting pressure of the pinch roller spring 24 becomes slightly weak. This state is a position used for the case where the recording sheet 4 is conveyed to the sheet reversing portion 2 after the re-lead-in of the recording sheet 4 at the time of the automatic both-side recording or the case where the thick recording sheet 4 is used and recorded.

In the present embodiment, in view of the operation of the recording apparatus, the lift mechanism is positioned at any one of four positions shown in FIGS. 10A to 10D, and by being limited to the four positions, the lift mechanism is simplified. That is, during one rotation of the lift cam shaft 58, the position is allowed to change by circulating from the first position, the second position, the third position, and the fourth position, and then, back to the first position again.

Figure 11:
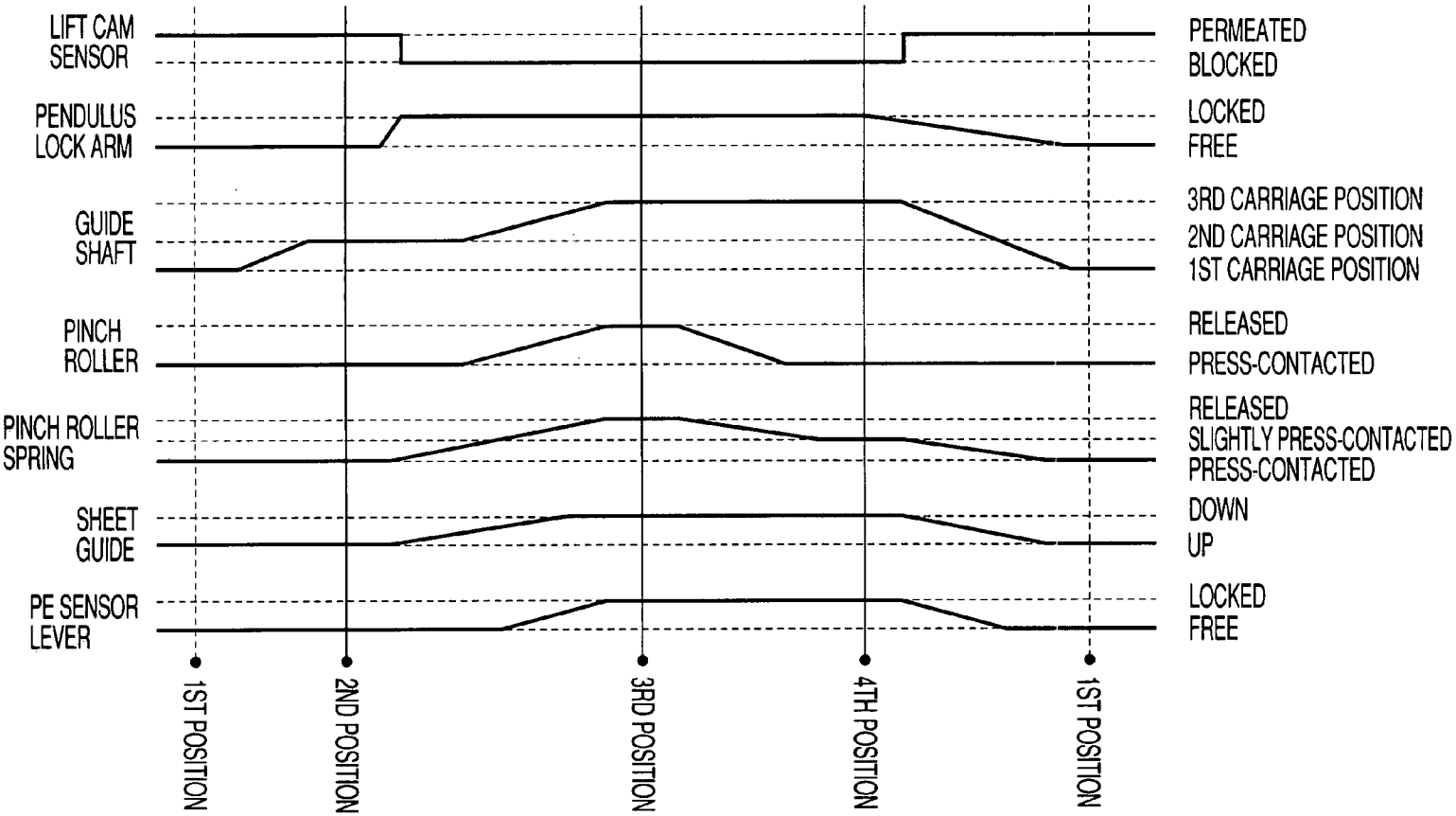
FIG. 11 is a timing chart to show the operation of the lift mechanism according to one embodiment of the present invention.

In FIG. 11 is shown a timing chart for representing the operational state of the lift mechanism, and by referring to the timing chart of FIG. 11, the contents shown in FIGS. 4A to 10D are easy to understand. The abscissa axis of FIG. 11 shows an angle of the lift cam shaft 58 in the range of 360 degrees, and a position of each component of the mechanism at each angle position. By synchronizing and operating the lift cam shaft 58 and the guide shaft 14, the angle of the lift cam shaft 58 is detected by the lift cam sensor 69 (ref. FIG. 3), and only by controlling the rotational angle of the ASF motor 46 (ref. FIG. 21), a plurality of mechanisms can be simultaneously operated.

However, the present invention is not limited to this, but may be configured such that each component of the mechanism independently operates. Further, the pressure adjustment mechanism of the pinch roller spring 24 is not indispensable, but can be omitted in the case where a rigidity of the pinch roller holder 23 is still sufficiently high or a load fluctuation of the LF motor 26 is not questionable. Further, even when the sheet passing guide 70 is horizontal by the arrangement of the main ASF 37 and the like, if the mechanism is such as being able to skillfully guide the top end of the recording sheet to the nip portion of the sheet passing roller 21, there is no need for the up and down mechanism of the sheet passing guide 70.

(Description of the Operation of the Present Embodiment)

Next, a method of executing a recording on the recording sheet by the both-side recording apparatus of the present embodiment will be described. First, each of the characteristic steps from among the recording methods in the present embodiment will be described.

<Sheet Feeding Operation>

When recording data is transmitted to a control substrate (or board) 301 from a host device 308 shown in FIG. 21 through an interface (I/F) 309, a RAM 312 stores the recording data, and a CPU 310 issues a recording operation start command, and starts the recording operation. When the recording operation is started, first a sheet feeding operation is executed. The main ASF 37 shown in FIGS. 1 and 2 takes out one sheet by one sheet from a plurality of recording sheets 4 loaded on the thick plate 41 for each recording operation, and delivers it to the conveying portion. To be more precise, upon receipt of the sheet feeding operation start command, the ASF motor 46 rotates in the forward direction, and though not illustrated, its motive power rotates the cam which holds the thick plate 41 through the gear row. When the cam is rotated by the rotation of the ASF motor 46, the thick plate 41 is released from a state of being pressed by the cam, and is biased to the sheet feeding roller 39 by the action of an unillustrated thick plate spring. At the same time, the sheet feeding roller 39 is rotated in a direction to convey the recording sheet, and the conveyance of the topmost one sheet from among the recording sheets loaded on the thick plate 41 is started.

However, depending on conditions such as a frictional force between the sheet feeding roller 39 and the recording sheet 4 or the mutual frictional force among the recording sheets 4, and the like, a plurality of recording sheets 4 are sometimes simultaneously discharged. In that case, the separating roller 40, which is press-contacted by the sheet feeding roller 39, and moreover, has a predetermined return rotational torque in a direction opposite to the conveying direction of the recording sheet 4, is operated, and this separating roller 40 pushes back to the original thick plate 41 the recording sheet 4 other than the recording sheet 4 contacted with the sheet feeding roller 39. By such an operation, the recording sheet 4 is conveyed to the conveying portion only by one sheet. At the time of completing the sheet feeding operation, the separating roller 40 is released from the press-contacted state with the sheet feeding roller 39 by the operation of the cam, and is separated by a predetermined distance, and at this time, the return claw 43 is rotated, and reliably pushes back the recording sheet 4 returned by the operation of the separating roller 40 to a predetermined position on the thick plate 41.

<Sheet Conveying Operation>

When one recording sheet 4 is conveyed from the main ASF 37, though the top end of the recording sheet 4 abuts against the ASF flap 44 (ref. FIG. 2) which is biased so as to narrow down the sheet material pathway by an unillustrated ASF flap, the top end pushes aside and passes through the ASF flap 44. When the recording operation on the recording sheet 4 is completed, and the rear end of the recording sheet passes through the ASF flap 44, since the ASF flap 44 restores its biased state with the sheet material pathway closed, there is no returning of the recording sheet 4 to the main ASF 37 even if conveyed in an opposite direction slightly.

One recording sheet 4 conveyed from the sheet feeding portion in such a manner is conveyed to the nip portion between the sheet passing roller 21 and the pinch roller 22.

The recording sheet 4 conveyed by the main ASF 37 is hit upon the nip portion between the sheet passing roller 21 and the pinch roller 22 which are in a stopping state. At this time, by conveying the recording sheet 4 by a distance slightly longer than the length of the predetermined sheet material pathway by the main ASF 37, the recording sheet 4 is warped in the shape of a loop between the sheet feeding roller 39 and the sheet passing roller 21. A force by which the loop tries to restitute its straightness press-contacts the top end of the recording sheet 4 to the nip portion between the sheet passing roller 21 and the pinch roller 22. This allows the top end of the recording sheet 4 to follow the sheet passing roller 21 to be parallelized, thereby completing a so-called registration capturing. After having completed the registration capturing, the LF motor 26 starts rotating in a direction to move the recording sheet 4 in the forward direction (direction to travel to the first sheet discharge roller 30).

After that, the provision of the driving force to the sheet feeding roller 39 is stopped, and the sheet feeding roller 39 rotates following the recording sheet 4. At this point of time, the recording sheet 4 is conveyed only by the sheet passing roller 21 and the pinch roller 22.

The top end of the recording sheet 4 gradually arrives in the nip portion between the first sheet discharge roller 30 and the first spur row 32, and the nip portion between the second sheet discharge roller 31 and the second spur row 33. The peripheral velocity of the first sheet discharge roller 30 and the second sheet discharge roller 31 is set approximately equal to the peripheral velocity of the sheet passing roller 21, and moreover, since the sheet passing roller 21 and the first sheet discharge roller 30 and the second sheet discharge roller 31 are connected by an unillustrated gear row, the first sheet discharge roller 30 and the second sheet discharge roller 31 rotate in synchronization with the sheet passing roller 21, thereby stably conveying the recording sheet 4 to the recording portion without being slackened and stretched.

<First Recording Operation>

First, the recording portion executes a recording on the face side surface for the conveyed recording sheet 4. That is, in a state of the recording sheet 4 stopped for a time, the carriage 13 mounted with the recording head 11 is transferred with a driving force from the carriage motor 17 through the carriage belt 16 while being guided to the guide shaft 14 and the guide rail 15, thereby executing a reciprocating scanning in a direction (usually in a direction orthogonal) to cross the conveying direction of the recording sheet 4, and at the same time, the recording head 11 ejects the ink on the recording sheet and executes a recording for one line portion according to the recording signal transferred through the flexible flat cable 73 from a head driver 307 shown in FIG. 21. When the recording for one line portion is completed, the recording sheet 4 is conveyed by the conveying portion only by one line pitch along a rib provided in the platen 29. The alternate repetition of the carriage scanning, the ink ejection from the recording head 11 and the conveyance of the recording sheet 4 every one line pitch allow the recording operation on the whole of the face side surface of the recording sheet to be executed.

Here, a recording range at the time of recording on the face side will be described. The recording head 11 has an ejection port area N (referred to also as (recording area) or (ink ejection area)) shown in FIG. 2 between the sheet passing roller 21 and the first sheet discharge roller 30, but, for the reason of the arrangement of an ink flow path reaching the ejection port or for the reason of the wiring to an actuator (ejection energy generating means) to eject the ink and the like, it is usually difficult to arrange the ejection port area N in the most vicinity of the nip portion of the sheet passing roller 21. Consequently, in the range where the recording sheet 4 is nipped between the sheet passing roller 21 and the pinch roller 22, there is no alternative but to arrange the recording head 11 in such a manner that its end portion comes to the downstream side of the nip portion of the sheet passing roller 21, for example, a position alienated by a length D1 shown in FIG. 2, and as a result, the recording sheet 4 is unable to be recorded in the area adding the length D1 to the portion nipped by the nip portion.

To reduce such a blank space area of the lower end of the recording sheet 4, in the present embodiment, the recording sheet 4 is allowed to come off the nip portion between the sheet passing roller 21 and the pinch roller 22 and to be conveyed only by the first sheet discharge roller 30 and the second sheet discharge roller 31, thereby continuing the recording. This allows the recording operation to dwindle the blank space of the lower end substantially into zero. However, by doing so, after recording on the face side surface, when an attempt is made to convey the recording sheet in the direction of the arrow mark b of FIG. 2 toward the sheet reversing portion 2, it becomes difficult to smoothly insert the rear end portion of the recording sheet 4 into the nip portion between the sheet passing roller 21 and the pinch roller 22, and there is strong possibility of developing a so-called jamming. In the present embodiment, to avoid the jamming, by using the above-described pinch roller release mechanism, as shown in FIG. 4B, the pinch roller 22 is released from the sheet passing roller 21 so as to create a predetermined clearance between thereof, and the end portion of the recording sheet 4 is led into that clearance, and after that, as shown in FIGS. 4A to 4C, the pinch roller 22 is press-contacted again to the sheet passing roller 21, thereby making it possible to convey the recording sheet in the direction of the arrow mark b of FIG. 2.

<Lead-In Operation>

As described above, after having completed the recording on the face side surface, the recording sheet 4 is conveyed in the direction of the arrow mark b of FIG. 2 through a horizontal pathway provided below the main ASF 37. Since the sheet reversing portion 2 is arranged at the back of the main ASF 37, the recording sheet 4 is guided to the inside of a double-sided unit 2 from the horizontal pathway, and is conveyed in the direction of the arrow mark c of FIG. 2.

Figure 12A:
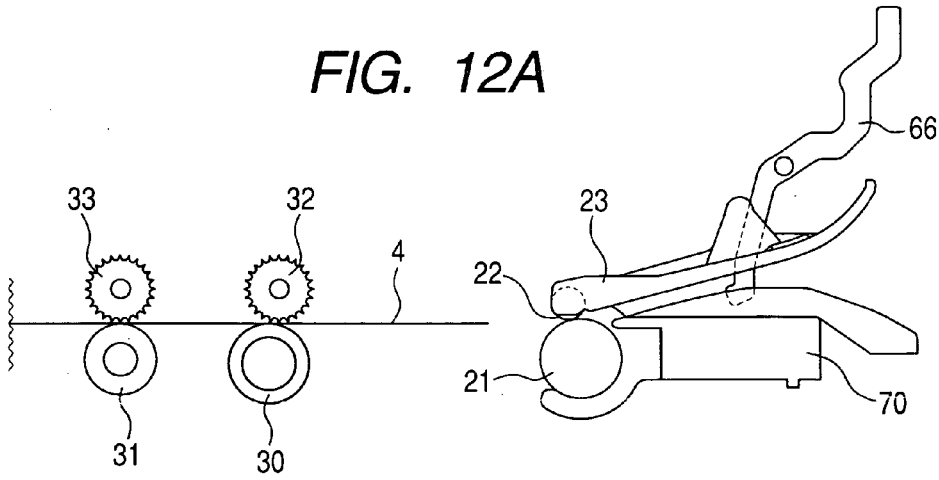
FIGS. 12A, 12B and 12C are explanatory drawings to show a back feed operation of the recording sheet according to one embodiment of the present invention.
Figure 12B:
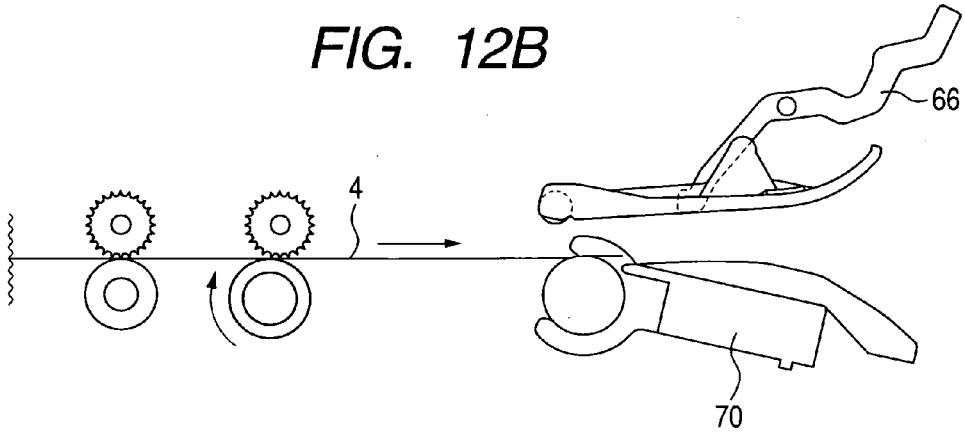
Figure 12C:
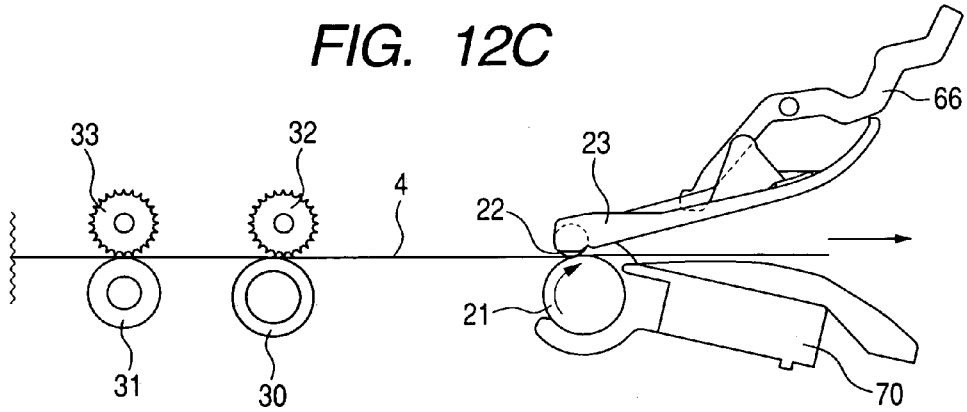

FIGS. 12A to 12C are schematic side views to explain a step of leading the recording sheet again into the nip portion of the sheet passing roller 21 after having completed the recording on the face side surface of the recording sheet 4. FIG. 12A shows a nipped state of the recording sheet 4 by the first sheet discharge roller 30 and the first spur row 32 and the second sheet discharge roller 31 and the second spur row 33 after having completed the recording on the face side surface of the recording sheet 4. At this time, the lift mechanism is in the state of the first position or the second position.

As described above, when the recording sheet 4 is allowed to travel up to the state shown in FIG. 12A so as to execute a recording, the ejection port row of the recording head 11 can face to a full length of the rear end portion of the recording sheet 4, and it is, therefore, possible to execute a recording without creating any blank space in the lower end of the recording sheet 4.

Next, the lift mechanism is moved to a third position as shown in FIG. 12B, and a predetermined clearance is left between the pinch roller 22 and the sheet passing roller 21. This allows the rear end of the recording sheet 4 to be easily led even if it is slightly undulated and curved upward. At this time, there is hardly any interference between the pinch roller holder 23 and the carriage 13, and therefore, it does not matter at which position of the main scanning direction the carriage 13 is located.

The first sheet discharge roller 30 is rotated in the direction of the arrow mark from the state shown in FIG. 12A, and the recording sheet 4 is conveyed in the direction of the arrow mark b of FIG. 2 (hereinafter, the conveyance of the recording sheet 4 in this direction is referred to as (back feed) or (reversal direction conveyance), and as shown in FIG. 12B, is moved to the beneath of the pinch roller 22, and then, is stopped. The reason why the recording sheet 4 is stopped in this state is mainly because the recording apparatus of the present embodiment adopts a wet type inkjet recording system, and therefore, the recorded surface of the recording sheet 4 (upper surfaces of FIGS. 12A to 12C) is in a wetted state by the ink immediately after the recording operation, and if it is press-contacted immediately by the pinch roller 22 and the sheet passing roller 21, the ink is transferred on the pinch roller 22, and the ink thereof is transferred again on the recording sheet 4, so that there is a likelihood of causing a contamination on the recording sheet 4. That is, in the state shown in FIG. 12B, the recording sheet 4 is on standby state until the ink dries up.

The reason why the recording sheet 4 is put into a standby state for drying up by not having it back fed to the position shown in FIG. 12A, but to the position shown in FIG. 12B by having rotated the sheet passing roller 21 in the reverse direction is mostly because of the deformation of the recording sheet 4. That is, when a recording on the recording sheet 4 is executed by a wet type inkjet recording system, since the recording sheet 4 absorbs moisture, a fiber configuring the sheet material is sometimes swelled, thereby expanding the recording sheet 4. Depending on a pattern to be recorded, an expandable portion and an unexpandable portion sometimes co-exist in the recording sheet 4, and in such a case, a remarkable unevenness is particularly formed. The size of the unevenness depends on the time having elapsed after the recording sheet starts absorbing the moisture, and as the time elapses, the unevenness increases and converges into a predetermined amount of deformation. When a long time elapses and the amount of deformation of the end portion of the recording sheet 4 becomes large, even when the pinch roller 22 is alienated from the sheet passing roller 21, if the recording sheet is inserted into the nip portion, the end portion thereof interferes with the pinch roller 22, and there is a likelihood of causing a jamming. To prevent this jamming, after having completed the recording, the recording sheet 4 is back fed before the deformation of the unevenness becomes large and is moved until it comes under the pinch roller 22. Because of the above-described reason, while the recording sheet 4 is put into a state of being back fed to the position shown in FIG. 12B, the drying up of the ink on the recorded portion of the recording sheet 4 is awaited. The clearance between the sheet passing roller 21 and the pinch roller 22 in a state where both of them are separated (released state) is usually set in such a manner as to become larger than the amount of deformation of the recording sheet 4 after recording on the first surface (face side surface) of the recording sheet 4.

FIG. 12C shows a state of conveying (reverse direction conveyance) the recording sheet 4 to the sheet reversing portion 2. When the recording sheet 4 is put into a state of not transferring the ink even in case the recorded portion of the recording sheet 4 dries up and press-contacts the pinch roller 22, the lift mechanism is moved to a fourth position as shown in FIG. 10D, and the recording sheet 4 is nipped by the pinch roller 22 and the sheet passing roller 21. In this state, the sheet passing roller 21 is rotated in a reverse direction, and the recording sheet 4 is back fed. At this time, since the PE sensor lever 66 is rotated upward and locked, there is no eating by the top end of the PE sensor lever 66 into the recording sheet 4 or no friction nor any peeling off of the recorded portion. Further, since the sheet passing guide 70 is in a descending state, its sheet passing surface is approximately horizontal, and the sheet passing guide 70 can convey the recording sheet 4 straightly to the sheet reversing portion 2. In the present embodiment, though, in a normal state, the sheet passing guide 70 is in a lifting state, the present invention is not limited to this state, but the normal state of the sheet passing guide 70 may be taken as the descending state. That is, the normal standby state is taken as the third position or the fourth position of the lift mechanism, and it is possible to set up a configuration such that the normal standby state is moved to the first position at the time of the sheet feeding operation from the main ASF 37. If configured in such a manner, when the recording sheet 4 having a high rigidity is inserted from the sheet discharge roller side, the insertion can be smoothly executed.

A time required for drying up the ink which exerts influence on the stopping time (drying standby time) in the state shown in FIG. 12B will be supplementarily described. Whether or not there is any possibility of the ink being transferred on the pinch roller 22, in other words, whether or not the ink shot in the recording sheet 4 is drying is affected by a variety of conditions. That is, the type of the recording sheet 4, the type of the ink in use, the superimpose shooting (or overlap-landing) method of the ink in use, the amount of shooting (or landing) of the ink in use for every unit area, (for example, a mass density for every unit area of the recorded data), the environmental temperatures under which the recording operation is executed, the environmental humidity under which the recording operation is executed, and the condition of the velocity of the flow of the environmental vapor under which the recording operation is executed. Broadly speaking, when the recording sheet 4 having an ink reception layer in its surface and being capable of quickly leading the ink into the interior is used, the ink can quickly dry up. Moreover, if the ink in which ink particles are small and easy to permeate the interior of the recording sheet and the main ingredients thereof are mainly dyes and the like is used, the ink can quickly dry up. Again, if the ink chemically responsive is used and is solidified by the superimpose shooting on the front surface of the recording sheet, the ink can quickly dry up. Again, if the amount of ink shot for every unit area is small, the ink can quickly dry up. Again, if the environmental temperatures under which the recording operation is executed is increased, the ink can quickly dry up. Again, if the environmental humidity under which the recording operation is executed is decreased, the ink can quickly dry up. Again, if the velocity of the flow of the environmental vapor is increased, the ink can quickly dry up. As described above, since the drying time is decided by several conditions, the present embodiment is configured by using a predetermined ink system such that a drying time required in case a recording is executed by an ordinary use condition (ordinary recording sheet and ordinary recording operation environment) is designated as a standard time, and the drying time is allowed to fluctuate by a predictable condition.

What is meant by this predictable condition is the amount of ink shot (or ink landing) for every unit area. In addition to this, if environmental temperature detection means, environmental humidity detection means, environmental velocity of wind detection means, and the like are used together, it is possible also to predict the drying standby time more in detail. For example, the data received from the host device 308 shown in FIG. 21 is stored on the RAM 312, and the amount of ink shot for every unit area is calculated, and its maximum value and a predetermined threshold value recorded in the ROM 311 are compared, thereby deciding the drying standby time. That is, in case the maximum value of the amount of ink shot for every unit area is large, the drying standby time is made long, and on the other hand, in case the maximum value is small, the drying standby time is made short, so that the drying standby time by the recording pattern can be optimized.

Further, depending on whether or not the type of ink used for the recording is dye system ink or pigment system ink, the drying standby time varies, but in case of the dye system ink, since it is easy to dry up, the drying standby time is made short, and in case of the pigment system ink, since it is hard to dry up, the drying standby time is made long. Further, when the environmental temperatures are high, since the ink is easy to dry up, the drying standby time is made short, and when the environmental temperatures are low, since the ink is hard to dry up, the drying standby time is made long. Further, when the environmental humidity is high, sine the ink is hard to dry up, the drying standby time is made long, and when the environmental humidity is low, since the ink is easy to dry up, the drying standby time is made short. Further, in case of the recording sheet which has an ink reception layer on its surface and is capable of quickly leading the ink into the interior of the sheet material, since the surface of the recording sheet is easy to dry up, the drying standby time is made short, and in case of the recording sheet which is strong in water repellent, since the ink is hard to dry up, the drying standby time is made long.

<Reversal Operation>

As shown in FIG. 2, inside the sheet reversing portion 2, the recording sheet 4 is nipped by the second double-sided roller 109 and the second double-sided pinch roller 113 so that its traveling direction is switched, and furthermore, is nipped by the first double-sided roller 108 and the first double-sided pinch roller 112 so that it is conveyed in the direction of the arrow mark d of FIG. 2, and finally its traveling direction is switched 180 degrees to return to the horizontal sheet material pathway. The recording sheet 4 after having completed the recording on the face side surface in such a manner is reversed upside down through a horizontal pathway below the main ASF 37 and the sheet reversing portion 2 at the back of the main ASF 37, so that it is conveyed again to the recording portion and the recording on the rear side surface can be executed.

Figure 13:
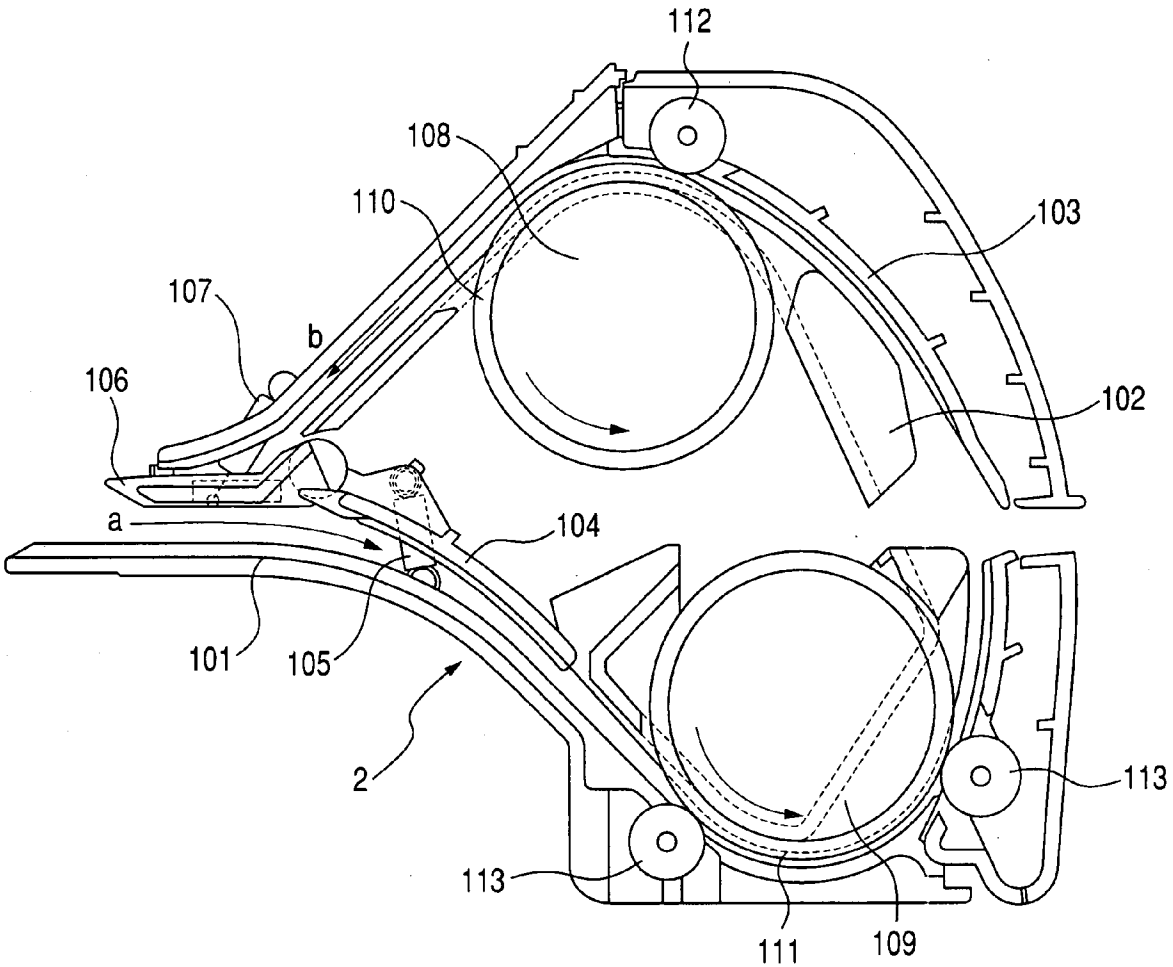
FIG. 13 is a schematic sectional side view to show the configuration of a sheet reversing portion according to one embodiment of the present invention.
Figure 14A:
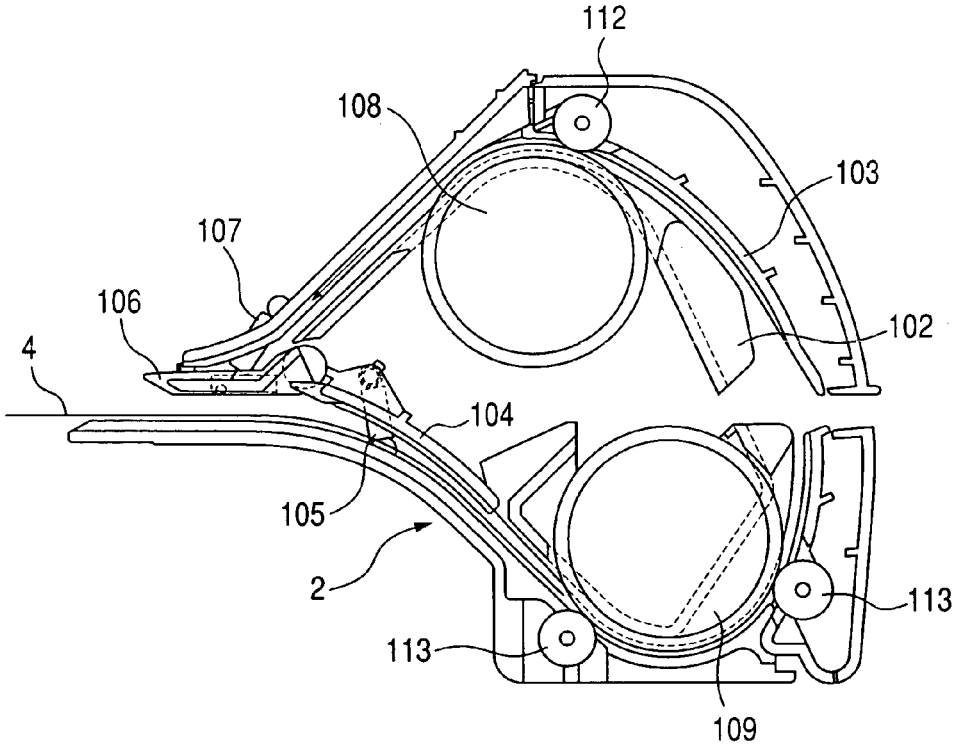
FIGS. 14A and 14B are explanatory drawings to show the operation of a flap of the sheet reversing portion according to one embodiment of the present invention.
Figure 14B:
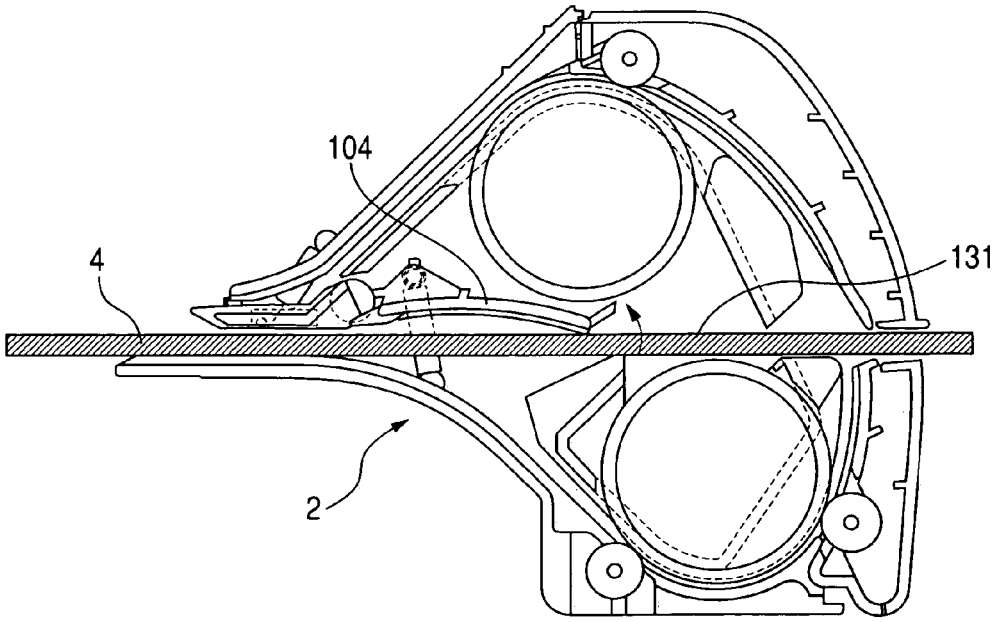

FIGS. 13 to 14B are schematic sectional side views to show the sheet material pathway and the conveying roller of the sheet reversing portion 2. As shown in FIGS. 13 to 14B, in the interior of the sheet reversing portion 2, there are provided: a sheet reversing portion frame 101 which configures two structures of the sheet reversing portion 2 and a part of the sheet material conveying pathway; an inner guide 102 which is fixed to the interior of the sheet reversing portion frame 101 and configures a part of the sheet material conveying pathway; a rear cover 103 which is closably arranged at the back of the sheet reversing portion frame 101 and configures a part of the sheet material conveying pathway; a selector flap 104 biased to a predetermined direction by a selector flap spring 105; an exit flap 106 biased in a predetermined direction by an exit flap spring 107; the first double-sided roller 108 including a first double-sided roller rubber 110, and the second double-sided roller 109 including a second double-sided roller rubber 111.

When the recording sheet 4 is conveyed to the sheet reversing portion 2 by rotating the sheet passing roller 21 in a reverse direction from the state shown in FIG. 12C, the exit flap 106 is biased by the exit flap spring 107, and as shown in FIG. 13, a lead-in path is limited to one direction. Hence, the recording sheet 4 travels in the direction of the arrow mark a of FIG. 13. Then, the recording sheet 4 hits on the selector flap 104. In case of the recording sheet 4 capable of executing the ordinary both-side recording, the load of the selector flap spring 105 is set in such a manner as not to rotate the selector flap 104, and so the recording sheet 4 travels along the pathway between the selector flap 104 and the double-sided unit frame 101. Still continuing in this manner, and in a state where the recorded surface (face side surface) abuts against the second double-sided roller rubber 111 of the second double-sided roller 109 and the surface not finished with the recording (rear side surface) abuts against the second double-sided pinch roller 113 made of highly lubricating high-molecular resin, the recording sheet 4 continues to be nipped between both of the roller rubber 111 and the pinch roller 113.

At this time, since the peripheral velocities of the first double-sided roller 108 and the second double-sided roller 109 as well as the sheet passing roller 21 are set approximately identical by the drive mechanism to be described later, the recording sheet 4 continues to be conveyed without developing a slippage with the second double-sided roller 109. Further, since the peripheral velocity is approximately identical, there is no slackening nor any tension applied on the recording sheet 4. When its traveling direction is changed by the second double-sided roller 109, the recording sheet 4 travels along the rear cover 103, and similarly, continues to be nipped between the first double-sided roller rubber 110 of the first double-sided roller 108 and the first double-sided pinch roller 112.

The recording sheet 4 has its traveling direction changed again by the first double-sided roller 108, and is conveyed in the direction of the arrow mark b of FIG. 13. The first and second double-sided rollers 108 and 109 configure reverse rollers for reversing both sides and the conveying direction of the recording sheet 4. When the recording sheet 4 continues to travel, the top end of the recording sheet 4 abuts against the exit flap 106. Since the exit flap 106 is biased by an exit flap spring 107 having a very weak load, the recording sheet 4 itself pushes aside the exit flap 106 and goes out of the sheet reversing portion 2. When the top end in the traveling direction of the recording sheet 4 goes out of the exit flap 106, since the length of the sheet material pathway in the interior of the sheet reversing portion 2 is set such that the rear end in the traveling direction of the recording sheet 4 passes through the underneath of the exit flap 106, the top end portion and the rear end portion of the recording sheet 4 are not in friction.

Although the details will be described later, the present embodiment is configured such that, when the recording is executed on the face side surface of the recording sheet 4, it is possible to measure the length of the recording sheet 4 by the PE sensor lever 66, and therefore, when the recording sheet 4 is inserted, which is shorter than the distance from the sheet passing roller 21 to the second double-sided roller 109 or the distance from the first double-sided roller 108 to the sheet passing roller 21 or when the recording sheet 4 is inserted, which is longer than the distance that makes a full circle from the exit flap 106 of the sheet reversing portion 2 and returns to the exit flap 106, a warning is issued at the stage of completing the recording on the face side surface, and the recording sheet 4 is discharged without being conveyed to the sheet reversing portion 2.

Here, the reason why the recorded surface of the recording sheet 4 is conveyed to the first double-sided roller rubber 110 and the second double-sided roller rubber 111 side will be explained. Since the first double-sided roller rubber 110 and the second double-sided roller rubber 111 are a driver side, and the first double-sided pinch roller 112 and the second double-sided pinch roller 113 are a driven side, the recording sheet 4 is conveyed by following the driver side roller, and the driven side is rotated by a frictional force with the recording sheet 4. At this time, in case a shaft damage of the rotational shaft supporting the first double-sided pinch roller 112 and the second double-sided pinch roller 113 is sufficiently small, it may be all right, but in case the shaft damage is increased for some causes, there is the possibility of developing a slippage between the recording sheet 4 and the first double-sided pinch roller 112 or the second double-sided pinch roller 113. Although a portion recorded in the recording sheet 4 has the ink dried to the extent of not being transferred because of the abutment against the roller, there is also the possibility of the ink being stripped off the surface of the recording sheet 4 when rubbed relatively strongly. Supposing that the recorded surface of the recording sheet 4 contacts the first double-sided pinch roller 112 and the second double-sided pinch roller 113 and develops a slippage with those rollers, there is the possibility of the ink on the recorded surface being stripped off because of a strong friction. To prevent such a stripping off of the ink, in the present embodiment, an arrangement is set up such that the driver side member abuts against the recorded surface (face side surface), and the driven side member abuts against the non-recorded side (rear side surface).

Moreover, the following reason can be cited for making such an arrangement. That is, since the first double-sided roller 108 or the second double-sided roller 109 at the driver side is regulated by a flexion radius of the recording sheet 4, there is no alternative but to allow the diameter to attain some degree of a size, but it is possible to make the diameter small for the first double-sided pinch roller 112 and the second double-sided pinch roller 113. Consequently, to design the sheet reversing portion 2 compact, there are often the cases where the first double-sided pinch roller 112 and the second double-sided pinch roller 113 are designed to be minor in diameter. Further, though no ink is basically transferred on the roller side from the recorded surface of the recording sheet 4, a little amount of ink is transferred, and the roller abutting against the recorded surface is sometimes gradually contaminated by the ink. In case of the miniaturized roller, since the frequency of contacting the outer periphery of the roller by the recording sheet 4 increases, the speed of being contaminated is higher than that of a roller having a large diameter, and it is, therefore, said that the minor diameter roller is not advantageous for the contamination. Because of the above described reason, in the present embodiment, in view of the miniaturization of the apparatus and the contamination of the roller, an arrangement is set up such that the first double-sided roller 108 and the second double-sided roller 109 having a large diameter are placed on the side which abuts against the recorded surface (face side surface) of the recording sheet 4.

Furthermore, the following reason can be cited for making such an arrangement. That is, in case a sheet material is nipped and conveyed by a pair of rollers with one roller thereof driven, to make the amount of conveyance accurate, the driver side is made of material high in coefficient of friction, and the driven side is made of material low in coefficient of friction, and either of the sides is often configured by an elastic material to make the area of the nip portion (nip area) large. Usually, a high coefficient of friction is obtained at a relatively low cost, and it is quite usual to use a raw material of a rubber class (rubber-like elastic material) rich in elasticity as a material of the driver side roller. Further, to increase a capacity for transport, a method for giving a rough polishing to the surface of the rubber class including elastomer and the like and intentionally putting on minute ruggedness is often employed. In this case, the driven side is generally configured by high-molecular resin being relatively small in coefficient of friction of the surface. In case the rubber class attached with micro ruggedness is compared to the surface of a smooth high-molecular resin, when they are allowed to abut against the recorded surface of the recording sheet 4, the contamination of the ink adheres on both of them, while in case of the rubber class attached with micro ruggedness, since the ruggedness keeps the contamination, any contamination is hardly transferred again on the recording sheet 4. However, in case of the smooth high-molecular resin, since the contamination is stripped off, and is often transferred again on the recorded surface of the recording sheet 4, it can be said that the rubber class can be advantageously abutted against the recorded surface of the recording sheet 4. Because of the above described reason, in the prevent embodiment, in view of the miniaturization of the apparatus and the contamination of the roller, an arrangement is set up such that the roller of the rubber class raw material is placed on the side which abuts against the recorded side (face side surface) of the recording sheet 4, and the roller made of the high-molecular resin raw material is placed on the side which abuts against the non-recorded surface (rear side surface).

<Processing of High Rigidity Recording Sheet>

Next, by using the above-described sheet reversing portion 2, the operation in case of executing a recording on a high rigidity recording sheet will be described. What is meant by the high rigidity recording sheet is, for example, a cardboard (or thick sheet) about 2 mm to 3 mm in thickness or a disc or irregular shape recording sheet, and there are supposed to be such cases where it is loaded on a predetermined tray and conveyed. Since such a recording sheet is high in rigidity, it is unable to bend to follow the diameter of the double-sided roller of the sheet reversing portion 2, and thus, it is unable to execute the automatic both-side recording. However, it is possible to execute a recording on one side of such a high rigidity recording sheet while in a state of the sheet reversing portion 2 being mounted on the recording apparatus.

In case the recording sheet 4 is high in rigidity, it is not possible to execute a sheet feeding by using the main ASF 37. In such a case, to use a straight sheet material pathway, the recording sheet 4 is fed from the sheet discharge roller side to the sheet passing roller 21 side. The operation of the sheet reversing portion 2 in case of such a time will be described below.

FIGS. 14A and 14B are schematic sectional side views to explain the operation of the selector flap 104. FIG. 14A shows a state of executing the automatic both-side recording by using the above-described ordinary recording sheet 4. In this state, the selector flap spring 105 continues to bias the selector flap 104 to a stopper by opposing to the pressuring force of the recording sheet 4, and this allows the recording sheet 4 to be guided to a reversal sheet material pathway.

Figure 22:
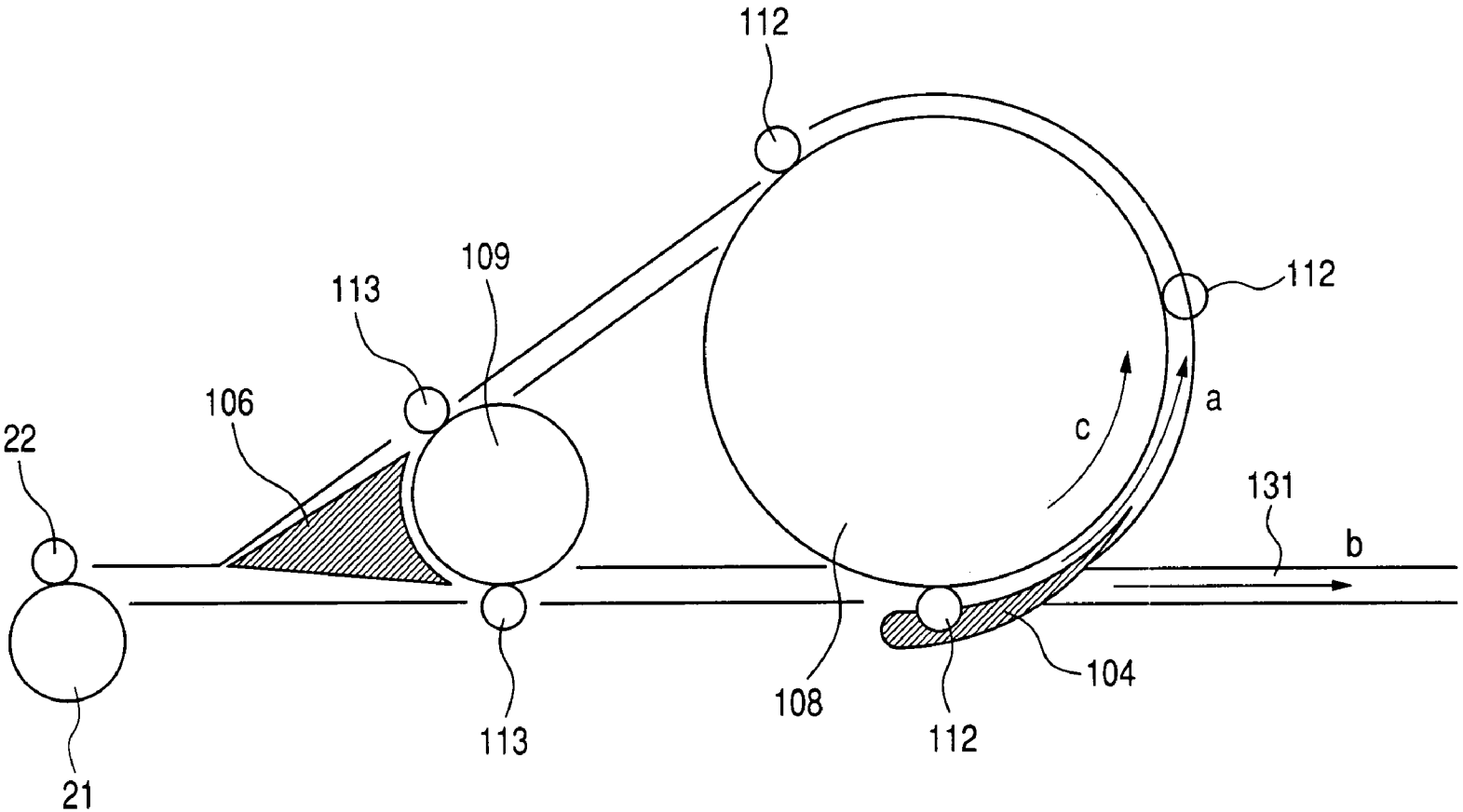
FIG. 22 is a schematic sectional side view to show another example of the sheet reversing portion according to one embodiment of the present invention.

FIG. 14B shows a state of using the high rigidity recording sheet 4. When the high rigidity recording sheet 4 is conveyed to the sheet reversing portion 2, the recording sheet 4 passes through under the exit flap 106 and abuts against the selector flap 104. Since the selector flap spring 105 is set to a spring load to the extent of evacuating the selector flap 104 by the pressuring force when the high rigidity recording sheet 4 is inserted to press the selector flap 104, it is swung counterclockwise (arrow mark direction of FIG. 14B) and evacuates by following the traveling of the high rigidity recording sheet 4. Hence, the high rigidity recording sheet 4 is guided to an evacuating path 131 which is the second sheet material pathway provided between the first double-sided roller 108 and the second double-sided roller 109. In the region which is equivalent to the evacuating path 131 of the rear cover 103, there is perforated a hole, and therefore, even in case of using a long, high rigidity recording sheet 4, the sheet does not interfere with the sheet reversing portion 2 to restrict the sheet conveyance. Note that the intent of the present invention is not limited to the above-described configuration shown in FIG. 14B. That is, to execute the present embodiment, it is not indispensable to provide an evacuating path 131 between the upper and lower two double-sided rollers 108 and 109. For example, the configuration as described below can be adopted. FIG. 22 is a schematic sectional side view to show the sheet reversing portion configured by arranging a large radius double-sided roller upward an approximately horizontal sheet material pathway. In FIG. 22, the selector flap 104 is biased by an unillustrated selector flap spring, and a spring force of the selector flap spring is set to a load to the extent of enabling the selector flap 104 to rotate when the high rigid recording sheet 4 abuts against the selector flap 104. In FIG. 22 also, the portions corresponding to each portion of FIG. 13 and FIGS. 14A and 14B are shown by the same reference numerals, and the details thereof will be omitted here by referring to the above described explanation.

Consequently, in case of a low rigidity recording sheet 4, the recording sheet 4 travels in the direction of the arrow mark a of FIG. 22 by the rotation of the first double-sided roller 108 in the direction of the arrow mark c, while the high rigidity recording sheet 4 pushes aside the selector flap 104 and travels to the evacuation path 131 in the direction of the arrow mark b. Therefore, even in case of using the long high rigidity recording sheet 4, it does not interfere with the sheet reversing portion 2 to restrict the sheet conveyance. As described above, the sheet reversing portion 2 of the present embodiment has two types of sheet material pathways, and it is possible also to execute one side recording on a high rigidity unbent recording sheet 4 without detaching the sheet reversing portion 2.

<Drive Mechanism of Sheet Reversing Portion>

Figure 15:
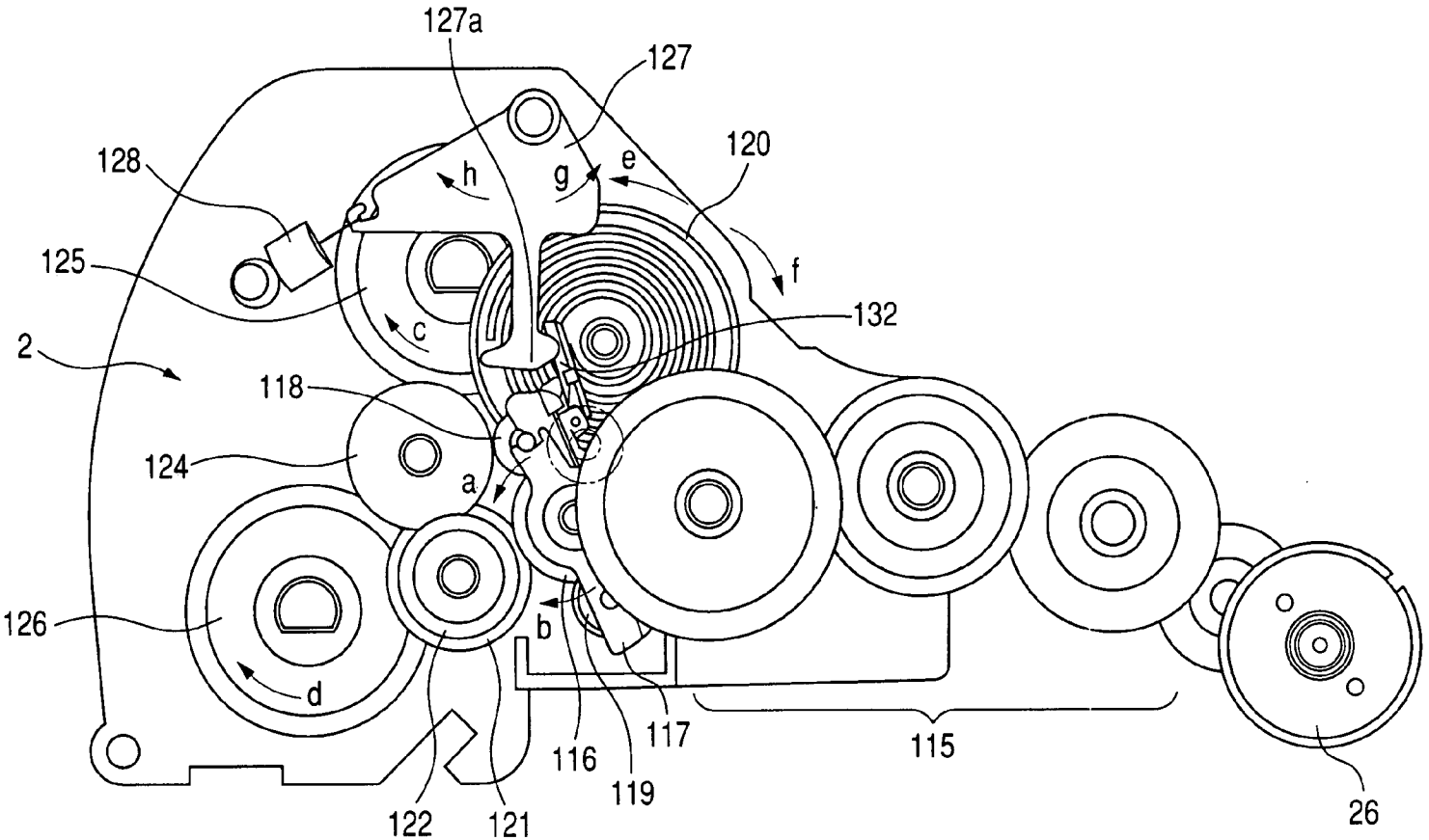
FIG. 15 is a schematic sectional side view to show the drive mechanism of the sheet reversing portion according to one embodiment of the present invention.

Next, the drive mechanism of the roller class of the sheet reversing portion 2 will be described. FIG. 15 is a schematic sectional side view to show a configuration of the drive mechanism of the roller class of the sheet reversing portion 2 seeing one embodiment (ref. FIG. 1) of the recording apparatus adopting the present invention from a side in opposition to FIG. 2. FIGS. 16A to 16F are schematic sectional side views to explain the operation of the drive mechanism of the roller class of the sheet reversing portion 2. Referring to the description of this drive mechanism, the driving force of the LF motor 26 is transferred to a double-sided sun gear 116 through a double-sided transfer gear row 115. A first double-sided planetary gear 118 and a second double-sided planetary gear 119 are rotatably attached to a double-sided pendulum arm 117, which is swingable with a double-sided sun gear 116 as a rotational center, with which the gears 118 and 119 are engaged. The double-sided pendulum arm 117 is attached with a double-sided pendulum arm spring 132.

A first reversing delay gear 121 is engageable with the second double-sided planetary gear 119, and the first reversing delay gear 121 and a second reversing delay gear 122 provided coaxially therewith are given a relative biasing force by a reversing delay gear spring 123. A first double-sided roller gear 125 fixed to the first double-sided roller 108 and a second double-sided roller gear 126 fixed to the second double-sided roller 109 are connected by a double-sided roller idler gear 124. A spiral groove gear 120 is engaged with the double-sided sun gear 116 through the idler gear. A stop arm 127 which swings by engaging with the groove of the spiral groove gear 120 is centered by a stop arm spring 128.

As described above, in the present embodiment, the driving force of the sheet reversing portion 2 is obtained from the LF motor 26 which drives the sheet passing roller 21. When the sheet passing roller 21 and the first double-sided roller 108 or the second double-sided roller 109 collaborate to convey the recording sheet 4 by setting up such a configuration, a conveyance speed of the recording sheet can be made approximately identical by allowing the start-stop timing to be completely synchronized. Hence, setting up such a configuration is most appropriate.

Since a configuration is set up such that an appropriate frictional force acts between the double-sided sun gear 116 and the double-sided pendulum arm 117, the double-sided pendulum arm 117 swings by following the rotational direction of the double-sided sun gear 116. Here, assuming that the direction allowing the LF motor 26 to rotate in a sheet discharge direction to which the sheet passing roller 21 conveys the recording sheet 4 as a forward direction, and the direction allowing the LF motor 26 to rotate in a direction to convey the recording sheet to the sheet reversing portion 2 side as a reverse direction, when the LF motor 26 rotates in the forward direction, the double-sided sun gear 116 rotates in the direction of the arrow mark a of FIG. 15. Accompanied by the rotation of the double-sided sun gear 116, the double-sided pendulum arm 117 also swings in the direction of the arrow mark a of FIG. 15. Then, the first double-sided planetary gear 118 engages with the double-sided roller idler gear 124 so as to rotate the double-sided roller idler gear 124. Accompanied by the rotation of the double-sided roller idler gear 124, the first double-sided roller gear 125 rotates in the direction of the arrow mark c, and similarly, the second double-sided roller gear 126 rotates in the direction of the arrow mark d. The directions of the arrow marks c and d of FIG. 15 are the directions to which the first double-sided roller 108 and the second double-sided roller 109 convey the recording sheet 4 within the sheet reversing portion 2.

When the LF motor 26 rotates in a reverse direction, the double-sided sun gear 116 rotates in the direction of the arrow mark b of FIG. 15. Accompanied by the rotation of the double-sided sun gear 116, the double-sided pendulum arm 117 also basically swings in the direction of the arrow mark b of FIG. 15. Then, the second double-sided planetary gear 119 engages with the first reversing delay gear 121. The first reversing delay gear 121 and the second reversing delay gear 122 have a projection projected, respectively, from thrust surfaces opposing to each other, which play a role of clutch means for allowing the projections to engage with each other when the first reversing delay gear 121 makes a one rotation with the second reversing delay gear 122 considered as fixed.

Prior to the engagement of the second double-sided planetary gear 119 with the first reversing delay gear 121, the above-described projections are biased in a direction to alienate each other by the reversing delay gear spring 123 in the space between the first reversing delay gear 121 and the second reversing delay gear 122, and after the first reversing delay gear 121 makes about one rotation after starting to rotate, the second reversing delay gear 122 starts to rotate. A period of time from when the LF motor 26 starts to rotate in the reverse direction until the second reversing delay gear 122 starts to rotate is a delay period of Lime where the first double-sided roller 108 and the second double-sided roller 109 are stopped.

When the second reversing delay gear 122 rotates, through the double-sided roller idler gear 124, the first double-sided roller gear is rotated in the direction of the arrow mark c of FIG. 15 and the second double-sided roller gear in the direction of the arrow mark d. This is the same direction as the rotational direction where the LF motor 26 is rotated in the forward direction. By such a mechanism, regardless of the rotational direction of the LF motor 26, it is possible to rotate the first double-sided roller 108 and the second double-sided roller 109 in a direction to convey the recording sheet 4.

Here, the operation of the spiral groove gear 120 will be described. The spiral groove gear 120 has a gear surface formed in its periphery, and at the edge of one side thereof, there is formed a cum which is cut with a spiral groove comprising caterpillars on the innermost periphery and the outermost periphery. This spiral groove gear 120, in the present embodiment, is connected to the double-sided sun gear 116 through the idler gear, and therefore, rotates in synchronization with the double-sided sun gear 116 in the same direction. Since the groove of the spiral groove gear 120 is engaged with a follower pin 127*a*, which is a part of the stop arm 127, Accompanied by the rotation of the spiral groove gear 120, the stop arm 127 swings. For example, when the spiral groove gear 120 rotates in the direction of the arrow mark e of FIG. 15, the follower pin 127*a* is led into the inner periphery, and therefore, the stop arm 127 swings in the direction of an arrow mark g. Even when the spiral groove gear 120 continues to rotate as it does in the direction of the arrow mark e of FIG. 15, the follower pin 127*a* enters the caterpillar of the innermost periphery, and therefore, the stop arm 127 stops at a predetermined position.

On the contrary, when the spiral groove gear 120 rotates in the direction of an arrow mark f of FIG. 15, the follower pin 127*a* moves in the direction of the outer periphery, and therefore, the stop arm 127 swings in the direction of an arrow mark h of FIG. 15. Similarly, when the spiral groove gear 120 continues to rotate in the direction of the arrow mark f, the follower pin 127*a* enters the caterpillar of the outermost periphery, and the stop arm 127 stops at a predetermined position. When the rotational direction of the spiral groove gear 120 is changed, the stop arm spring 128 centers the stop arm 127 with a center vicinity of its moving range as a center so that the movement from the outermost and innermost peripheral caterpillars to the spiral groove can be smooth.

The stop arm 127 operating in such a manner, as shown in FIGS. 16A to 16F, acts upon the double-sided pendulum arm spring 132 attached to the double-sided pendulum arm 117. The double-sided pendulum arm spring 132 is an elastic member, which is attached to the double-sided pendulum arm 117, and extends in the direction of the stop arm 127. The top end of the double-sided pendulum arm spring 132 is always positioned in the central direction of the spiral groove gear 120 rather than the stop arm 127.

Figure 16A:
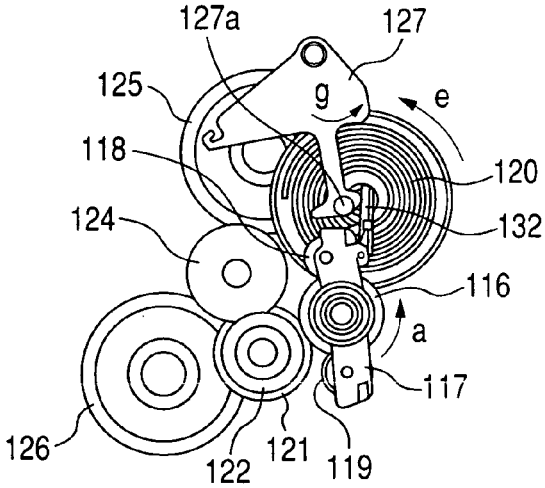
FIGS. 16A, 16B, 16C, 16D, 16E and 16F are explanatory drawings to show the operation of the drive mechanism of the sheet reversing portion according to one embodiment of the present invention.
Figure 16D:
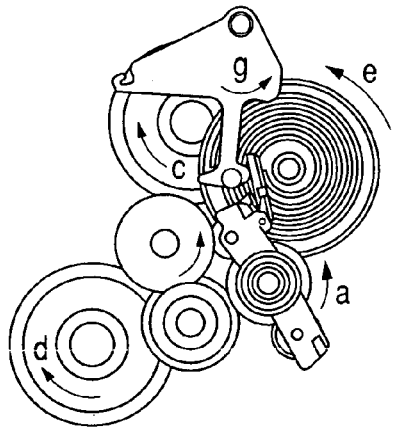

Because of such a positional relationship, when the LF motor 26 rotates in the forward direction, the following actions are given. That is, when the LF motor 26 rotates in a reverse direction to convey the recording sheet 4 to the sheet reversing portion 2, where the recording sheet 4 is reversed relative to the face side and the rear side and is returned to the sheet passing roller 21, as shown in FIG. 16C, the stop arm 127 engages with the caterpillar of the outermost periphery of the spiral groove gear 120. After that, when the LF motor 26 is rotated in the forward direction so as to execute the recording on the rear side surface, the stop arm 127 moves to the inner periphery of the spiral groove gear 120. When the LF motor 26 rotates in the forward direction, the double-sided pendulum arm 117 swings in the direction of the arrow mark a of FIG. 15, and therefore, as shown in FIG. 16D, the stop arm 127 in the middle of traveling to the inner periphery abuts against the double-sided pendulum arm spring 132.

When the LF motor 26 rotates further in the forward direction, the stop arm 127 moves further to the inner periphery so as to elastically deform the double-sided pendulum arm spring 132, and therefore, the posture of the double-sided pendulum arm 117 is decided by the balance of a force acting in the direction of an pressure angle when the tooth surfaces of the first double-sided planetary gear 118 and the double-sided roller idler gear 124 are mutually engaged, a force of swinging the double-sided pendulum arm 117 in the direction of an arrow mark a of FIG. 15 and a force of the repulsive force of the double-sided pendulum arm spring 132. In the case of the present embodiment, since the repulsive force of the double-sided pendulum arm spring 132 is set small, even when the stop arm 127, as shown in FIG. 16E, is in a position entering the caterpillar of the innermost periphery, only by elastically deforming the double-sided pendulum arm spring 132, the motive power transmission between the first double-sided planetary gear 118 and the double-sided roller idler gear 124 is continuously executed.

When the LF motor 26 is intermittently driven and repeats the rotation and the stop, even if the motor is in a stopped state, since the tooth surfaces of the first double-sided planetary gear 118 and the double-sided roller idler gear 124 mutually remain superposed, the engagement of both of them does not come off. However, after the recording on the rear side surface of the recording sheet 4 is completed, and when the transfer of the driving to the sheet reversing portion 2 comes to be not required, it is preferable that the driving is cut off to reduce the load of the LF motor 26. Hence, in case of desiring to cut off the transfer of the driving, the following method is executed.

Figure 16B:
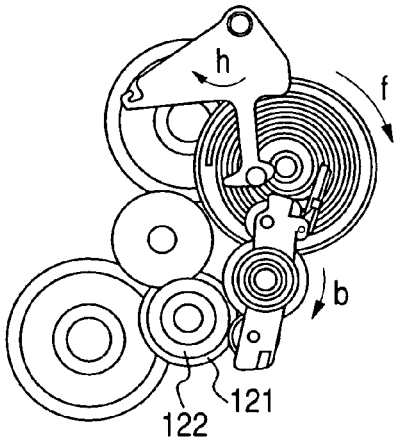
Figure 16E:
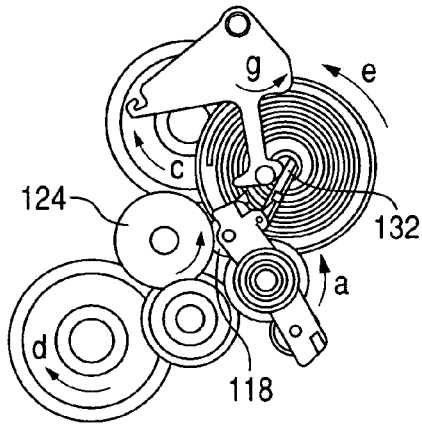
Figure 16C:
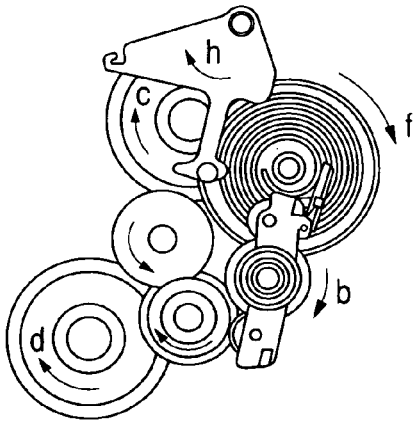
Figure 16F:
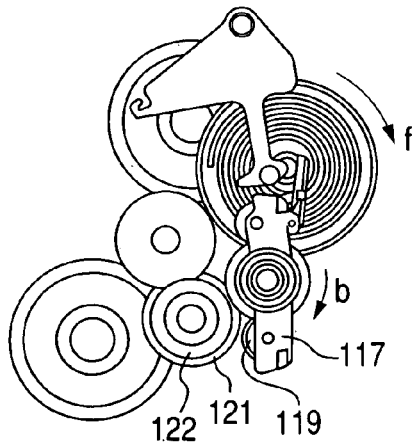

That is, the stop arm 127 enters the innermost peripheral caterpillar, and the double-sided pendulum arm spring 132 is in an elastically deformed state, and as shown in FIG. 16F, the LF motor 26 is slightly rotated in a reverse direction. By the repulsive force of the double-sided pendulum arm spring 132, the rotation of the double-sided pendulum arm 117 in the direction of the arrow mark b of FIG. 15 is stopped by the mutual overlapping of the tooth surfaces of the first double-sided planetary gear 118 and the double-sided roller idler gear 124. From this state, the rotation in the direction to remove the mutual overlapping of the tooth surfaces is given to the double-sided pendulum arm 117, so that the arm 117 is rotated at once in the direction of the arrow mark b of FIG. 15. When the double-sided pendulum arm 117 once rotates in the direction of the arrow mark b of FIG. 15, the elastically deformed double-sided pendulum arm spring 132 returns to its original state. Therefore, even when the LF motor 26 is rotated in the forward direction, because of the interference between the double-sided pendulum arm spring 132 and the stop arm 127, the double-sided pendulum arm 117 is unable to swing to the position where the first double-sided planetary gear 118 and the double-sided roller idler gear 124 are engaged. Therefore, from this state, the driving force cannot be transferred subsequent to the double-sided pendulum arm 117 inside the sheet reversing portion 2 unless a predetermined amount of rotation in the reversal direction of the LF motor 26 elapses. The driving till the double-sided pendulum arm 117 is effected only by the rotation of the gear row, and therefore, the load applied to the LF motor 26 is low, and there is hardly any difference with a load where the sheet reversing portion 2 is not attached.

When the LF motor 26 rotates in a reverse direction from the state where the stop arm 127 is in the caterpillar of the innermost periphery, since there is no action exerted between the double-sided pendulum arm spring 132 and the stop arm 127, the driving force is drivingly transferred to the first reversing delay gear 121 as described above.

As evident from the above-described description, according to the configurations of FIGS. 15 and 16A to 16F, in the both-side recording apparatus comprising the sheet passing roller 21, the recording portion N, and the sheet reversing portion 2, wherein, after the first surface (face side surface) of the recording sheet 4 is recorded at the recording portion N, the recording sheet 4 is conveyed to the sheet reversing portion by the sheet passing roller, and the recording sheet after having been reversed is nipped again by the sheet passing roller, and the second surface (rear side surface) of the recording sheet is recorded, the both-side recording apparatus is configured such that after the recording on the first surface is executed, the reversing portion roller starts rotating in synchronization with the sheet passing rollers 108 and 109 during the period of time from starting driving the sheet passing roller until the top end of the recording sheet is nipped by the reversing portion roller 109 of the sheet reversing portion. Further, the both-side recording apparatus is configured such that the reversing portion rollers 108 and 109 start rotating in synchronization with the sheet passing roller 21 by a first clutch means connected by a predetermined amount of rotation of the sheet passing roller 21 in a first rotational direction (rotation in the reversal direction) to convey the recording sheet 4 to the sheet reversing portion 2.

(Both-Side Recording Method)

Figure 20A:
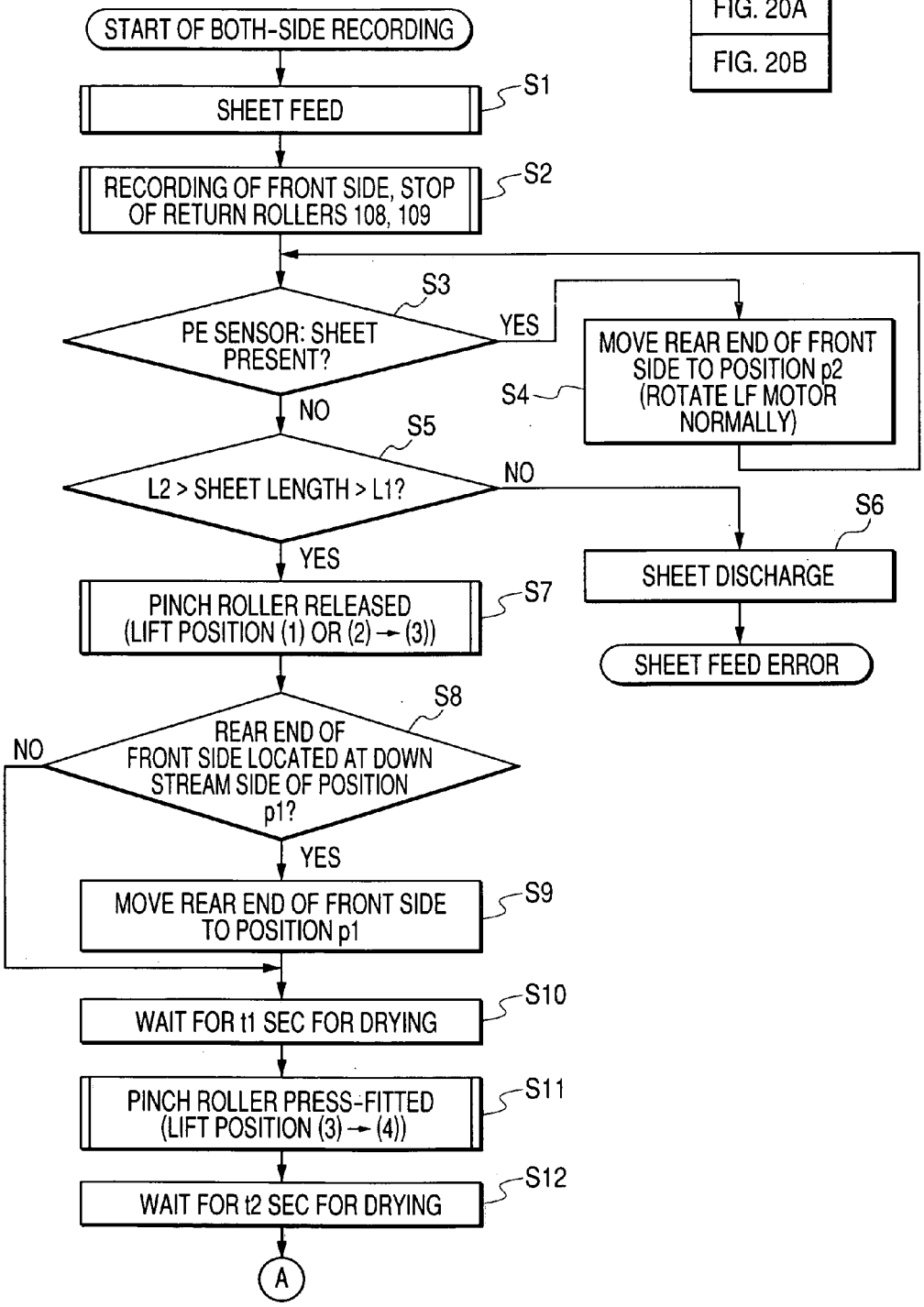
FIG. 20 which is composed of FIGS. 20A and 20B are flowcharts of an automatic both-side recording operation according to one embodiment of the present invention.
Figure 20:
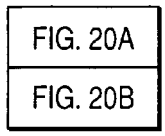
Figure 20B:
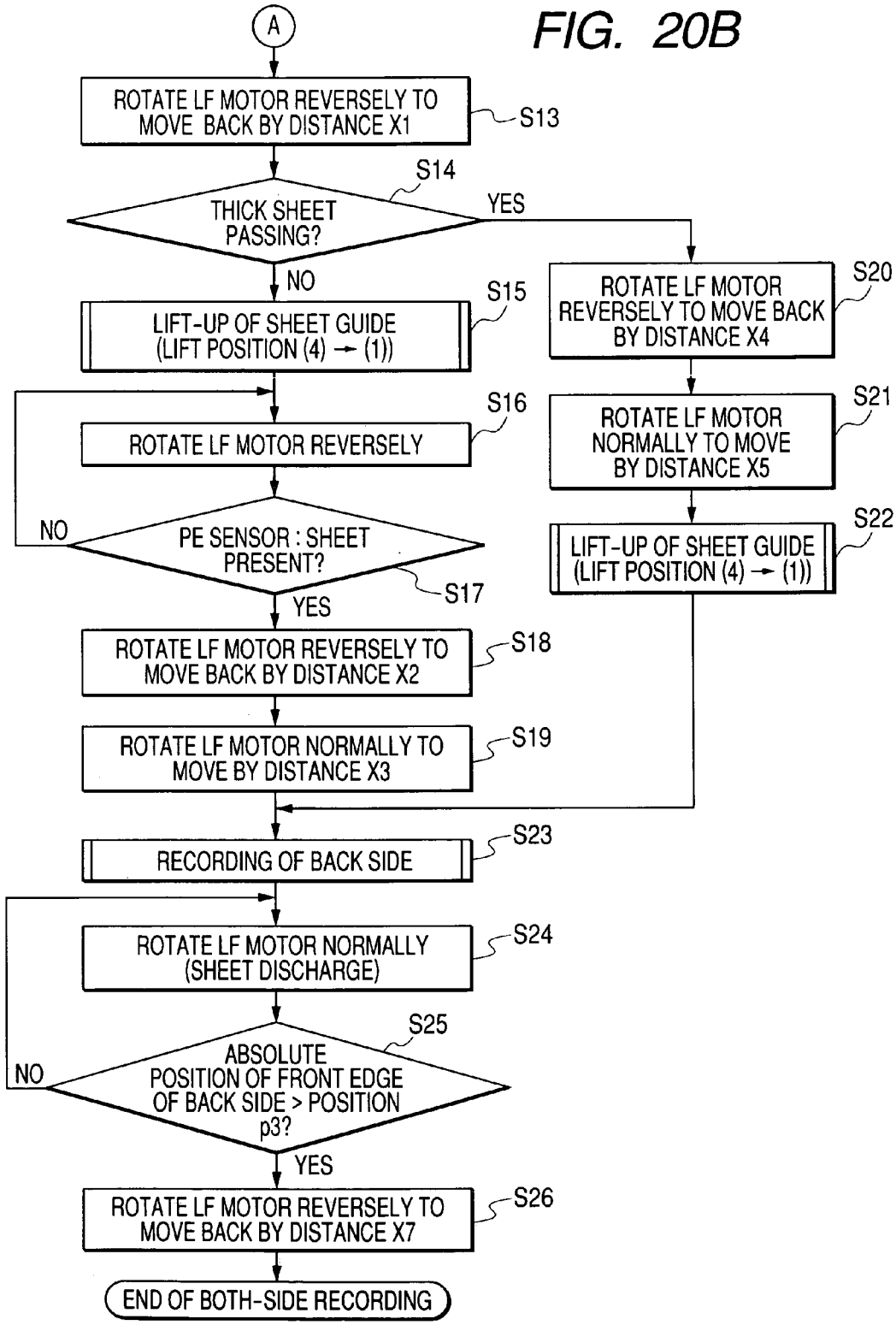

Next, the details of the automatic both-side recording of the present embodiment including the operation of the drive mechanism of the roller class of the sheet reversing portion 2 will be described with reference to the flowchart of FIGS. 20A and 20B.

When the automatic both-side recording is started, at step S1, the feeding of the recording sheet 4 is executed, and for example, the recording sheet 4 is supplied to the sheet passing roller 21 from the main ASF 37 and the like. Next, at step S2, the recording on the face side surface is executed. This is the same operation as that of the recording on one side only. The state of the drive mechanism of the roller class at this time is a state shown in FIG. 16A. That is, after the initialization of the drive mechanism of the sheet reversing portion 2, the LF motor 26 is in a state on the way to rotate in the forward direction, which is a state where the face side surface at the time of the automatic both-side recording is in the midst of being recorded or the ordinary recording operation is in the midst of being executed without using the automatic both-side recording. In this state, the follower pin 127*a* of the stop arm 127 is in the innermost peripheral caterpillar of the spiral groove gear 120, and when the double-sided pendulum arm 117 tries to swing in the direction of the arrow mark a of FIGS. 15 and 16A to 16F, the double-sided pendulum arm 117 is unable to move further because its arm spring 132 abuts against the stop arm 127, and moreover, the first double-sided planetary gear 118 is unable to engage with the double-sided roller idler gear 124. Hence, the driving force from the LF motor 26 is not transferred to the first double-sided roller gear 125 and the second double-sided roller gear 126. In this state, the first double-sided roller 108 or the second double-sided roller 109 where a shaft damage develops by receiving a pressure of the first double-sided pinch roller 112 or the second double-sided pinch roller 113 does not rotate, and therefore, the load received by the LF motor 26 is low.

Next, at step S3, upon completion of the surface recording, whether or not the rear end of the recording sheet 4 is detected by the PE sensor 67 is confirmed. That is, at this time, if the PE sensor 67 detects the recording sheet 4, since the rear end of the surface of the recording sheet 4 does not arrive as yet, the LF motor 26 is rotated in the forward direction as it is at step S4, and the rear end of the surface of the recording sheet 4 is moved up to a position p2 by passing through the PE sensor lever 66 and still traveling further. Next, at step S5, the length of the recording sheet 4 is calculated from the amount of conveyance of the recording sheet 4 from the detection by the PE sensor 67 of the top end of the surface of the recording sheet 4 to the detection of the rear end of the surface. As described above, when the length of the recording sheet 4 is shorter than the predetermined length L1, the sheet does not reach the roller while traveling from the sheet passing roller 21 to the second double-sided roller 109 or from the first double-sided roller 108 to the sheet passing roller 21, and therefore, it is necessary to remove the sheet from the automatic both-side recording operation. Further, when the length of the recording sheet 4 is longer than the predetermined length L2, the recorded surfaces of the recording sheet 4 are mutually intertwined on the way to the sheet material pathway from the sheet passing roller 21 to the sheet reversing portion 2, which is not preferable, and therefore, it is necessary to remove the sheet from the automatic both-side recording operation. When it is determined that the recording sheet be removed from the automatic both-side recording operation under this condition, the procedure advances to step S6, and the LF motor 26 is rotated in the forward direction so as to discharge the recording sheet 4 as it is. When the condition is suitable, the procedure advances to step S7, and the lift mechanism is put to the third position as shown in FIG. 16C so that the pinch roller 22 is released.

Next, at step S8, whether or not the rear end of the face side surface of the recording sheet 4 is already conveyed further to the downstream side than the position p1 of the vicinity of the pinch roller 22 is confirmed. In case already conveyed to the downstream side, when the pinch roller 22 is returned to a press-contacted state, at step S9, the LF motor 26 is rotated in the reverse direction to be back fed until the rear end of the face surface comes to p1 so as to be reliably nipped between the sheet passing roller 21 and the pinch roller 22. The state of the drive mechanism of the roller class at this time is a state shown in FIG. 16B. From step S2 to step S8, it is preferable that the operation does not stop as described above so that the step S9 is carried out before the recording sheet 4 is distorted. On the other hand, in case the rear end of the face surface is further at the upstream side than p1, if the pinch roller 22 is contact-pressed as it is, it is possible to reliably nip the recording sheet 4, and therefore, the procedure advances to step S10.

FIG. 16B shows a state immediately after the rotation of the LF motor 26 in a reverse direction is started. That is, it is a state (state of FIG. 12B) immediately after the back feed is started after the completion of the recording on the face side surface or a state where the LF motor 26 is reversed for the adjustment of the head poke amount after the sheet feeding from the main ASF 37. At this time, since there exists nothing at all to prevent the double-sided pendulum arm 117 from moving in the direction of the arrow mark b of FIG. 15 and FIGS. 16A to 16F, the second double-sided planetary gear 119 engages with the first reversing delay gear 121. Accompanied by this, though the first reversing delay gear 121 starts rotating, since the driving force is not transferred to the second reversing delay gear 122 until it makes approximately one rotation, the double-sided roller idler gear 124 does not rotate, and the first double-sided roller 108 and the second double-sided roller 109 are not operating. Consequently, even in this state, the load which the LF motor 26 receives is still low. The reason why such a state is set up is because, when the recording sheet 4 is back fed in the automatic both-side recording operation, since the distance from the sheet passing roller 21 to the second double-sided roller 109 is long, it is not necessary for the second double-sided roller 109 to rotate until the top end of the recording sheet 4 reaches the second double-sided roller 109. Further, as described above, it is to prevent the first double-sided roller 108 or the second double-sided roller 109 from unnecessarily rotating at the time of adjusting the head poke amount at the normal recording time.

Next, at step S10, the drying up of the ink on the recorded face side surface of the recording sheet 4 is awaited. The time required for the drying up of the ink depends on several factors, and therefore, a drying standby time t1 can be taken as a variable parameter. To be more precise, the t1 can be decided by taking into consideration the conditions such as a type of recording sheet 4, a type of ink, the superimpose shooting method of ink, the amount of shooting of ink for every unit area, an environmental temperature, an environmental humidity, an environmental velocity of wind, and the like.

Next, at step S11, the lift mechanism is put into the fourth position as shown in FIG. 10D. This allows the sheet passing roller 21 and the pinch roller 22 to nip the recording sheet 4 again. At step S12, only the drying standby time t2 is awaited. This t2 may not be used when the drying standby time t1 is carried out at step S10, and it is possible to advance to the next step by taking t2=0. The reason why the time t2 only is awaited is because, for example, when there exists a blank space not subjected to the recording operation in the rear end portion of the recording sheet 4, at step S10, assuming that t1=0, though no trouble develops even if the pinch roller 22 is immediately controlled to press-contact the blank space, there is a possibility that, if the recording sheet 4 is back fed and conveyed as it is, the ink before drying is transferred on the pinch roller 22, and thus in such a case, it is advantageous to set up the drying standby time t2 there.

At step S13, the LF motor 26 is rotated in the reverse direction, and the recording sheet is back fed by a predetermined amount x1. At this step S13, the recording sheet 4 is conveyed to the sheet reversing portion 2, and is reversed relative to the face side and the rear side. At this point of time when the step S13 is completed, the top end of the rear side surface returns slightly before this side of the sheet passing roller 21. The state of the roller class of the drive mechanism here is a state shown in FIG. 16C, and this is a state where the LF motor 26 continues to be reversed further in the reverse direction. That is, it is a state during a time when the recording sheet 4 is back fed, and is reversed at the sheet reversing portion 2. When the reversing delay gear 121 makes about one rotation from the state of FIG. 16B, the projection projected in the thrust direction of the first reversing delay gear 121 engages with the projection of the second reversing delay gear 122 provided in opposition to thereof, and the first reversing delay gear 121 and the second reversing delay gear 122 start rotating integrally. When the second reversing delay gear 122 starts rotating, since the second reversing delay gear 122 always engages with the double-sided roller idler gear 124, the double-sided roller idler gear 124, and the first double-sided roller gear 125 and second double-sided roller gear 126 rotate. Consequently, the first double-sided roller 108 rotates in the direction of the arrow mark c of FIG. 15 and the second double-sided roller 109 is rotated in the direction of the arrow mark d, respectively.

That is, in the present embodiment, the second double-sided roller 109 is configured to start a synchronous rotation with the sheet passing roller 21 during the period of time from when, after the driving of the sheet passing roller 21 is started, the top end of the recording sheet 4 is nipped by the second double-sided roller 109 of the sheet reversing portion 2 after the recording on the first surface (face side surface) is executed. Further, in the above-described configuration, by the first clutch means (ref. FIG. 15 and FIGS. 16A to 16F) connected by a predetermined amount of rotation of the sheet passing roller 21 in a first rotational direction (rotation in the reversal direction) to convey the recording sheet 4 to the sheet reversing portion 2, the second double-sided roller 109 is configured to start a synchronous rotation with the sheet passing roller 21. As the first clutch means, a configuration including mechanisms 120, 127 and 132 constraining a swing arm 117 which holds the planetary gears 118 and 119 is adopted.

Next, a so-called registration operation where the top end of the rear side surface is nipped by the nip portion between the sheet passing roller 21 and the pinch roller 22 will be described. First, at step S14, whether or not the recording sheet 4 currently used is a low rigidity thin sheet material or a high rigidity thick sheet material is confirmed. According to this confirmation, the control is changed. The rigidity of the recording sheet 4 may be determined by the type of recording sheet 4 set by a user's using a printer driver or determined by using detection means for measuring the thickness of the recording sheet. Here, the reason why the control is divided into two types is because, due to the rigidity of the recording sheet 4, its behavior varies when a loop is prepared by warping the recording sheet 4.

Figure 18A:
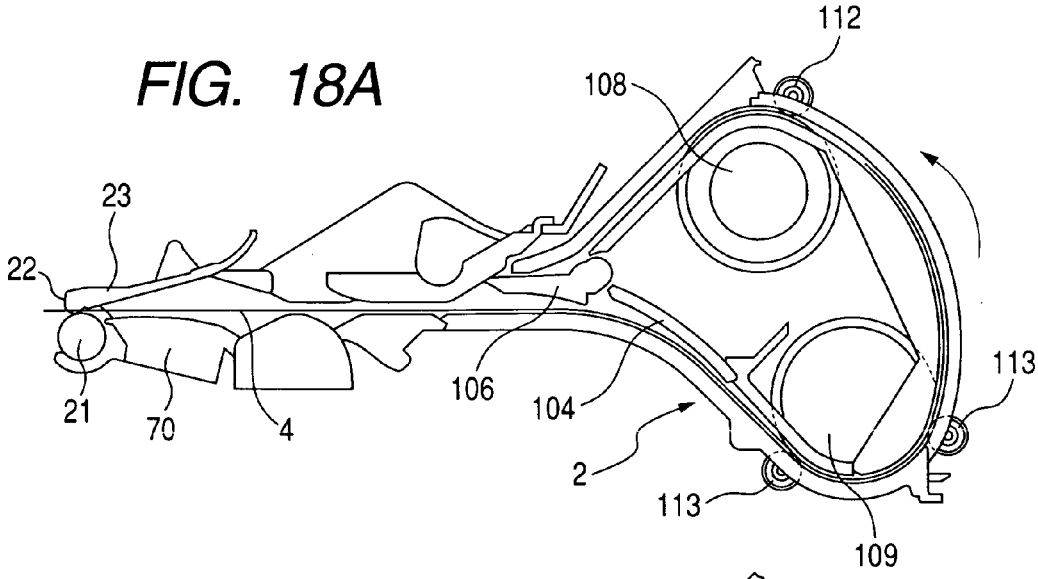
FIGS. 18A, 18B and 18C are explanatory drawings to show a registration operation of the top end of the rear side surface in case of using a thin recording sheet in the both-side recording apparatus according to one embodiment of the present invention.
Figure 18B:
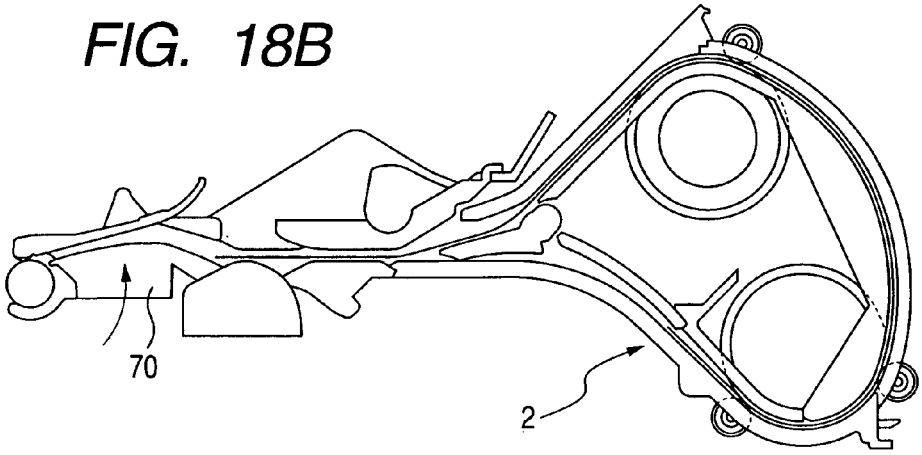
Figure 18C:
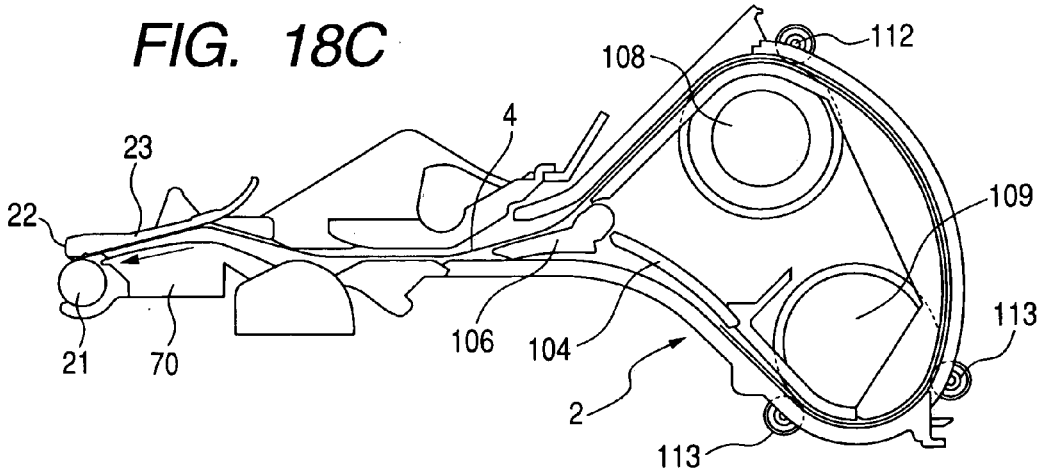

First, the case of a relatively low rigidity thin recording sheet 4 will be described. FIGS. 18A to 18C are schematic sectional side views to show a registration operation of the top end of the rear side surface in case of using a thin recording sheet 4. By the rotation of the LF motor 26 in the reverse direction at step S13, as shown in FIG. 18A, a conveyance for reversing the recording sheet 4 is executed. At the point of time when the step S13 is completed, the top end of the rear side surface of the recording sheet 4 returns to the approximate vicinity of the sheet passing guide 70. Next, in the case of the thin recording sheet 4, the procedure advances to step S15. At step S15, the lift mechanism is operated, and is moved to the first position as shown in FIG. 10A. This allows the sheet passing guide 70 to lift upward.

FIG. 18B shows a state where step S15 is completed. As described above, since the center of the pinch roller 22 is arranged slightly offset at the first sheet discharge roller 30 side for the center of the sheet passing roller 21, the nip portion between the sheet passing roller 21 and the pinch roller 22 is inclined with some angles for an approximately horizontal line in which the recording sheet 4 is conveyed. By bringing back the sheet passing guide 70 to the lifting position before the registration operation, it is possible to smoothly guide the top end of the rear side surface of the recording sheet 4 to this inclined nip portion. Next, at step S16, the LF motor 26 is rotated in the reverse direction, and the recording sheet 4 is conveyed further in the direction of the sheet passing roller 21. Next, at step S17, the top end of the rear side surface of the recording sheet 4 is detected by the PE sensor 67. When the top end of the rear side surface is detected, the procedure advances to step S18.

Next, at step S18, the recording sheet 4 is conveyed only for a distance X2, which is slightly longer than the distance from the position where the top end of the rear side surface is detected by the PE sensor 67 to the sheet passing roller 21. This allows the top end of the rear side surface of the recording sheet 4 to reach the nip portion between the sheet passing roller 21 and the pinch roller 22, and the portion (distance X2) conveyed further additionally of the recording sheet 4 is warped, and forms a loop. FIG. 18C shows a state where step S18 is completed. By placing the sheet passing guide 70 to the lifting position, the clearance in a height direction of the sheet material pathway becomes small, but since the rigidity of the recording sheet 4 is relatively low, the loop can be easily formed, and a force trying to eliminate the loop pushes forward the recording sheet 4. By doing so, the top end of the rear side surface of the recording sheet 4 becomes parallel with the sheet passing roller 21 by following the nip portion of the sheet passing roller 21 continuing to rotate in reverse and the pinch roller 22. Thus, a so-called registration operation is completed. The rotational direction of the LF motor 26 is turned to the forward direction at step S19, and the top end of the rear side surface of the recording sheet 4 is nipped by the nip portion, and is conveyed only for a predetermined distance X3, and the preparation of the start of the recording on the rear side surface is completed.

Figure 19A:
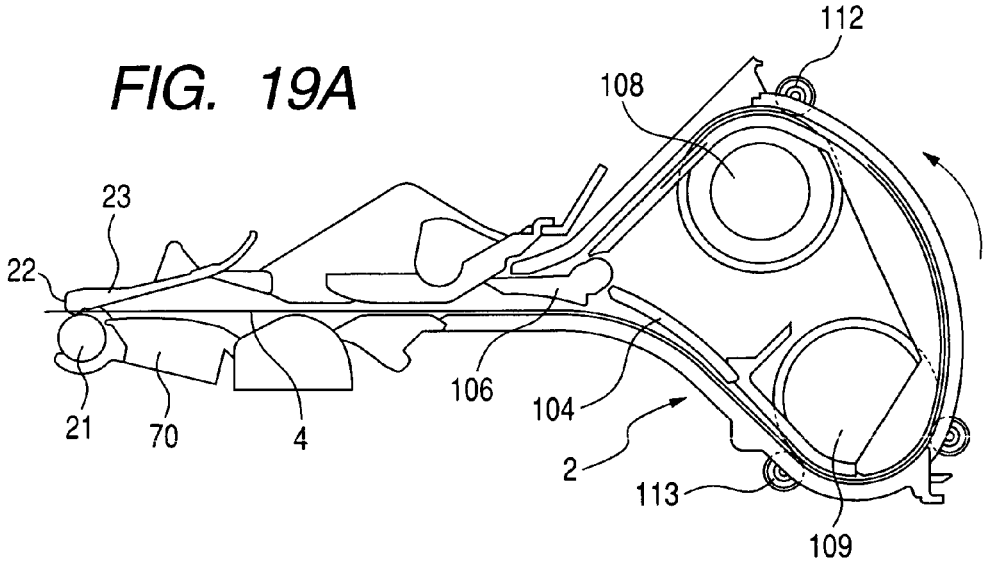
FIGS. 19A, 19B and 19C are explanatory drawings to show the registration operation of the top end of the rear side surface in case of using the thick recording sheet in the both-side recording apparatus according to one embodiment of the present invention.
Figure 19B:
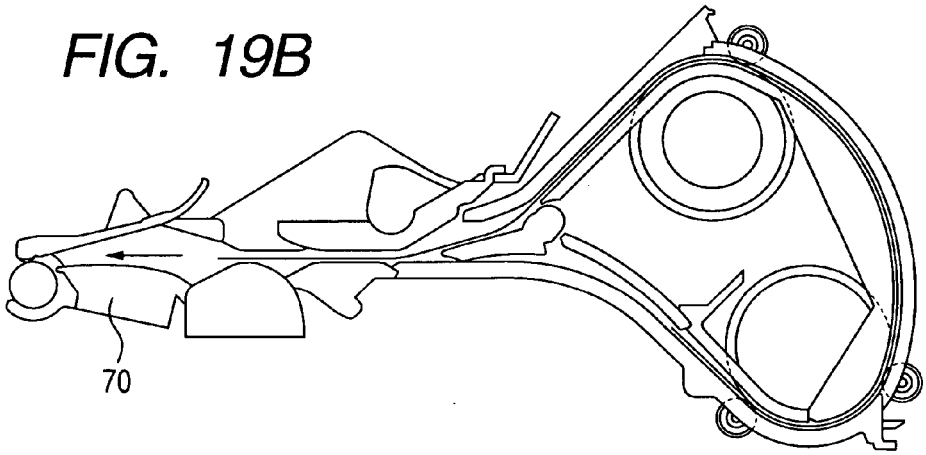
Figure 19C:
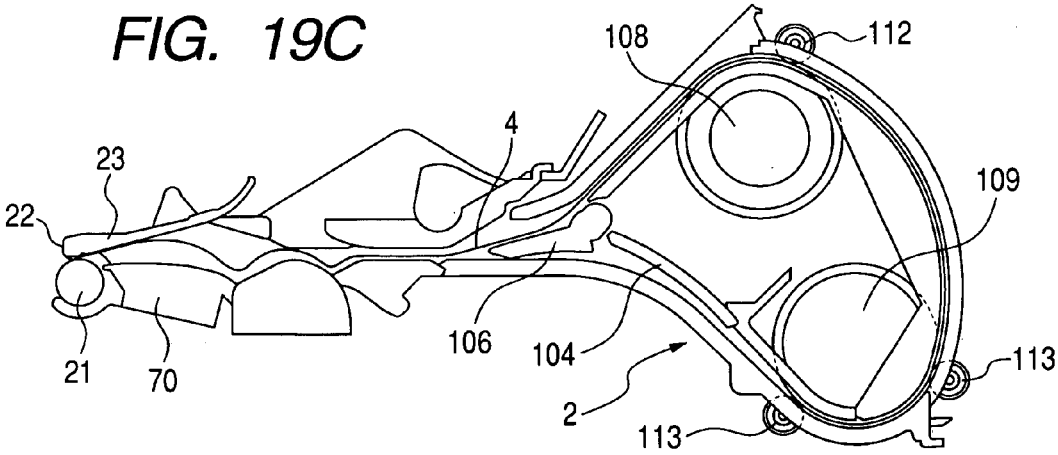

Next, the case of a thick recording sheet 4 having a relatively high rigidity will be described. FIGS. 19A to 19C are schematic sectional side views to show the registration operation of the top end of the rear side surface in case of using the thick recording sheet. FIG. 19A, similarly to FIG. 18A, shows a state on the way to step S13, and FIG. 19B shows a state where step S13 is completed.

At step S20, the LF motor 26 is rotated in the reverse direction while the sheet passing roller 70 remains in the descending position, and the recording sheet 4 is conveyed only for a distance X4 slightly longer than the distance to the nip of the sheet passing roller 21 from the top end of the rear side surface of the recording sheet 4 of the position stopped at step S13. By doing so, similarly to the case of the thin recording sheet 4, the top end of the rear side surface of the recording sheet 4 arrives at the nip portion of the sheet passing roller 21 rotated in reverse, and the portion (distance x4) conveyed additionally of the recording sheet 4 forms the loop, and therefore, the top end of the rear side surface of the recording sheet 4 becomes parallel with the sheet passing roller 21. Thus, the registration operation is completed. FIG. 19C shows a state where the step S20 is completed.

Next, at step S21, the rotational direction of the LF motor 26 is turned in the forward direction, and the top end of the rear side surface of the recording sheet 4 is nipped by the nip portion, and is conveyed only for a predetermined distance X3, and the preparation of the start of the recording on the rear side surface is executed. At step S19 or step S21, the LF motor 26 rotated in the reverse direction till then turns its rotational direction to the forward direction. At this time, the double-sided pendulum arm 117 swings in the direction of the arrow mark a of FIGS. 15 and 16A to 16F. Then, the engagement of the second double-sided planetary gear 119 and the first reversing delay gear 121 comes off. At the time of the rotation of the LF motor 26 in the reverse direction, though the first reversing delay gear 121 and the second reversing delay gear 122 engage with each other by the mutual projections, at the same time, the reversing delay gear spring 123 which is a torsional coil spring nipped between both of them is in a compressed state. However, as described above, the first reversing delay gear 121 becomes free (released state) so that the reversing delay gear spring 123 is expanded by a spring force, and therefore, the first reversing delay gear 121 makes an approx. one reversal rotation and returns to the initial state as shown in FIG. 16F.

Next, at step S22, the lift mechanism is put to the first position as shown in FIG. 10A, and the preparation of the start of the recording on the rear side surface is completed. Here, the reason why the sheet passing guide 70 is put to the descending position during the registration operation in case of using the thick recording sheet 4 will be described.

Similarly to the case of the thin recording sheet 4, when the attempt is made to form the loop as shown in FIG. 18C, when the rigidity of the recording sheet 4 is high, before arriving at the nip portion, the recording sheet 4 is conveyed along the pinch roller holder 23. Even if the attempt is made to form the loop after the recording sheet 4 reaches the nip portion and then is further conveyed, by this time, there remains no space capable of forming the loop, and the loop is not formed, and therefore, it is possible that there is the case where the registration is not taken aptly. This is the reason why. When the loop is not formed, the recording sheet 4 nipped at the same time between the first double-sided roller 108 and the sheet passing roller 21 is unable to have a slack. In case of using the mechanism such as the double-sided pendulum arm 117 for the drive mechanism of the roller class as with the present embodiment, during the period of time from the reversal rotation of the LF motor 26 at step S20 to the forward rotation of the LF motor 26 at step S21, a time for the double-sided pendulum arm 117 to swing is required, and during that time, the first double-sided roller 108 and the second double-sided roller 109 end up stopping. Since the sheet passing roller 21 is directly connected to the LF motor 26, there does not exist such a stopping time, and therefore, a speed differential arises in the conveying speed of the sheet. If the recording sheet 4 has a slack, the slack absorbs the speed differential of the conveying speed of the sheet during step S21. However, when there is no slack in the recording sheet 4, with the speed differential of the conveying speed of the sheet remaining not absorbed, the sheet passing roller 21 and the like try to forcibly convey the recording sheet, but since the rear portion of the recording sheet 4 is nipped by the first double-sided roller 108, practically the recording sheet 4 is not conveyed, and the amount of conveyance of the top end of the rear side surface of the recording sheet 4 is disturbed, and the blank space of the upper end of the rear side surface sometimes ends up becoming shorter than a predetermined amount.

Hence, in the present embodiment, to solve the above described problems, as described above, the sheet passing guide 70 is put to the descending position, and the clearance in the height direction with the pinch roller holder 23 is sufficiently taken, and a sufficient space capable of forming the loop is secured. By doing so, even in case of using the thick recording sheet 4 having a relatively high rigidity, an excellent registration operation is possible.

Next, at step S23, the recording on the rear side surface of the recording sheet 4 is executed. At this point of time, in most cases, the rear end portion of the rear side surface of the recording sheet 4 is still nipped by the first double-sided roller 108. While remaining in such a state, when the rotation of the first double-sided roller 108 is stopped, the roller 108 receives a load to pull the recording sheet 4 backward, and therefore, there is a possibility that a conveying accuracy of the sheet is deteriorated, which is not preferable. Consequently, at least during the rear end portion of the rear side surface of the recording sheet 4 is nipped by the first double-sided roller 108, the driving of the first double-sided roller 108 is configured to continue. At this time, the drive mechanism of the roller class is in a state as shown in FIG. 16D. FIG. 16D is a schematic sectional side view to show the operational state of the drive mechanism of the roller class of the sheet reversing portion 2 during the LF motor 26 is rotated in the forward direction after the reversing operation of the recording sheet 4. That is, when the LF motor 26 is turned to the forward rotation from the state shown in FIG. 16C, the double-sided pendulum arm 117 swings in the direction of the arrow mark a of FIGS. 15 and 16C to 16F. At this time, the stop arm 127 is swinging in the direction of the arrow mark h of FIG. 15, and even when the double-sided pendulum arm 117 swings in the direction of the arrow mark a of FIG. 15, the double-sided pendulum arm spring 132 does not abut against the stop arm 127, and therefore, the first double-sided planetary gear 118 engages with the double-sided roller idler gear 124 so that the driving force is transferred.

After that, when the LF motor 26 continues to rotate in the forward direction, the follower pin 127*a* moves to the inner periphery by being guided by the spiral groove gear 120, and the stop arm 127 swings in the direction of the arrow arm a of FIGS. 15 and 16A to 16F. While in the midst of swinging, the stop arm 127 abuts against the double-sided pendulum arm spring 132, and deforms the double-sided pendulum arm spring 132. By a reactive force due to the deformation of the double-sided pendulum arm spring 132, a force trying to swing in the direction of the arrow mark b of FIGS. 15 and 16A to 16F acts upon the double-sided pendulum arm 117, but during the driving force is transferred between the first double-sided planetary gear 118 and double-sided roller idler gear 124, since a force by which the gear tooth surfaces are mutually engaged is stronger, the engagement of the first double-sided planetary gear 118 and the double-sided roller idler gear 124 does not come off, and the driving is continued. FIG. 16D shows this state.

Further, as described above, even when an intermittent driving accompanied by a rotation and a stop is executed, since the tooth surfaces of the gears are superposed, the engagement of the first double-sided planetary gear 118 and the double-sided roller idler gear 124 does not come off. Further, when the recording operation on the rear side surface of the recording sheet 4 is continued and the LF motor 26 is rotated in the forward direction, the follower pin 127*a* reaches the innermost periphery of the spiral groove gear 120. The state of the double-sided roller class drive mechanism at this time is a state shown in FIG. 16E. At this time, the double-sided pendulum arm spring 132 is in a maximum displaced state, but in spite of that, the load of the double-sided pendulum arm spring 132 is set such that the force by which the gear tooth surfaces are mutually engaged become larger than the force to swing the double-sided pendulum arm 117, and therefore, the mutual engagement of the gears does not come off as long as the LF motor 26 continues to be rotated in the forward direction. When, during this time, the recording on the rear side surface of the recording sheet 4 is completed, the procedure advances to step S24.

Next, at step S24, a sheet discharge operation for discharging the recording sheet 4 on an unillustrated discharge tray is executed. In the sheet discharge operation, by continuing the rotation of the LF motor 26 in the forward direction, the recording sheet 4 is conveyed outside of a recording unit main body 1 by the second sheet discharge roller 31.

At step S25, a confirmation of the absolute position of the top end of the rear side surface is executed. This is because, in case of using the short recording sheet 4, it is appreciated that the follower pin 127*a* does not reach the innermost periphery of the spiral groove gear 120. Even in that case, the LF motor 26 is rotated only for a predetermined length, so that, when the recording operation on the rear side surface of the recording sheet 4 is completed, the follower pin 127*a* is allowed always to come to the innermost periphery of the spiral groove gear 120.

At step S26, the initialization of the drive mechanism of the roller class is executed. As described above, since a force charged by the double-sided pendulum arm spring 132 is maintained by the engagement of the first double-sided planetary gear 118 and the double-sided roller idler gear 124, a rotation of the LF motor 26 in the reverse direction only for a small amount allows the engagement to come off. That is, when the LF motor 26 is rotated in the reverse direction, the double-sided pendulum arm 117 tries to swing in the direction of the arrow mark b of FIGS. 15 and 16A to 16F, and therefore, the engagement of the first double-sided planetary gear 118 and the double-sided roller idler gear 124 comes off, and by a force by which the charged double-sided pendulum arm spring 132 turns back, the arm 117 at once swings in the direction of the arrow mark b of FIGS. 15 and 16A to 16F. The drive mechanism of the roller class at this time is in a state shown in FIG. 16F.

In the state of FIG. 16F, the posture of the double-sided pendulum arm spring 132 returns to its original state, and therefore, when the LF motor 26 rotates in the forward direction from this state, the double-sided pendulum arm 117 tries to swing in the direction of the arrow mark a of FIGS. 15 and 16A to 16F, but since the follower pin 127*a* enters the innermost peripheral vicinity of the spiral groove gear 120, the double-sided pendulum arm spring 132 ends up abutting against the stop arm 127, so that the first double-side planetary gear 118 is unable to engage with the double-sided roller idler gear 124. Further, even when the LF motor 26 is rotated in the forward direction, the follower pin 127*a* continues to rotate the innermost periphery of the spiral groove gear 120, and therefore, the first double-sided roller 108 and the second double-sided roller 109 are not driven.

That is, the both-side recording apparatus according to the present embodiment is configured such that, after the recording sheet 4 is conveyed from the sheet reversing portion 2 to nip the recording sheet by the sheet passing roller 21 again, during the period of time from when the rear end of the recording sheet 4 is alienated from the first double-sided roller 108 until the sheet discharge operation of the recording sheet is completed, the first double-sided roller 108 is not allowed to rotate in synchronization with the sheet passing roller 21.

In the above described configuration, a configuration is adopted such that, by a second clutch means (ref. FIGS. 15 and 16A to 16F) to be cut off by rotating the sheet passing roller 21 by a predetermined amount in the first rotational direction (reverse direction) after the sheet passing roller 21 is rotated for a predetermined amount in a second rotational direction (forward direction) to convey the recording sheet 4 from the sheet reversing portion 2 to the direction of the sheet passing roller 21, the first double-sided roller 108 does not synchronize with the sheet passing roller 21. Further, the second clutch means includes mechanisms 120, 127 and 132 which constrain the swing arm 117 holding the planetary gears 118 and 119. Further, the second clutch means includes a time differential mechanism by a helical end face cam (spiral groove gear 120) and a cam follower (stop arm 127).

Further, in the above described configuration, as described above, during the period of time from when the driving of the sheet passing roller 21 is started after the recording on the first surface (face side surface) until the top end of the recording sheet 4 is nipped by the second double-sided roller 109 of the sheet reversing portion 2, the second double-sided roller 109 is configured to start a synchronous rotation with the sheet passing roller 21, and moreover, by the first clutch means (ref. FIG. 15 and FIGS. 16A to 16F) to be connected by rotating the sheet passing roller 21 for a predetermined amount in the first rotational direction (reverse direction) to convey the recording sheet 4 to the sheet reversing portion 2, the second double-sided roller 109 is configured to start a synchronous rotation with the sheet passing roller 21.

In the state of FIG. 16F as described above, since the first reversing delay gear 121 is initialized at step S19 pr step S21, the entire initialization of the drive mechanism of the roller class in completed at step S26.

Thus, the automatic both-side recording operation is completed. When the automatic both-side recording operation is continuously executed, the above described sequence may be repeated.

In the present embodiment, by the action of the double-sided pendulum arm spring 132 as described above, though an elastic abutting relationship is realized between the double-side pendulum arm 117 and the stop arm 127, in replacement of such a relationship, it is possible to adopt the configuration as shown in FIGS. 17A to 17E. FIGS. 17A to 17E, similarly to FIG. 16, are schematic sectional side views to show the operational state of the drive mechanism of the roller class of the sheet reversing portion 2. The double-sided pendulum arm 117 of FIGS. 17A to 17E has an arm of low elasticity, and its arm and the stop arm 127 are in the relationship capable of abutting against each other. The operation of this configuration will be simply described below.

Figure 17A:
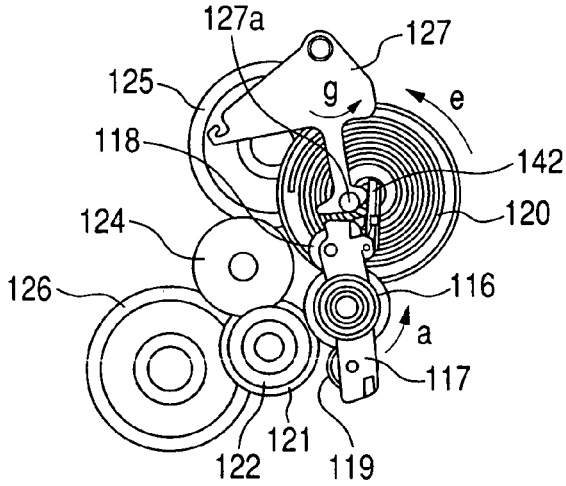
FIGS. 17A, 17B, 17C, 17D and 17E are explanatory drawings to show the operation of another example of the drive mechanism of the sheet reversing portion according to one embodiment of the present invention.
Figure 17D:
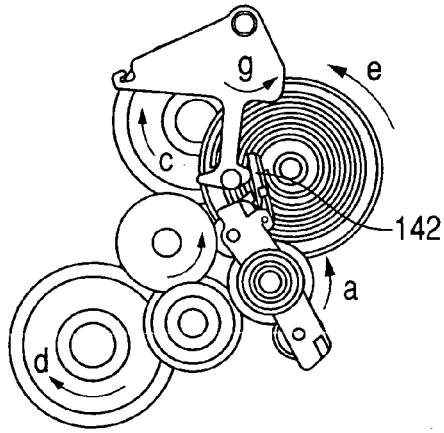
Figure 17B:
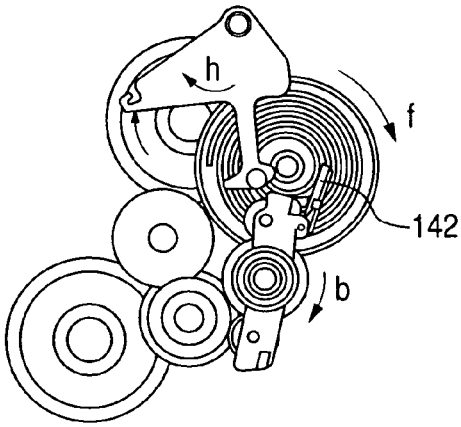
Figure 17E:
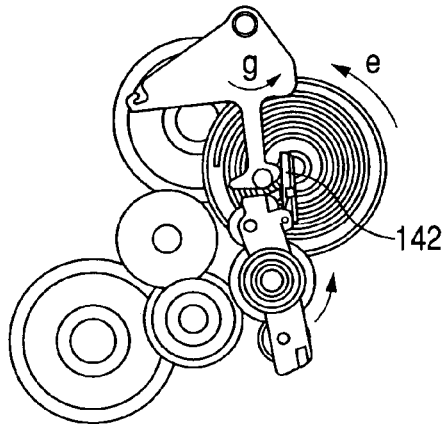
Figure 17C:
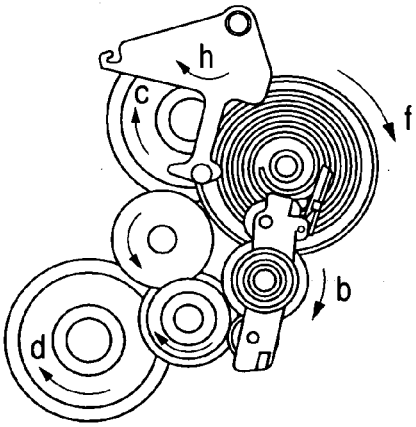

The operation of FIGS. 17A to 17C is the same as that of FIGS. 16A to 16C, and therefore, the description thereof will be omitted.

FIG. 17D shows a state where the stop arm 127 moves in the innerperipheral direction of the spiral groove gear 120 and abuts against the arm 142 of the double-sided pendulum arm 117. Since the arm 142 of the double-sided pendulum arm 117 does not have much elasticity, when the arm 142 is pushed by the stop arm 127, a force to rotate the double-sided pendulum arm 117 in the direction of the arrow mark b of FIG. 17 is operated. That force works in the direction to disconnect the engagement between the first double-sided planetary gear 118 and the double-sided roller idler gear 124. The force trying to disconnect the engagement corresponds to pressure acting between the tooth surfaces of the first double-sided planetary gear 118 and the double-sided roller idler gear 124 and an elasticity as well as a slippage force of the gears. In the course of time, as the follower pin 127*a* moves to the inner periphery, the force to disconnect the engagement becomes large enough to overcome the force acting between the tooth surfaces, and forcibly releases the engagement between the first double-sided planetary gear 118 and the double-sided roller idler gear 124. When the engagement is released, at the same time, the rotation of the first double-sided roller 108 and the second double-sided roller 109 are stopped. FIG. 17E shows this state. The timing to stop the rotation of this roller is set at an appropriate period of time during step S23 after the rear end of the rear side surface of the recording sheet 4 passes through the first double-sided roller 108.

That is, in the configuration of FIGS. 17A to 17E, in replacement of the second clutch means described in FIGS. 16A to 16F, by using third clutch means 120, 127 and 142 to be cut off by rotating the sheet passing roller 21 by a predetermined amount in the second rotational direction (forward direction), the first double-sided roller 108 is configured not to synchronously rotate with the sheet passing roller 21. Further, the third clutch means in the configuration of FIGS. 17A to 17E includes a mechanism to forcibly replace the swing arm 117 for maintaining the planetary gears 118 and 119, and moreover, includes the time differential mechanism by the helical end face cam (spiral groove gear 120) and the cam follower (stop arm 127).

Further, even in the both-side recording apparatus having the mechanism of FIGS. 17A to 17E, as described above, during the period of time from when the driving of the sheet passing roller 21 is started after the recording on the first surface (face side surface) until the top end of the recording sheet 4 is nipped by the second double-sided roller 109 of the sheet reversing portion 2, the second double-sided roller 109 is configured to synchronously rotate with the sheet passing roller 21, and moreover, by the first clutch means (ref. FIG. 15 and FIGS. 16A to 16F) to be connected by rotating the sheet passing roller 21 in the first rotational direction (reverse direction) to convey the recording sheet 4 to the sheet reversing portion 2 for a predetermined amount, the second double-sided roller 109 is configured to start the synchronous rotation with the sheet passing roller 21.

Subsequent to the release of the engagement of the gears as shown in FIG. 17C, even when the LF motor 26 rotates in the forward direction, the swinging of the double-sided pendulum arm 117 in the direction of the arrow mark a of FIGS. 17A to 17E is prevented by the stop arm 127, and therefore, the sheet reversing portion 2 is not driven until the LF motor 26 is rotated in the reverse direction next time for a predetermined amount. Further, similarly to the first embodiment, since the first reversing delay gear 121 is initialized also at step S19 or step S21, at this point of time, the initialization of the drive mechanism of the roller class of the sheet reversing portion 2 is completed. This allows a load to rotate the first double-sided roller 108 and the second double-sided roller 109 to be eliminated during the recording on the rear side surface, thereby reducing the rotational load of the LF motor 26.

(Change of Carriage Position)

Next, the case of changing the carriage position by the types of the recording sheet 4 will be described. Depending on the type of recording sheet 4, there are the cases where the recording sheet 4 is warped by the environmental condition under which it is stored or the recording sheet 4 is warped by the shooting of the ink after the recording is completed. The recording portion 11 and the recording sheet 4 in the midst of the conveyance are arranged in such a manner as to execute the recording operation with predetermined clearance provided between thereof. However, when the warp of the recording sheet is larger than the clearance, there is a possibility of the recording portion 11 to contact the recording sheet 4, of which three examples are cited as follows.

The first example is the case where the recording sheet 4 is warped before the sheet is fed to the recording apparatus. As its example, for example, an inkjet postcard and a sheet material having a coat layer on one side to absorb the ink and the like can be cited. When these recording sheets 4 are left alone under low humidity environment, they are often curved in a direction decided from the watermark of the sheet and the position of the coat layer. When they are conveyed as they are, at the final stage of the recording operation on the face side surface, the rear end portion of the recording sheet 4 comes off the nip portion of the pinch roller 22, and the end portion of the recording sheet 4 curves upward and sometimes abuts against the recording head 11, while being maintained by the sheet discharge roller and the spur. Once abutted, the ink adheres on an unintended portion of the recording sheet 4, and in the worst case, there is a possibility that, accompanied by the scanning of the recording portion 13, the recording portion hits upon the side end portion of the recording sheet 4, thereby shifting the position of the recording sheet 4. Consequently, in case of using this type of recording sheet 4, it is advantageous that at the recording operation on the face side surface, the carriage 13 is set in advance at a second carriage position, that is, a position where the clearance S2 is produced between the recording head 11 and the recording sheet 4 as shown in FIG. 10B. At this time, during the recording operation on the rear side surface, since the warped direction of the recording sheet 4 is opposite to the face side surface, a possibility of contact between the recording portion and the recording sheet 4 barely exists, and therefore, the recording operation can be executed by returning the carriage 13 to a first carriage position which is suitable in view of the recording dignity, that is, a position where the clearance S1 is produced between the recording head 11 and the recording sheet 4 as shown in FIG. 10A. The above is the case where the recording operation is executed at the second carriage position in case of the face side surface and at the first carriage position in case of the rear side surface.

The second example is the case of the recording sheet 4 easy to deform by the absorption of the ink. As its example, a thin sheet material lacking an elasticity, a sheet material using a swellable paper fiber and the like can be cited. When the recording is executed on these recording sheet 4, as the time elapses after the ink is absorbed, the deformation amount of the sheet material is gradually increased to a certain degree of amount. At the time of the recording operation on the face side surface, it does not matter if the distance between the recording portion and the recording sheet 4 is short, but at the time of the recording operation on the rear side surface, since the recording sheet 4 is greatly deformed due to undulation caused by the ink absorption, there is a possibility that the recording portion and the recording sheet 4 end up coming into contact. Consequently, in case of using this type of recording sheet 4, it is preferable that the carriage is put to the second carriage position only in case of the recording on the rear side surface. The above is the case where the recording operation is executed at the first carriage position and the second carriage position on the face side surface and the rear side surface, respectively.

The third example is the case where the recording is executed on the recording sheet having the above described two properties at the same time. In this case, there is a possibility that the recording portion and the recording sheet 4 come in contact at the time of the recording on any of the face side surface or the rear side surface, and therefore, it is suitable that the carriage 13 is always put to the second carriage position. This is the case where the recording operation is executed at the second carriage position on any of the face side surface and the rear side surface.

The above described three carriage positions can be selected by various methods. For example, the case where the user operates carriage position selection means such as a switch added to the recording apparatus main body or the case where the carriage position is selected by the type of sheet material set by the user at the recording operation command time at the host device 308 or the case where the type of the recording sheet is detected by sheet material detection means at the recording apparatus main body or the case where the deformation amount of recording sheet is detected by deformation amount detection means at the recording apparatus main body, and the like can be cited.

If the use of the recording sheet 4 hard to develop the warp is taken into consideration, similarly to the conventional recording apparatus, it is preferable that the recording operation on any of the face side surface and the rear side surface is executable at the first carriage position having a short clearance between the recording portion and the recording sheet 4 suitable for the recording dignity. In that case, the selection of four carriage positions is executed by some methods as described above. Further, with respect to a very thick or a high rigidity recording sheet 4, by using the both-side recording apparatus of the present embodiment, it is possible to execute the one side recording only on the face side surface without reversing the face side and the rear side nor executing the recording on the rear side surface.

The above is the description of the automatic both-side recording operation along the flowchart showing the operational sequence on the both-side recording apparatus of the present embodiment.

The present invention is not limited to the above described configurations, but it is possible to control the change of the position of the lift mechanism as described in FIGS. 10A to 10D. That is, in the above described embodiment, though the sheet passing guide 70 is in a lifting state in the normal standby state, it is possible to change this state to the descending state. To be more precise, usually, though the lift mechanism is put to the third position as shown in FIG. 10C, the control may be added in such a manner that, before advancing to step S1, the lift mechanism is moved to the first position as shown in FIG. 10A from this third position. Further subsequent to step S26, the control may be added in such a manner that the lift mechanism is moved to the third position from the first position. In case of such configuration, since the pinch roller 22 is in a release state in a standby state, it is suitable when the thick sheet and the like are fed from the sheet discharge roller side.

In the present embodiment, though a serial type recording apparatus for executing the recording while moving the recording head 11 in the main scanning direction has been described, the present invention can be also similarly adopted for a line type recording apparatus which executes recording using a line type recording means having a length to cover a part or a whole width of the recording sheet 4 while performing sub-scan (sheet feeding) only, and can achieve the same advantages.

According to the above described explanation, though the configuration capable of selecting two or three carriage positions (clearance between the recording portion and the recording sheet) at the recording time has been described, the configuration capable of selecting a more number of carriage positions (clearance) or the configuration capable of setting the clearance steplessly can be adopted.

The present invention can be freely executed regardless of the number of recording means, and in addition to the recording apparatus using one recording means, the recording apparatus for a color recording using a plurality of recording means using the ink of different colors or the recording apparatus for a gradation recording using a plurality of recording means using the ink having the same color but different in density, or furthermore, the recording apparatus which combines these recording means can be also similarly adapted to the present invention, and the same advantages can be obtained.

Further, the present invention can be similarly adapted to the configuration using a replaceable head cartridge integrating the recording head 11 and the ink tank 12 when a recording apparatus is the inkjet recording apparatus or the configuration separating the recording head 11 and the ink tank 12 into a separate body and connecting them by an ink supply tube and the like regardless of whatever arrangement configuration is provided between the recording head 11 and the ink tank 12 and the same advantages can be obtained.

In addition to the recording apparatus using an ink ejection type inkjet recording head by using thermal energy when the recording apparatus is an inkjet recording apparatus, the present invention can be similarly adapted, for example, to the inkjet recording apparatus using other ink ejection type such as the recording apparatus using the ink ejection type inkjet recording head by using an electromechanical conversion body such as an piezo element and the like, and the same operation and the same advantages can be achieved.

This application claims priority from Japanese Patent Application No. 2003-306417 filed Aug. 29, 2003, which is hereby incorporated by reference herein.

What is claimed is:

1. A recording apparatus executing recording on both surfaces of a recording sheet with a recording head, comprising:

a carriage for moving with the recording head mounted thereon;

a conveying roller provided upstream of said carriage relative to a conveying direction of the recording sheet, for conveying the recording sheet;

a sheet reversing portion for reversing the recording sheet relative to a front surface and a rear surface by conveying the recording sheet of which a first surface has been recorded, by said conveying roller, in a conveying direction reverse to that in recording the recording sheet with the recording head;

changing means for changing a clearance between the recording head and the recording sheet; and a control portion for controlling the changing means for changing the clearance between the recording head and the recording sheet when a second surface of the recording sheet is recorded to be less than that when the first surface of the recording sheet is recorded.

2. The recording apparatus according to claim 1, wherein the clearance at the time of recording on the first surface and the clearance at the time of recording on the second surface are set according to the type of recording sheet.

3. The recording apparatus according to claim 1, wherein recording on the first surface only without operating said sheet reversing portion is selectively executed depending on the type of the recording sheet.

4. A recording method for executing recording on both surfaces of a recording sheet with a recording head, comprising the steps of:

arranging a carriage for moving with the recording head mounted thereon;

arranging a conveying roller upstream of the carriage relative to a conveying direction of the recording sheet, for conveying the recording sheet;

executing recording on a first surface of the recording sheet with the recording head;

reversing the recording sheet relative to a front surface and a rear surface by conveying the recording sheet of which the first surface has been recorded, by the conveying roller, in a conveying direction reverse to that in recording the recording sheet with the recording head; and changing a clearance between the recording head and the recording sheet when a second surface of the recording sheet is recorded to be less than that when the first surface of the recording sheet is recorded.

5. The recording method according to claim 4, wherein the first clearance and the second clearance are set according to the type of the recording sheet.

6. A recording method for selectively executing recording on both surfaces of a recording sheet with a recording head, comprising the steps of:

arranging a carriage for moving with the recording head mounted thereon;

arranging a conveying roller upstream of the carriage relative to a conveying direction of the recording sheet, for conveying the recording sheet;

selectively executing recording on a first surface of the recording sheet only, without reversing the recording sheet, with the recording head depending on the type of the recording sheet;

reversing the recording sheet relative to a front surface and a rear surface, when recording is not on a first surface only, by conveying the recording sheet of which the first surface has been recorded, by the conveying roller, in a conveying direction reverse to that in recording the recording sheet with the recording head; and when there is reversing of the recording sheet, changing a clearance between the recording head and the recording sheet when a second surface of the recording sheet is recorded to be less than that when the first surface of the recording sheet is recorded.

* * * * *

UNITED STATES PATENT AND TRADEMARK OFFICE

CERTIFICATE OF CORRECTION

PATENT NO. : 7,192,207 B2
APPLICATION NO. : 10/925028
DATED : March 20, 2007
INVENTOR(S) : Tetsuyo Ohashi et al.

It is certified that error appears in the above-identified patent and that said Letters Patent is hereby corrected as shown below:

ON THE TITLE PAGE:
At Item (56), References Cited, Foreign Patent Documents, "JP 2000218893 8/2000" should read --JP 2000-218893 8/2000--, "JP 2002127541 5/2002" should read --JP 2002-127541 5/2002--, and "JP 2004098412 4/2004" should read --JP 2004-098412 4/2004--.

COLUMN 2:
Line 12, "an" should read --a--.

COLUMN 6:
Line 35, "surfaces" should read --surface--.

COLUMN 12:
Line 29, "dignity." should read --quality.-- .

COLUMN 27:
Line 23, "Lime" should read --time--.
Line 40, "cum" should read --cut--.

COLUMN 28:
Line 37, "an" should read --a--.

Signed and Sealed this

Fourth Day of December, 2007

JON W. DUDAS
*Director of the United States Patent and Trademark Office*